US012584264B2

(12) United States Patent
Lee et al.

(10) Patent No.: US 12,584,264 B2
(45) Date of Patent: Mar. 24, 2026

(54) CLOTHES CARE APPARATUS

(71) Applicant: SAMSUNG ELECTRONICS CO., LTD., Suwon-si (KR)

(72) Inventors: Myungwoo Lee, Suwon-si (KR); Jaeryong Park, Suwon-si (KR); Younghak Kong, Suwon-si (KR); Byeongcheol Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 110 days.

(21) Appl. No.: 18/744,016

(22) Filed: Jun. 14, 2024

(65) Prior Publication Data

US 2025/0066983 A1 Feb. 27, 2025

Related U.S. Application Data

(63) Continuation of application No. PCT/KR2024/006561, filed on May 14, 2024.

(30) Foreign Application Priority Data

Aug. 25, 2023 (KR) ..... 10-2023-0112163
Aug. 25, 2023 (KR) ..... 10-2023-0112166
(Continued)

(51) Int. Cl.
*D06F 39/08* (2006.01)
*D06F 39/14* (2006.01)

(52) U.S. Cl.
CPC ..... *D06F 39/088* (2013.01); *D06F 39/14* (2013.01)

(58) Field of Classification Search
CPC ..... D06F 39/088
See application file for complete search history.

(56) References Cited

U.S. PATENT DOCUMENTS 11,525,208 B2 12/2022 Song
11,591,746 B2 2/2023 Woo et al.
(Continued)

FOREIGN PATENT DOCUMENTS

CN 204162934 U 2/2015
CN 208748389 U 4/2019
(Continued)

OTHER PUBLICATIONS

International Search Report dated Sep. 9, 2024 issued in PCT Application No. PCT/KR2024/006561.
(Continued)

*Primary Examiner* — Jason Y Ko
(74) *Attorney, Agent, or Firm* — STAAS & HALSEY LLP

(57) ABSTRACT

A clothes care apparatus includes a cabinet; a first chamber formed inside the cabinet, and configured to accommodate a garment; a first door configured to open or close the first chamber, having a second chamber separated from the first chamber, and configured to accommodate a garment, and including a door water supply tub and a door drain tub; a second door pivotally coupled to the first door to open or close the second chamber; and a spot cleaning device arranged inside the second chamber to spot clean the garment accommodated in the second chamber, and including a water supply tub to receive water from the door water supply tub, and a drain tub to release the water from the second chamber to the door drain tub.

15 Claims, 37 Drawing Sheets

(30) Foreign Application Priority Data

Oct. 24, 2023 (KR) ..... 10-2023-0142689
Dec. 1, 2023 (KR) ..... 10-2023-0172804

(56) References Cited

U.S. PATENT DOCUMENTS

| | | | |
|---|---|---|---|
| 2004/0206131 | A1 | 10/2004 | Kleker |
| 2017/0292213 | A1 | 10/2017 | Lv et al. |
| 2022/0125253 | A1 | 4/2022 | Matsuda et al. |
| 2023/0145586 | A1 | 5/2023 | Heo et al. |
| 2023/0151535 | A1 | 5/2023 | Kim et al. |
| 2023/0235500 | A1 | 7/2023 | Kim et al. |
| 2023/0272576 | A1 | 8/2023 | Choi et al. |

FOREIGN PATENT DOCUMENTS

| | | | |
|---|---|---|---|
| CN | 111188179 | A | 5/2020 |
| CN | 112302487 | A | 2/2021 |
| CN | 116065371 | A | 5/2023 |
| KR | 10-2007-0109319 | | 11/2007 |
| KR | 10-2013-0017029 | | 2/2013 |
| KR | 10-2015-0071904 | | 6/2015 |
| KR | 10-2017-0075736 | | 7/2017 |
| KR | 10-2018-0052956 | | 5/2018 |
| KR | 10-2020-0025946 | | 3/2020 |
| KR | 10-2021-0062398 | | 5/2021 |
| KR | 10-2021-0098406 | | 8/2021 |
| KR | 10-2021-0117199 | | 9/2021 |
| KR | 10-2022-0056090 | | 5/2022 |
| KR | 10-2022-0137612 | | 10/2022 |
| WO | WO 2019/194565 | A1 | 10/2019 |

OTHER PUBLICATIONS

Written Opinion dated Sep. 9, 2024 issued in PCT Application No. PCT/KR2024/006561.

CLOTHES CARE APPARATUS

CROSS REFERENCE TO THE RELATED APPLICATION

This application is a continuation application, filed under 35 U.S.C. § 111 (a), of International Application PCT/KR2024/006561 filed on May 14, 2024, and is based on and claims priority under 35 U.S.C. § 119 to Korean Patent Applications No. 10-2023-0112166, filed on Aug. 25, 2023, Korean Patent Applications No. 10-2023-0112163, filed on Aug. 25, 2023, Korean Patent Applications No. 10-2023-0142689, filed on Oct. 24, 2023, Korean Patent Applications No. 10-2023-0172804, filed on Dec. 1, 2023 in the Korean Intellectual Property Office, the disclosures of which are incorporated by reference herein in their entireties.

TECHNICAL FIELD

The disclosure relates to a clothes care apparatus including a spot cleaning device capable of performing partial cleaning on a target garment.

BACKGROUND ART

A clothes care apparatus is a device for performing garment care such as drying wet clothes, removing dust or odors from clothes, reducing wrinkles from clothes, etc.

The clothes care device may include a hot air supplier for supplying hot air into a care room to dry the clothes, and a steam generator for performing refresh functions such as unwrinkling of the clothes, deodorizing, removing static electricity from the clothes, putting a scent, etc.

DISCLOSURE

Technical Problem

The disclosure provides a clothes care apparatus including a spot cleaning device to be able to clean a partial portion of the clothes.

The disclosure provides a clothes care apparatus having a spot cleaning device arranged inside a door, thereby increasing space availability and user convenience.

The disclosure provides a clothes care apparatus capable of supplying and draining water without the need to separate a water supply tub and a drain tub of a spot cleaning device from the spot cleaning device.

The disclosure provides a clothes care apparatus capable of automatically supplying water into a water supply tub of a spot cleaning device and draining water from a drain tub.

The disclosure provides a clothes care apparatus capable of supplying water from a door water supply tub having relatively large volume to a water supply tub of a spot cleaning device having relatively small volume.

The disclosure provides a clothes care apparatus capable of draining water from a drain tub of a spot cleaning device having relatively small volume to a door drain tub having relatively large volume.

Technological objectives of the disclosure are not limited to what are mentioned above, and throughout the specification, it will be clearly appreciated by those of ordinary skill in the art that there may be other technological objectives unmentioned.

Technical Solution

According to an embodiment of the disclosure, a clothes care apparatus includes a cabinet; a first chamber formed inside the cabinet and configured to accommodate a garment to clean; a first door configured to open or close the first chamber, having a second chamber separated from the first chamber and configured to accommodate a garment to clean, and including a door water supply tub and a door drain tub; a second door pivotally coupled to the first door to open or close the second chamber; and a spot cleaning device arranged inside the second chamber to spot clean the clothes accommodated in the second chamber and including a water supply tub connectable to the door water supply tub to receive water, to be used to spot clean the garment accommodated in the second chamber, from the door water supply tub, and a drain tub connectable to the door drain tub to release the water from the spot cleaning device to the door drain tub.

The spot cleaning device is movable in the second chamber.

The first door further comprises a home position part placed inside the second chamber, and to be coupled to the spot cleaning device, and in response to the spot cleaning device being coupled to the home position part; the water supply tub is connected to the door water supply tub; and the drain tub is connected to the door drain tub.

The home position part comprises a first opening formed for the water of the door water supply tub to pass through, and the clothes care apparatus further comprises a water supply pump placed below the first opening and configured to move the water in the door water supply tub into the water supply tub located above the first opening in response to the spot cleaning device being coupled to the home position part.

The home position part further comprises a second opening formed for the water of the drain tub to pass through, and the clothes care apparatus further comprises a drain pump placed below the second opening and configured to move the water in the drain tub located above the second opening into the door drain tub in response to the spot cleaning device being coupled to the home position part.

The clothes care apparatus further comprises: a first hose configured to connect the first opening to an outlet of the water supply pump; and a second hose configured to connect the second opening to an inlet of the drain pump.

The first door further comprises a third chamber configured to accommodate the door water supply tub, the door drain tub, the water supply pump, the drain pump, the first hose, and the second hose The clothes care apparatus further comprises a cover to cover at least a portion of the third chamber to prevent the water supply pump, the drain pump, the first hose, and the second hose from being exposed to outside, wherein the cover is detachable in a forward direction of the first door.

The door water supply tub is detachable in a forward or backward direction of the first door; and the door drain tub is detachable in the forward or backward direction of the first door.

The spot cleaning device comprises: a water supply part coupled to the water supply tub to supply the water from the door water supply tub into the water supply tub, and to be coupled to the home position part; and a water drain part coupled to the water drain tub to drain the water from the water drain tub to the door drain tub, and to be coupled to the home position part, and wherein the water supply part comprises a first check valve configured to prevent the water in the water supply tub from being discharged by gravity through the water supply part, and wherein the drain part comprises a second check valve configured to prevent the water in the drain tub from being discharged by gravity through the drain part.

The home position part comprises: a first opener configured to open the first check valve in response to the water supply part being coupled to the home position part; and a second opener configured to open the second check valve in response to the drain part being coupled to the home position part.

The spot cleaning device comprises: a water sprayer configured to spray the water supplied from the water supply tub; a washing fluid sprayer configured to spray a washing fluid which is a mixture of the water supplied from the water supply tub and a detergent; and a suction part configured to draw in the water, the washing fluid and foreign materials.

The spot cleaning device comprises: at least one of a vibrator configured to vibrate a garment; and a roller configured to contact a garment to remove contaminants on the garment by rolling on the garment.

The spot cleaning device comprises: a water supply pump configured to move the water in the water supply tub into the washing fluid sprayer, a drain pump configured to move the water from the suction part into the drain tub; and a battery configured to supply power to operate the water supply pump and the drain pump.

The first door further comprises a home position part placed inside the second chamber, and to be coupled to the spot cleaning device, the spot cleaning device comprises a first charging terminal electrically connected to the battery, and the home position part comprises a second charging terminal connected to the first charging terminal and configured to charge the battery.

Advantageous Effects

According to the disclosure, a clothes care apparatus including a spot cleaning device to do the partial wash on the garment may be provided.

According to the disclosure, a clothes care apparatus may be configured to increase space availability by arranging the spot cleaning device in a separate space formed inside the door.

According to the disclosure, a clothes care apparatus capable of supplying and draining water without separating a water supply tub and a drain tub of a spot cleaning device from the spot cleaning device may be provided.

According to the disclosure, a clothes care apparatus capable of automatically supplying water into a water supply tub and draining water from a drain tub of a spot cleaning device may be provided.

According to the disclosure, a clothes care apparatus capable of supplying water from a door water supply tub having relatively large volume to a water supply tub of a spot cleaning device having relatively small volume may be provided.

According to the disclosure, a clothes care apparatus capable of draining water from a drain tub of a spot cleaning device having relatively small volume to a door drain tub having relatively large volume may be provided.

MODES OF THE INVENTION

Figure 1:
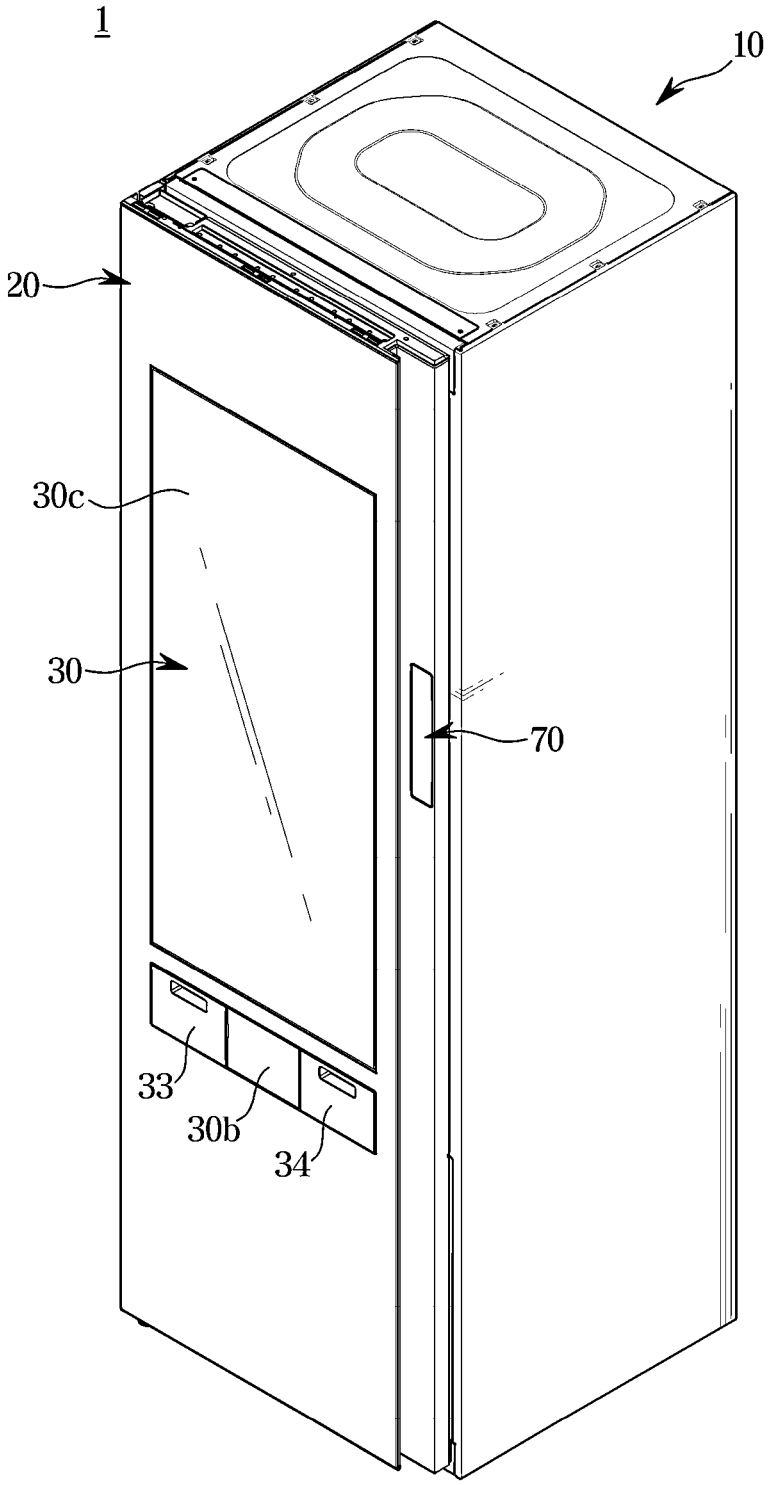
FIG. 1 is a perspective view of a clothes care apparatus, according to an embodiment.

It is understood that various embodiments of the disclosure and associated terms are not intended to limit technical features herein to particular embodiments, but encompass various changes, equivalents, or substitutions.

Like reference numerals may be used for like or related elements throughout the drawings.

The singular form of a noun corresponding to an item may include one or more items unless the context states otherwise.

Throughout the specification, "A or B", "at least one of A and B", "at least one of A or B", "A, B or C", "at least one of A, B and C", and "at least one of A, B, or C" may each include any one or all the possible combinations of A, B and C. For example, the expression "at least one of A, B and C" may include any of the following: A, B, C, A and B, A and C, B and C, A and B and C.

The expression "and/or" is interpreted to include a combination or any of associated elements.

Terms like "first", "second", etc., may be simply used to distinguish an element from another, without limiting the elements in a certain sense (e.g., in terms of importance or order).

When an element is mentioned as being "coupled" or "connected" to another element with or without an adverb "functionally" or "operatively", it means that the element may be connected to the other element directly (e.g., wiredly), wirelessly, or through a third element.

It will be further understood that the terms "comprise" and/or "comprising," when used in this specification, specify the presence of stated features, integers, steps, operations, elements, parts or combinations thereof, but do not preclude the possible presence or addition of one or more other features, integers, steps, operations, elements, components, and/or groups thereof.

When an element is mentioned as being "connected to", "coupled to", "supported on" or "contacting" another element, it includes not only a case that the elements are directly connected to, coupled to, supported on or contact each other but also a case that the elements are connected to, coupled to, supported on or contact each other through a third element.

Throughout the specification, when an element is mentioned as being located "on" another element, it implies not only that the element is abut on the other element but also that a third element exists between the two elements.

The terms "forward or front", "rearward or behind", "left", "right", "up (upward)" and "down (downward)" as herein used are defined with respect to the drawings, but the terms may not restrict the shapes and position of the respective components.

Figure 2:
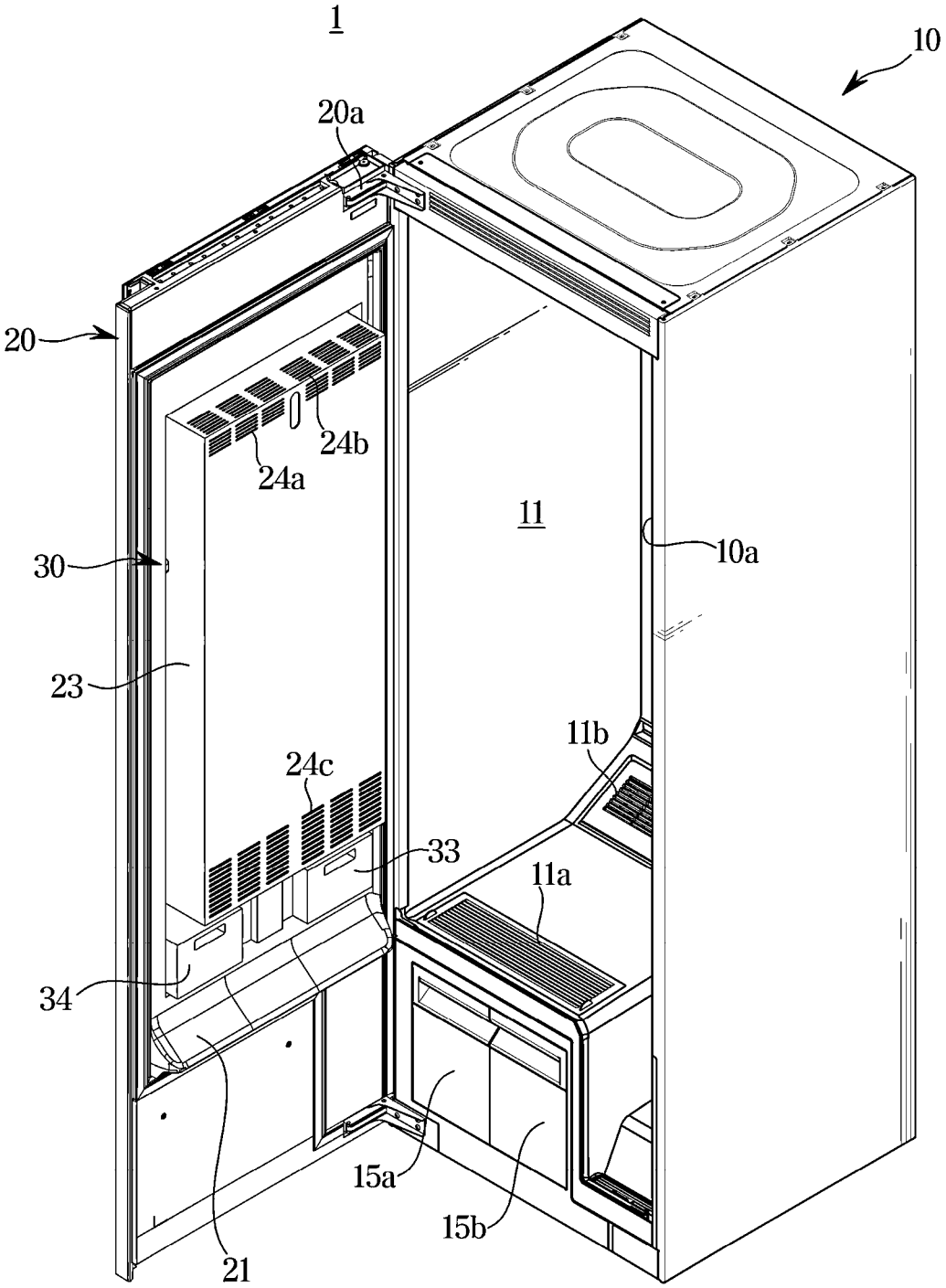
FIG. 2 illustrates a clothes care apparatus with a first door opened, according to an embodiment.
Figure 3:
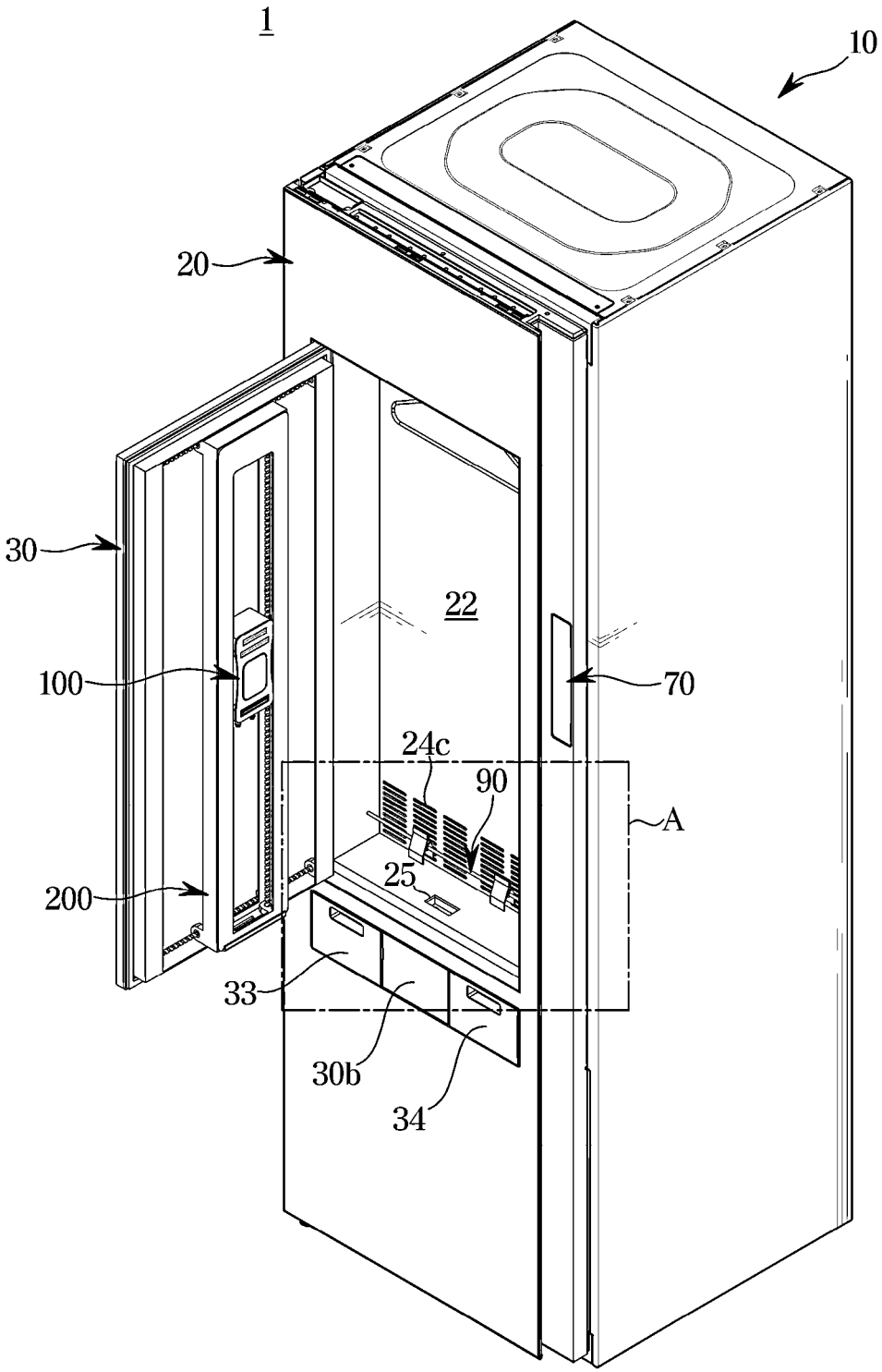
FIG. 3 illustrates a clothes care apparatus with a second door opened, according to an embodiment.
Figure 4:
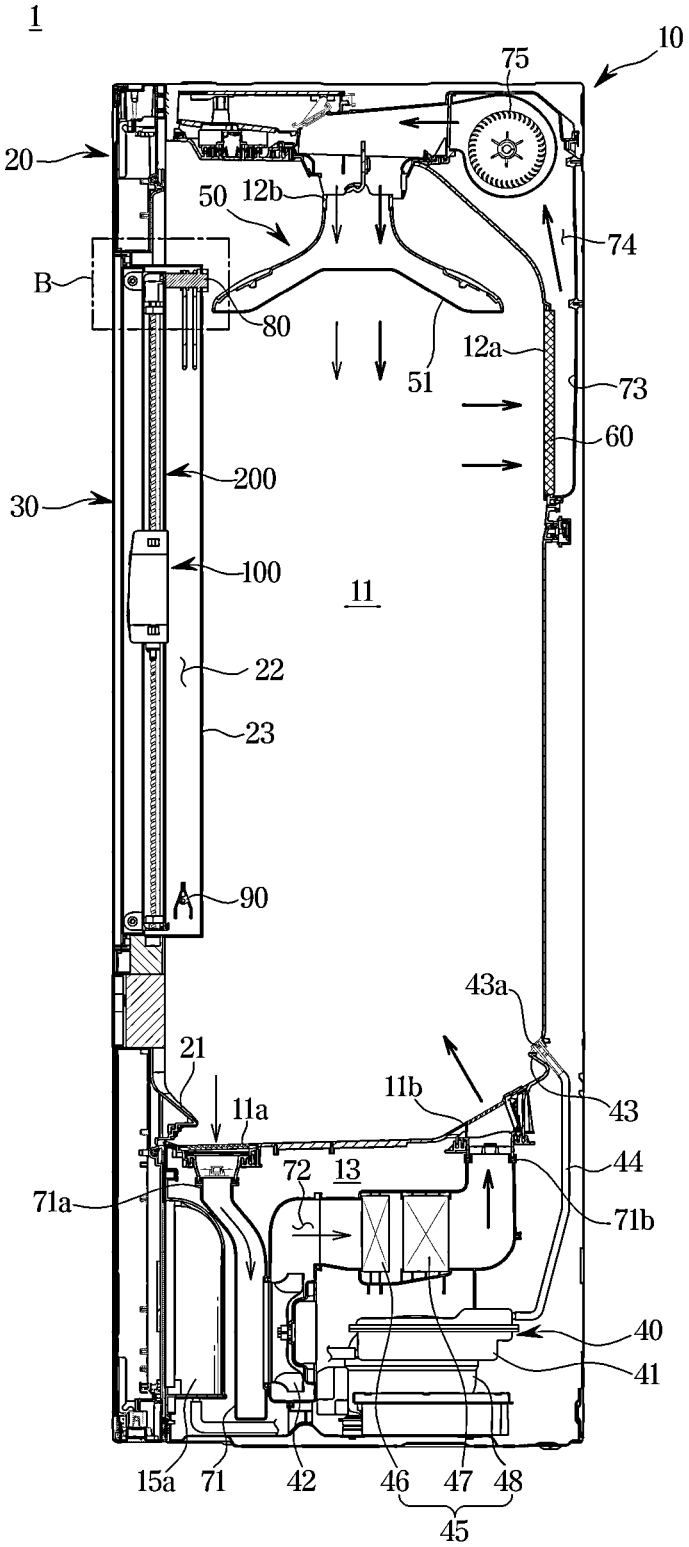
FIG. 4 is a cross-sectional view of a clothes care apparatus, according to an embodiment.

FIG. 1 is a perspective view of a clothes care apparatus, according to an embodiment. FIG. 2 illustrates a clothes care apparatus with a first door opened, according to an embodiment. FIG. 3 illustrates a clothes care apparatus with a second door opened, according to an embodiment. FIG. 4 is a cross-sectional view of a clothes care apparatus, according to an embodiment.

As shown in FIGS. 1 to 4, a clothes care apparatus 1 may include a cabinet 10 that forms the exterior, a first door 20 pivotally coupled to the cabinet 10, and a second door 30 pivotally coupled to the first door 20. In another example, the first door 20 may be movably coupled to the cabinet 10. Alternatively, the second door 30 may be movably coupled to the first door 20.

The cabinet 10 may form a first chamber 11 configured to accommodate a garment. The cabinet 10 may be shaped like a cuboid with one open side. An opening 10*a* may be formed on the front of the cabinet 10. Hence, the first chamber 11 may be formed to have the open front side.

The first door 20 may be configured to open or close the opening 11 of the cabinet 10. The first door 20 may be pivotally coupled to the cabinet 10. The first door 20 may open or close the first chamber 11 by opening or closing the opening 10*a* of the cabinet 10. The first door 20 may be pivotally coupled to the cabinet 10 through a connection member such as a hinge 20*a*. A control panel 70 may be provided on the first door 20.

A machine room 13 may be formed in the cabinet 10 to be separated from the first chamber 11. The machine room 13 may receive a heat exchange device 45 configured to heat or dehumidify air in the first chamber 11. The machine room 13 may receive a steam generating device 40 configured to supply steam into the first chamber 11.

The first chamber 11 may be configured to accommodate a garment. The first chamber 11 may form a space for receiving clothes. A garment support member 50 may be provided in the first chamber to support a garment. The garment support member 50 may be detachably coupled to an upper side of the first chamber 11. There may be one or more garment support members 50 provided in the first chamber 11. For example, a plurality of garment support members 50 may be provided in the first chamber 11. The garment support member 50 may be shaped like a hanger to hang a garment thereon. The garment support member 50 may be provided for air to move around within the garment support member 50. Dust or foreign materials on the garment may be removed by spraying the air supplied into the garment support member 50 toward the garment.

The first door 20 may include a second chamber 22 separated from the first chamber 11 and configured to accommodate a garment. The second chamber 22 may be formed inside the first door 20. The first door 20 may include a case 23 shaped like a cuboid with one open side, and the case 23 may form the second chamber 22. The case 23 may be provided integrally with the first door 20 or provided separately to be coupled to the first door 20. The second chamber 22 may be formed to have an open front side.

The first door 20 may include a door drain tub 33 and a door water supply tub 34 mounted on the first door 20 to be detachable from the first door 20. The first door 20 may include a third chamber 30*a* configured to accommodate the door drain tub 33 and the door water supply tub 34, and a second water supply pump 35 and a second drain pump 36, which will be described later.

The second door 30 may be configured to open or close the second chamber 22. The second door 30 may be pivotally coupled to the first door 20 to open or close the second chamber 22. In another example, although not shown, the second door 30 may be coupled to the first door 20 to be moved upward or downward or to the left or right against the first door 20.

A display 30*c* may be provided on the front of the second door 30.

The first chamber 11 may include a first air current inlet 11, a second air current inlet 12*a*, a first air current outlet 11*b* and a second air current outlet 12*b*.

The first air current inlet 11*a* and the first air current outlet 11*b* may be formed on the lower side of the first chamber 11. The first air current inlet 11*a* may be arranged on a front portion of the lower side of the first chamber 11. The first air current outlet 11*b* may be arranged on a rear portion of the lower side of the first chamber 11. The second air current inlet 12*a* may be formed on the rear side of the first chamber 11. The second air current outlet 12*b* may be formed on the upper side of the first chamber 11. The second air current inlet 12*a* and the second air current outlet 12*b* may be arranged close to each other. For this, the second air current inlet 12*a* may be arranged on an upper rear side of the first chamber 11. The second air current outlet 12*b* may be arranged to be adjacent to the center of the upper side of the first chamber 11.

A grill or filter may be provided at the first air current inlet 11*a* to prevent inflow of foreign materials other than water through the first air current inlet 11*a*. A grill or filter may be provided at the first air current outlet 11*b* to prevent inflow of foreign materials and help the air current spread well into the first chamber 11.

The second air current outlet 12*b* of the first chamber 11 may be coupled to the garment support member 50. Air discharged through the second air current outlet 12*b* is delivered to the garment hung on the garment support member 50 through an air hole 51 formed at the garment support member 50. In another example, the second air current outlet 12*b* may be formed not to couple to the garment support member 50, and the air discharged through the second air current outlet 12*b* may be moved to the outside of the garment support member 50 and conveyed to the garment.

Referring to FIG. 2, the second chamber 22 may include a third air current inlet 24*a* and 24*b* and a third air current outlet 24*c*.

The third air current inlet 24*a* and 24*b* may include a rear air current inlet 24*a* formed on a upper rear side of the second chamber 22, and a top air current inlet 24*b* formed on the upper side of the second chamber 22. The third air current outlet 24*c* may be formed on a lower rear side of the second chamber.

The third air current inlet 24*a* and 24*b* and the third air current outlet 24*c* may be formed to penetrate the case 23. Dry air and/or steam inside the first chamber 11 may flow into the second chamber 22 through the third air current inlet 24*a* and 24*b*. The air and/or steam inside the second chamber 22 may be released into the first chamber 11 through the third air current outlet 24*c*.

As the third air current inlet 24*a* and 24*b* is arranged to be adjacent to the second air current outlet 12*b*, the amount of air inflow through the third air current inlet 24*a* and 24*b* may be larger than the amount of air release through the third air current inlet 24*a* and 24*b*. It does not exclude air release through the third air current inlet 24*a* and 24*b*.

Unlike what is shown in FIG. 2, the clothes care apparatus 1 may include a plurality of holes formed all across at least one side of the case 23. The plurality of holes may include inlets through which air and steam flow into the second chamber 22 from the first chamber 11, and outlets through which air and steam are released from the second chamber 22. For example, the plurality of holes may be formed all across the rear side of the case 23 or all across the top, bottom, left and right and rear sides of the case 23. This may facilitate exchange of the air and steam between the first chamber 11 and the second chamber 22. The plurality of holes may be formed across at least a portion of the top, bottom, left and right and rear sides of the case 23.

Likewise, the third air current outlet 24*c* is arranged to be adjacent to the first air current inlet 11*a*, the amount of air release through the third air current outlet 24*c* may be larger than the amount of air inflow through the third air current outlet 24*c*. It does not exclude air inflow through the third air current outlet 24*c*.

Referring to FIG. 2, the door drain tub 33 and the door water supply tub 34 may be detachable in the backward direction of the first door 20. The door drain tub 33 and the door water supply tub 34 may be separated from the rear side of the first door 20. The door drain tub 33 and the door water supply tub 34 may be separated not only from the front side of the first door 20 in the forward direction of the first door 20 but also from the rear side of the first door 20 in the backward direction of the first door 20.

The clothes care apparatus 1 may include a spot cleaning device 100 provided in the second chamber 22 to partially clean the garment accommodated in the second chamber 22.

The spot cleaning device 100 may be placed inside the second chamber 22 when the second chamber 22 is closed by the second door 30. The spot cleaning device 100 may be arranged on the rear side of the second door 30.

The clothes care apparatus 1 may include a moving device 200 configured to move the spot cleaning device 100 in the second chamber 22 in a first direction and a second direction crossing the first direction.

The spot cleaning device 100 may be able to be movable in the second chamber 22. Specifically, the spot cleaning device 100 may be able to be moved by the moving device 200 in the second chamber 22 along the first direction and the second direction. Hereinafter, the first direction may indicate the vertical direction and the second direction may indicate the horizontal direction. The vertical direction may include upward and downward directions. The horizontal direction may include left and right directions on the assumption that the second door 30 is in a closed state.

As the spot cleaning device 100 is able to be movable in the second chamber 22, it may perform spot cleaning on the garment accommodated in the second chamber 22. Spot cleaning may refer to selectively washing a portion of the garment. The portion of the garment to be subject to spot cleaning may be called a target portion. The target portion may be determined by the user's settings, etc.

The spot cleaning device 100 may be configured to spray water and a washing fluid to the garment. The washing fluid may refer to a detergent or a fluid, which is a mixture of a detergent and water. The spot cleaning device 100 may provide vibration for the garment after or at the same time as spraying water and the washing fluid to the garment. The vibration may be produced by an ultrasonic vibrator arranged in the spot cleaning device 100. Accordingly, the vibration may be called ultrasonic vibration. The spot cleaning device 100 may clean the target portion by providing vibration for the target portion of the garment where the water and washing fluid have been sprayed. The spot cleaning device 100 may be configured to draw in the water and washing fluid sprayed toward the garment. The spot cleaning device 100 may reduce or getting rid of the water and the washing fluid that remain on the garment by drawing in the water and the washing fluid. The spot cleaning device 100 may also absorb contaminants or foreign materials on the garment as well as draw in the water and the washing fluid. A detailed structure of the spot cleaning device 100 will be described later.

A cabinet drain tub 15*a* and a cabinet water supply tub 15*b* may be installed in a lower portion of the cabinet 10 to be detachable from the cabinet 10. The cabinet drain tub 15*a* and the cabinet water supply tub 15*b* may be arranged under the first chamber 11.

The cabinet drain tub 15*a* may be configured to store condensate produced in an operation process of the heat exchange device 45 or water condensed from the steam before releasing it. The cabinet drain tub 15*a* may be installed to be detachable from the cabinet 10 for easy water release.

The cabinet water supply tub 15*b* may be configured to store water required to produce steam in the steam generating device 40, which will be described later. The water in the cabinet water supply tub 15*b* may be supplied to the steam generating device 40 to be used to produce steam. The cabinet water supply tub 15*b* may be installed to be detachable from the cabinet 10 for easy water replenishment.

The cabinet drain tub 15*a* and the cabinet water supply tub 15*b* may be arranged in front of the machine room 13. The machine room 13 may be arranged in a lower portion of the cabinet 10. The machine room 13 may be arranged under the first chamber 11 and separated from the first chamber 11 to form a separate space. The machine room 13 may receive the heat exchange device 45 configured to dehumidify and heat air in the first chamber 11.

In the machine room 13, a first fan 42, the heat exchange device 45 and the steam generating device 40 may be arranged.

The heat exchange device 45 may supply heated air into the first chamber 11. The heat exchange device 45 may include an evaporator 46, a compressor 48 and a condenser 47, through which a refrigerant circulates. The heat exchange device 45 may dehumidify and heat the air.

The refrigerant absorbs latent heat of surrounding air while evaporating in the evaporator 46 of the heat exchange device 45, so the heat exchange device 45 may condense and eliminate moisture in the air. When the refrigerant is condensed in the condenser 47 through the compressor 48, latent heat may be released to the surrounding air, so the heat exchange device 45 may heat the surrounding air. The air brought into the machine room 13 by a first fan 42 may be dehumidified and heated while sequentially going through the evaporator 46 and the condenser 47.

The clothes care apparatus 1 may include a first duct 71 configured to accommodate the evaporator 46, the condenser 47 and the first fan 42. The first duct 71 may be placed inside the machine room 13. One end 71*a* of the first duct 71 may be coupled to the first air current inlet 11*a*. The other end 71*b* of the first duct 71 may be coupled to the first air current outlet 11*b*. The first duct 71 may be connected to the first chamber 11 through the first air current inlet 11*a* and the first air current outlet 11*b*.

The air in the first chamber 11 may flow into the first duct 71 through the first air current inlet 11*a*, and may be released back into the first chamber 11 through the first air current outlet 11*b*. The air brought into the first duct 71 may be dehumidified and heated while going through the evaporator 46 and the condenser 47. The first duct 71 may form a first circulation path 72 that circulates through the first chamber 11, the first fan 42, the evaporator 46 and the condenser 47. The first fan 42 may be placed inside the first circulation path 72 to draw the air of the first chamber 11 into the first duct 71. The air drawn into the first duct 71 by the first fan 42 may be released into the first chamber 11 through the first air current outlet 11*b*. The first circulation path 72 may refer to a circulation path in which the air brought into the first duct 71 from the first chamber 11 through the first air current inlet 11*a* is released back into the first chamber 11 from the first duct 71 through the first air current outlet 11*b*.

The clothes care apparatus 1 may include the steam generating device 40 placed inside the machine room 13. The steam generating device 40 may produce steam with water received from the cabinet water supply tub 15*b* in the machine room 13.

The steam generating device 40 may include a steam generator 41 connected to the cabinet water supply tub 15*b* for producing steam with the supplied water, a steam sprayer 43 for spraying steam produced by the steam generator 41, and a steam connection tube 44 connecting between the steam generator 41 and the steam sprayer 43.

The steam sprayer 43 may be fixed to a steam outlet 43*a* formed at a rear lower side of the first chamber 11. The steam outlet 43*a* may be formed to correspond to the steam sprayer 43. The steam sprayer 43 may spray the steam produced in the machine room 13 into the first chamber 11 through the steam outlet 43*a*. It is possible to change the locations of the steam sprayer 43 and the steam outlet 43*a*.

The steam generator 41 may include a heater (not shown) inside. The steam generator 41 may produce steam by heating water with the heater.

The first door 20 may include a door guide 21 configured to lead the water moving down by gravity to the first air current inlet 11*a*. The door guide 21 may be arranged in a lower portion of the rear side of the first door 20. The door guide 21 may slope down to the first air current inlet 11*a* from the rear side of the first door 20. The water on the rear side of the first door 20 may move to the door guide 21 by gravity and may be led rearward by the door guide 21 to flow in through the first air current inlet 11*a*. The water flowing in through the first air current inlet 11*a* may be moved by a connection member (not shown) into the cabinet drain tub 15*a*.

The clothes care apparatus 1 may include a second fan 75 for forcing the air inside to move around, and a second duct 73 in which the second fan 75 is installed. The second duct 73 may be connected to the first chamber 11. One end of the second duct 73 may be coupled to the second air current inlet 12*a*. The other end of the second duct 73 may be coupled to the second air current outlet 12*b*. The air flowing into the second duct 73 through the second air current inlet 12*a* may be released into the first chamber 11 through the second air current outlet 12*b*. The second fan 75 may be installed in the second duct 73 to draw air into the second duct 73 through the second air current inlet 12*a*. The air drawn into the second duct 73 by the second fan 75 may be released into the first chamber 11 through the second air current outlet 12*b*.

The second duct 73 may connect the first chamber 11 to the second air current inlet 12*a* and the second air current outlet 12*b*, thereby creating a second circulation path 74. The second circulation path 74 may refer to a circulation path in which the air drawn into the second duct 73 from the first chamber 11 through the second air current inlet 12*a* is released back into the first chamber 11 from the second duct 73 through the second air current outlet 12*b*.

The second duct 73 may be arranged behind the first chamber 11. The second duct 73 may be placed behind the second air current inlet 12*a* formed on the rear side of the first chamber 11. The second duct 73 may be located in an upper portion of the rear side of the first chamber 11. A filter member 60 may be detachably installed at the second air current inlet 12*a* to filter off foreign materials in the air drawn in through the second air current inlet 12*a*. Foreign materials such as dust and odor in the air drawn into the second duct 73 may be removed by the filter member 60. The filter member 60 may include not only a filter but also a sheet (not shown) configured to provide a scent for the garment.

The garment support member 50 may be coupled onto the top of the first chamber 11 to be connected to the second air current outlet 12*b*. The garment support member 50 may spray the air released from the second air current outlet 12*b* toward the garment. The air sprayed by the garment support member 50 may get rid of foreign materials such as dust on the garment. In another example, the garment support member 50 may be coupled onto the top of the first chamber 11 under the second air current outlet at a certain distance.

The clothes care apparatus 1 may perform a garment care mode while clothes are hung on the garment support member 50 and the first door 20 is in a closed state. In the garment care mode, the air in the first chamber 11 may circulate in the cabinet 10 along the first circulation path 72 and the second circulation path 74. A portion of the air in the first chamber 11 may flow into the second chamber 22 through the third air current inlet 24*a* and 24*b*. The air in the second chamber 22 may be released into the first chamber 11 through the third air current outlet 24*c*.

Figure 5:
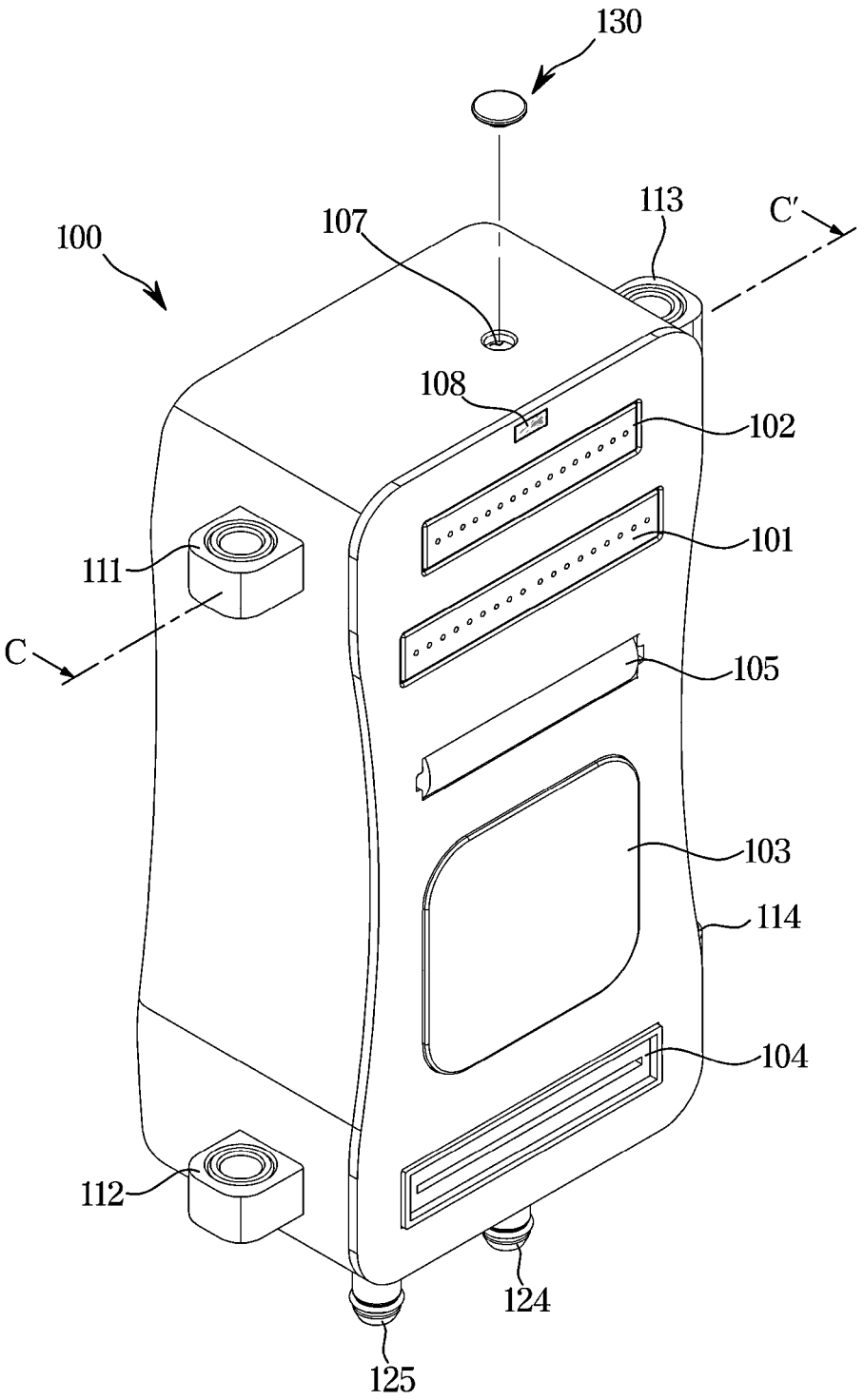
FIG. 5 illustrates a spot cleaning device, according to an embodiment.
Figure 6:
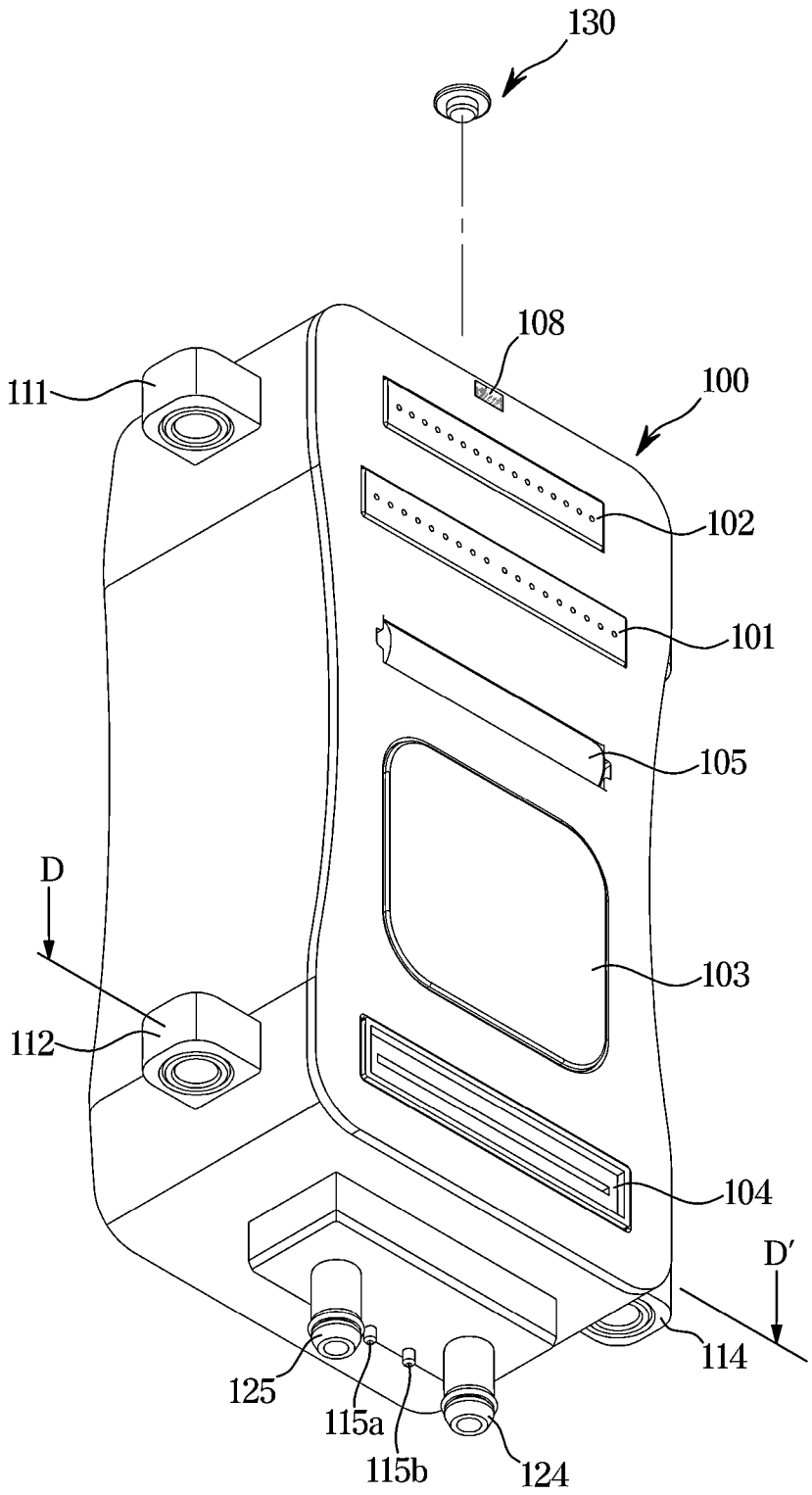
FIG. 6 illustrates a spot cleaning device at a different angle, according to an embodiment.
Figure 7:
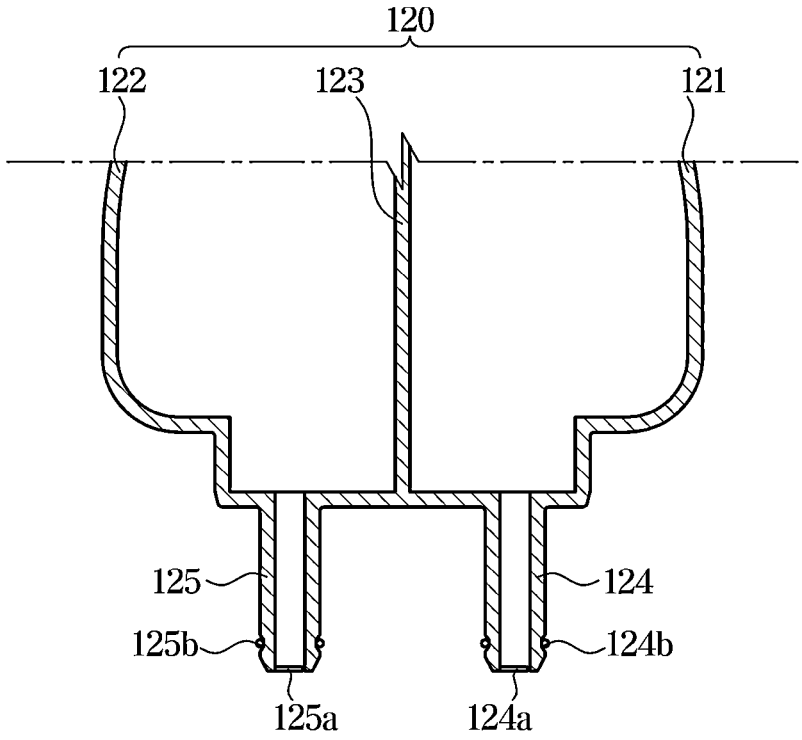
FIG. 7 is a cross-sectional view along line D-D' of FIG. 6.

FIG. 5 illustrates a spot cleaning device, according to an embodiment. FIG. 6 illustrates a spot cleaning device at a different angle, according to an embodiment. FIG. 7 is a cross-sectional view along line D-D' of FIG. 6.

Referring to FIGS. 5 and 6, the clothes care apparatus 1 may include the spot cleaning device 100. The spot cleaning device 100 may be arranged in the second chamber 22 to do the partial wash (spot cleaning) on the garment accommodated in the second chamber 22.

The spot cleaning device 100 may include a water sprayer 101 configured to spray water, a washing fluid sprayer 102 configured to spray a washing fluid, a vibrator 103 configured to contact the garment and provide vibration for the garment, and a suction part 104 configured to draw in the water and the washing fluid. For example, the vibrator 103 may use an ultrasonic element to generate vibration.

The water sprayer 101 may spray water toward the garment. The washing fluid sprayer 102 may spray the washing fluid, which is a mixture of water and detergent, toward the garment. In another example, the washing fluid may only include the detergent with a controlled concentration. The vibrator 103 may clean the clothes by contacting the garment and providing vibration for the garment. The suction part 104 may draw in the water and washing fluid sprayed to the garment, and foreign materials.

In addition, the spot cleaning device 100 may further include a roller 105 configured to rotate to get rid of foreign materials on the garment. The spot cleaning device 100 may include a motor (not shown) configured to rotate the roller 105. The roller 105 may clean the target portion of the garment along with the vibrator 103. The roller 105 may clean the garment by contacting the garment. The roller 105 may facilitate blending of contaminants on the garment with the washing fluid by physically contacting the garment onto which the water and washing fluid are sprayed. Furthermore, the roller 105 may get rid of foreign materials such as dust on the garment by contacting the garment. Unlike what is shown, the spot cleaning device 100 may not include the roller 105. In another example, the roller 105 may replace the vibrator 103. In another example, the roller 105 may be shaped like a brush. These will be described later.

In an embodiment, the spot cleaning device 100 may include a water tub 120 including a water supply tub 121 configured to supply water to be sprayed by the water sprayer 101 and a drain tub 122 configured to store water drawn in in by the suction part 104. Referring to FIG. 7, the water tub 120 may be partitioned by a wall 123 into the water supply tub 121 and the drain tub 122. In other words, a portion of the water tub 120 may be used as the water supply tub 121 and the other portion may be used as the drain tub 122. The portion and the other portion of the water tub 120 may be separated by the wall 123. Alternatively, the spot cleaning device 100 may include the water supply tub and the drain tub, respectively, which are separated from each other.

The water tub 120 may be arranged in the spot cleaning device 100. As will be described later, the water supply tub 121 may receive water from the door water supply tub 34 mounted on the first door 20, and the drain tub 122 may release water into the door drain tub 33 mounted on the first door 20. Hence, the water tub 120 may be arranged not to be separated from the spot cleaning device 100. This is because water may be supplied into the water supply tub 121 and drained from the drain tub 122 without separating the water tub 120 from the spot cleaning device 100. However, it is not limited thereto. To clean the water tub 120, the water tub 120 may be configured to be detachable from the spot cleaning device 100. In various embodiments, the water tub 120 may include both an inlet through which to supply water into the water supply tub 121 and an outlet through which water is released from the water supply tub 121. In various embodiments, the water tub 120 may include both an inlet through which water and washing fluids, foreign materials, etc., are brought into the drain tub 122 and an outlet through which the water and washing fluids, foreign materials, etc., are drained.

The spot cleaning device 100 may include a water supply part 124 coupled to the water supply tub 121 and a drain part 125 coupled to the drain tub 122. When the spot cleaning device 100 is coupled to a home position part 25, the water supply tub 121 may receive water from the door water supply tub 34 through the water supply part 124. When the spot cleaning device 100 is coupled to a home position part 25, the drain tub 122 may release water into the door drain tub 33 through the drain part 125. The home position part 25 may include a first opening 25*c* arranged for the water of the door water supply tub 34 to pass through, and a second opening 25*d* arranged for the water of the drain tub 122 to pass through. The first opening 25*c* may be connected to the water supply part 124. The second opening 25*d* may be connected to the drain part 125.

Referring to FIG. 7, the water supply part 124 and the drain part 125 may be arranged on the lower side of the spot cleaning device 100 to be connected to the home position part 25 formed on the lower side of the second chamber 22. As the water supply part 124 is connected to the water supply tub 121 and placed farther down than the water supply tub 121, the water stored in the water supply tub 121 may be discharged by gravity through the water supply part 124. The spot cleaning device 100 may include a first check valve 124*a* arranged at the water supply part 124 to prevent the water stored in the water supply tub 121 from being released by gravity through the water supply part 124. As the drain part 125 is connected to the drain tub 122 and placed farther down than the drain tub 122, the water stored in the drain tub 122 may be discharged by gravity through the drain part 125. The spot cleaning device 100 may include a second check valve 125*a* arranged at the drain part 125 to prevent the water stored in the drain tub 122 from being released by gravity through the drain part 125.

Figure 8:
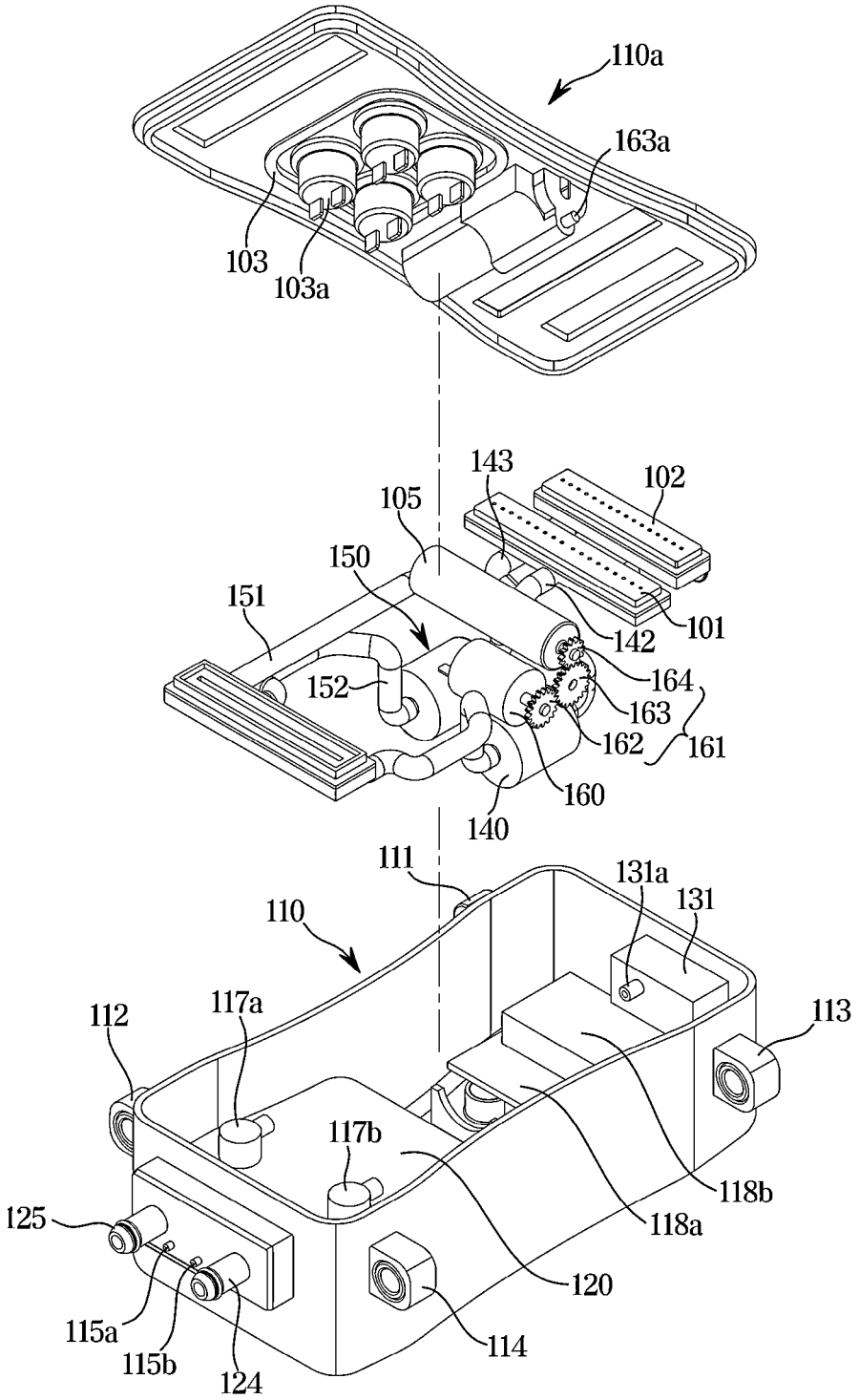
FIG. 8 is an exploded view of a spot cleaning device, according to an embodiment.

The spot cleaning device 100 may include a detergent inlet 107 configured to put the detergent into a detergent container 131 (see FIG. 8). The user may put the detergent through the detergent inlet 107 into the detergent container 131 without separating the spot cleaning device 100 from the second door 30. In other words, the detergent may be put into the detergent container 131 without the need to access the rear side of the spot cleaning device 100. In various embodiments, the detergent container 131 may be configured to be detachable from the housing 110, and the user may put the detergent into the detergent container 131 through the detergent inlet 107 after separating the detergent container 131 from the housing 110.

The spot cleaning device 100 may further include an inlet cover 130 configured to cover the detergent inlet 107 and detachably coupled to the detergent inlet 107. In a case that the detergent inlet 107 is arranged on the top of the spot cleaning device 100 as shown in FIG. 5, the inlet cover 130 may be omitted. This is because the detergent may not flow out through the detergent inlet even without the inlet cover.

The spot cleaning device 100 may include moving parts 111, 112, 113 and 114. The moving parts 111, 112, 113 and 114 may include the first moving part 111 and the second moving part 112 configured to connect to a first shaft 211. The moving parts 111, 112, 113 and 114 may include the third moving part 113 and the fourth moving part 114 configured to connect to a third shaft 231. The moving parts 111, 112, 113 and 114 may be configured to move in a first direction with the rotation of the first shaft 211 and the third shaft 231.

The first moving part 111 and the second moving part 112 may be spaced apart in the first direction. The third moving part 113 and the fourth moving part 114 may be spaced apart in the first direction. The first direction may refer to upward and downward directions or a vertical direction. Hence, the first moving part 111 and the second moving part 112 may be vertically spaced apart, and the third moving part 113 and the fourth moving part 114 may be vertically spaced apart.

The moving parts 111, 112, 113 and 114 may each include a hole formed for the shaft to go through. A screw thread may be formed in the hole of each of the moving parts 111, 112, 113 and 114 to correspond to a screw thread formed at the first shaft 211 or the third shaft 231. This may enable the first moving part 111 and the second moving part 112 to move upward or downward with the rotation of the first shaft 211 in one direction, and enable the first moving part 111 and the second moving part 112 to move downward or upward with the rotation of the first shaft 211 in the other direction. Likewise, the third moving part 113 and the fourth moving part 114 may move upward or downward with the rotation of the third shaft 231 in one direction, and the third moving part 113 and the fourth moving part 114 may move downward or upward with the rotation of the third shaft 231 in the other direction. The one direction and the other direction may refer to clockwise (CW) and counterclockwise (CCW), respectively.

Figure 9:
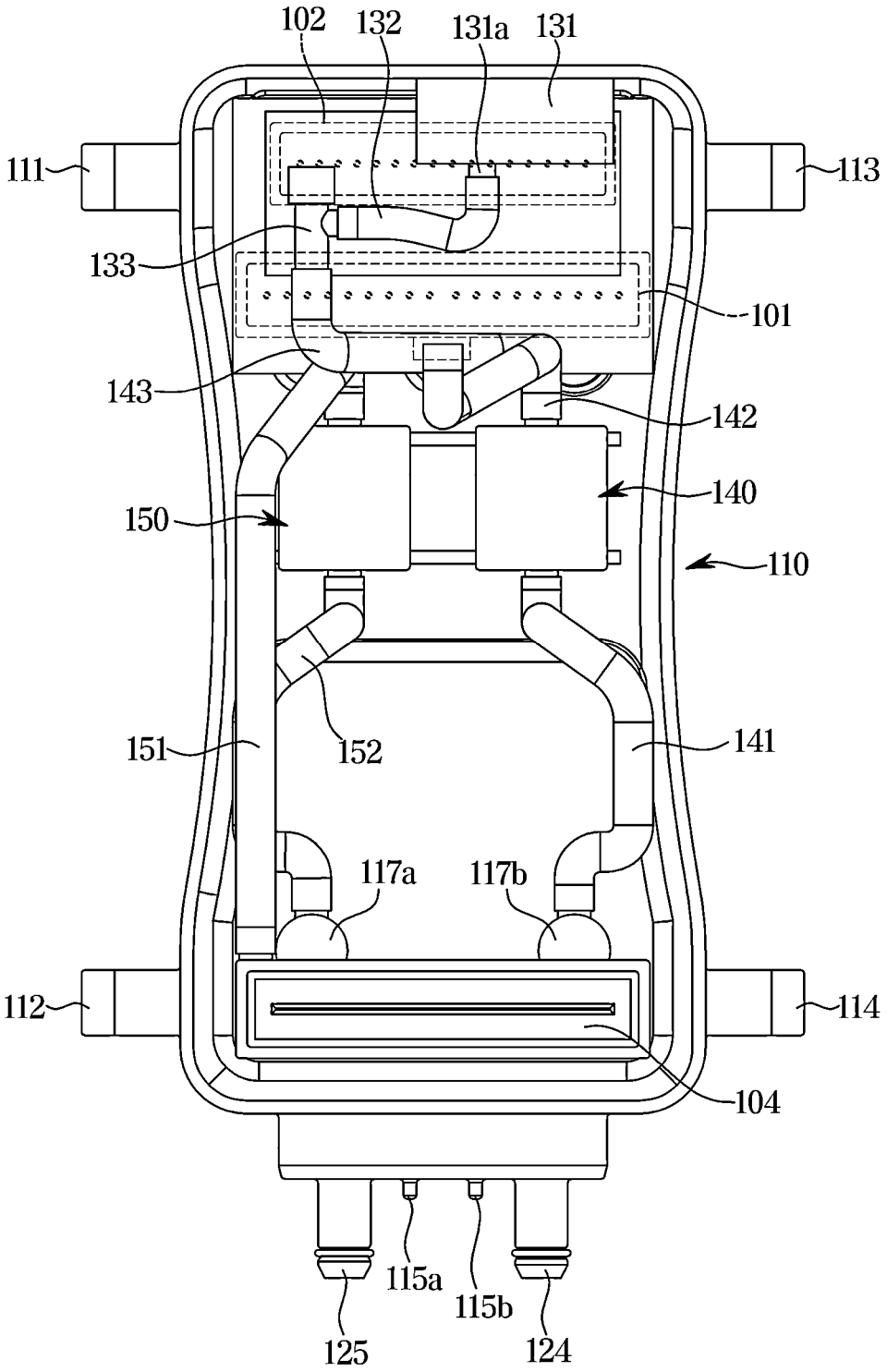
FIG. 9 illustrates a spot cleaning device with some components omitted therefrom to describe a water supply path and a drain path, according to an embodiment.
Figure 10:
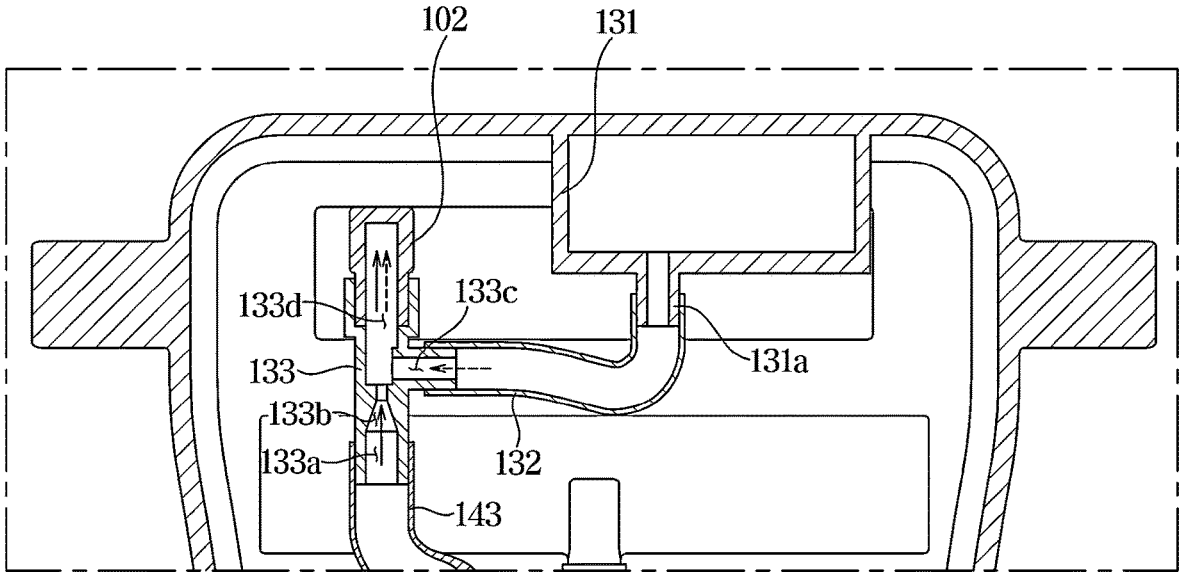
FIG. 10 is an enlarged cross-sectional view of a portion of a spot cleaning device, according to an embodiment.

FIG. 8 is an exploded view of a spot cleaning device, according to an embodiment. FIG. 9 illustrates a spot cleaning device with some components omitted therefrom to describe a water supply path and a drain path, according to an embodiment of the disclosure. FIG. 10 is an enlarged cross-sectional view of a portion of a spot cleaning device, according to an embodiment.

Referring to FIG. 8, the spot cleaning device 100 may include a housing 110, a first water supply pump 140 accommodated in the housing 110, a first drain pump 150, a driving motor 160 and a housing cover 110*a*. The spot cleaning device 100 may further include the detergent container 131, a substrate 118*a* and a battery 118*b*.

The housing 110 may have a form with one open side. The housing 110 may include the first, second, third and fourth moving parts 111, 112, 113 and 114. The housing may receive the first water supply pump 140, the first drain pump 150 and the driving motor 160. The detergent container 131 may be arranged and the substrate 118*a* and the battery 118*b* may be accommodated in the housing 110. The housing cover 110*a* may be configured to cover the one open side of the housing 110.

The housing 110 may include the water tub 120. At the water tub 120, a water supply connector 117*b* coupled to the water supply tub 121 of the water tub 120 and a drain connector 117*a* coupled to the drain tub 122 of the water tub 120 may be arranged.

Referring to FIG. 8, the spot cleaning device 100 may include the driving motor 160 for providing driving force to rotate the roller 105, and a gear module 161 configured to deliver the driving force of the driving motor 160 to the roller 105. In an embodiment, the gear module 161 may include a first gear 162 coupled to the driving shaft of the driving motor 160, a second gear 164 coupled to the roller 105, a third gear 163 configured to interlock with the first and second gears 162 and 164 between the first and second gears 162 and 164. The third gear 163 may be coupled to a gear connector 163*a* of the housing cover 110*a*.

The spot cleaning device 100 may include an ultrasonic vibrator 103*a* configured to provide vibration for the vibrator 103. The ultrasonic vibrator 103*a* may be provided in the plural, and for example, there may be four ultrasonic vibrators 103*a* arranged inside the vibrator 103. The ultrasonic vibrator 103*a* may be placed inside the housing 110 when the housing cover 110*a* is coupled to the housing 110.

Referring to FIGS. 8 and 9, the spot cleaning device 100 may include the first water supply pump 140 configured to move the water stored in the water supply tub 121 into the water sprayer 101 and the washing fluid sprayer 102. The water supply pump 140 may be connected to a first water supply hose 141 and a second water supply hose 142. The water may be moved into the first water supply hose 141 and the second water supply hose 142, which may form a flow path in which the water is moved. The first water supply hose 141 may connect between the water supply connector 117*b* and the first water supply pump 140. The second water supply hose 142 may connect between the first water supply pump 140 and the water sprayer 101. As the first water supply pump 140 operates, the water in the water supply tub 121 may flow into the first water supply pump 140 through the water supply connector 117*b* and the first water supply hose 141. The water brought into the first water supply pump 140 may be released into the second water supply hose 142. As the second water supply hose 142 is connected to the water sprayer 101, the water released into the second water supply hose 142 may be sprayed out of the spot cleaning device 100 through the water sprayer 101.

In the disclosure, the term hose refers to a component used to convey a fluid and may thus be substituted with a pipe, tube, conduit or duct. Furthermore, in the disclosure, the hose may include a pipe, a tube, a conduit and/or a duct.

In an embodiment, the spot cleaning device 100 may further include a third water supply hose 143 branched from a point of the second water supply hose 142. The third water supply hose 143 may be connected to a connection hose 133, which will be described later. The water in the third water supply hose 143 may be mixed with the detergent in the detergent container 131 in the connection hose 133, and then sprayed out of the spot cleaning device 100 through the washing fluid sprayer 102. This will be described later in detail.

Referring to FIGS. 8 and 9, the spot cleaning device 100 may include the first drain pump 150 configured to move the water, the washing fluid and foreign materials into the drain tub 122 from the suction part 104. The first drain pump 150 may be connected to a first drain hose 151 and a second drain hose 152. The water may be moved into the first drain hose 151 and the second drain hose 152, which may form a flow path in which the water is moved. The first drain hose 151 may connect between the suction part 104 and the first drain pump 150. The second drain hose 152 may connect between the first drain pump 150 and the drain connector 117*a*. As the first drain pump 150 operates, water, washing fluids and foreign materials through the suction part 104 may flow into the first drain pump 150 through the first drain hose 151. The water, washing fluids and foreign materials brought into the first drain pump 150 may be released into the second drain hose 152. The second drain hose 152 is connected to the drain tub 122 through the drain connector 117*a*, so the water, washing fluids and foreign materials released into the second drain hose 152 may be stored in the drain tub 122.

The spot cleaning device 100 may include the detergent container 131 to contain the detergent. In an embodiment, the detergent container 131 may be integrally formed with the housing 110. It is not, however, limited thereto, and the detergent container 131 is a separate component accommodated in the housing 110 and may be detachable from the housing 110. The detergent container 131 may be connected to the detergent inlet 107. The detergent put in through the detergent inlet 107 may be stored in the detergent container 131.

The detergent container 131 may include a detergent outlet 131*a*. The detergent in the detergent container 131 may be discharged out of the detergent container 131 through the detergent outlet 131*a*.

The detergent outlet 131*a* may be connected to a detergent hose 132. The detergent hose 132 may form a flow path in which the detergent moves. The detergent hose 132 may be connected to the connection hose 133. The connection hose 133 may be provided in the form of a T-shaped valve. The connection hose 133 may include two inlets and one outlet. One of the two inlets of the connection hose 133 may be connected to the third water supply hose 143 and the other may be connected to the detergent hose 132. The outlet of the connection hose 133 may be connected to the washing fluid sprayer 102.

Referring to FIG. 10, the connection hose 133 may include a first inlet 133*a* connected to the third water supply hose 143, a second inlet 133*c* connected to the detergent hose 132, and an outlet 133*d* connected to the washing fluid sprayer 102. The water brought in through the first inlet 133*a* and the detergent brought in through the second inlet 133*c* may be mixed in the connection hose 133, and the washing fluid of the mixture may be released through the outlet 133*d*.

The connection hose 133 may include a nozzle part 133*b* arranged at one end of the first inlet 133*a*. The one end of the nozzle part 133*b* may have the same diameter as the first inlet 133*a* to be connected to the first inlet 133*a*. The other end of the nozzle part 133*b* may have a smaller diameter than the first inlet 133*a*. That is, the nozzle part 133*b* may have the diameter decreasing from one end of the nozzle part 133*b* toward the other end. With this structure of the nozzle part 133*b*, water brought in through the one end of the nozzle part 133*b* may be released through the other end at increasing flow velocity. This is because pressure is reduced and flow velocity increases as the area of the flow path decreases while passing through the nozzle part. With the reduction in pressure of the fluid at the other end of the nozzle part 133*b*, the detergent in the detergent hose 132 is moved into the connection hose 133 having relatively low pressure. The water that has passed through the other end of the nozzle part 133*b* and the detergent brought in through the second inlet 133*c* may be mixed in the connection hose 133. The washing fluid that is the mixture of the water and the detergent may be released through the outlet 133*d* of the connection hose 133. The outlet 133*d* is connected to the washing fluid sprayer 102, so the water and detergent mixed in the connection hose 133 may be sprayed out of the spot cleaning device 100 through the washing fluid sprayer 102. As described above, the connection hose 133 may use the pressure difference made by the nozzle part 133*b* included in the connection hose 133 to automatically mix the water and the detergent without an extra driving device.

The spot cleaning device 100 may include the battery 118*b* configured to provide power to the first water supply pump 140, the first drain pump 150, the driving motor 160 and the ultrasonic vibrator 103*a*, and charging terminals 115*a* and 115*b* configured to charge the battery. The charging terminals 115*a* and 115*b* may include the positive electrode 115*a* and the negative electrode 115*b*.

The spot cleaning device 100 may include the substrate 118*a* on which a second controller 180 and a second communicator 190 as will be described later are mounted. The substrate 118*a* may be accommodated in the housing 110. In addition to the second controller 180 and the second communicator 190, various parts (e.g., a heatsink) may be mounted on the substrate 118*a* as required.

Figure 11:
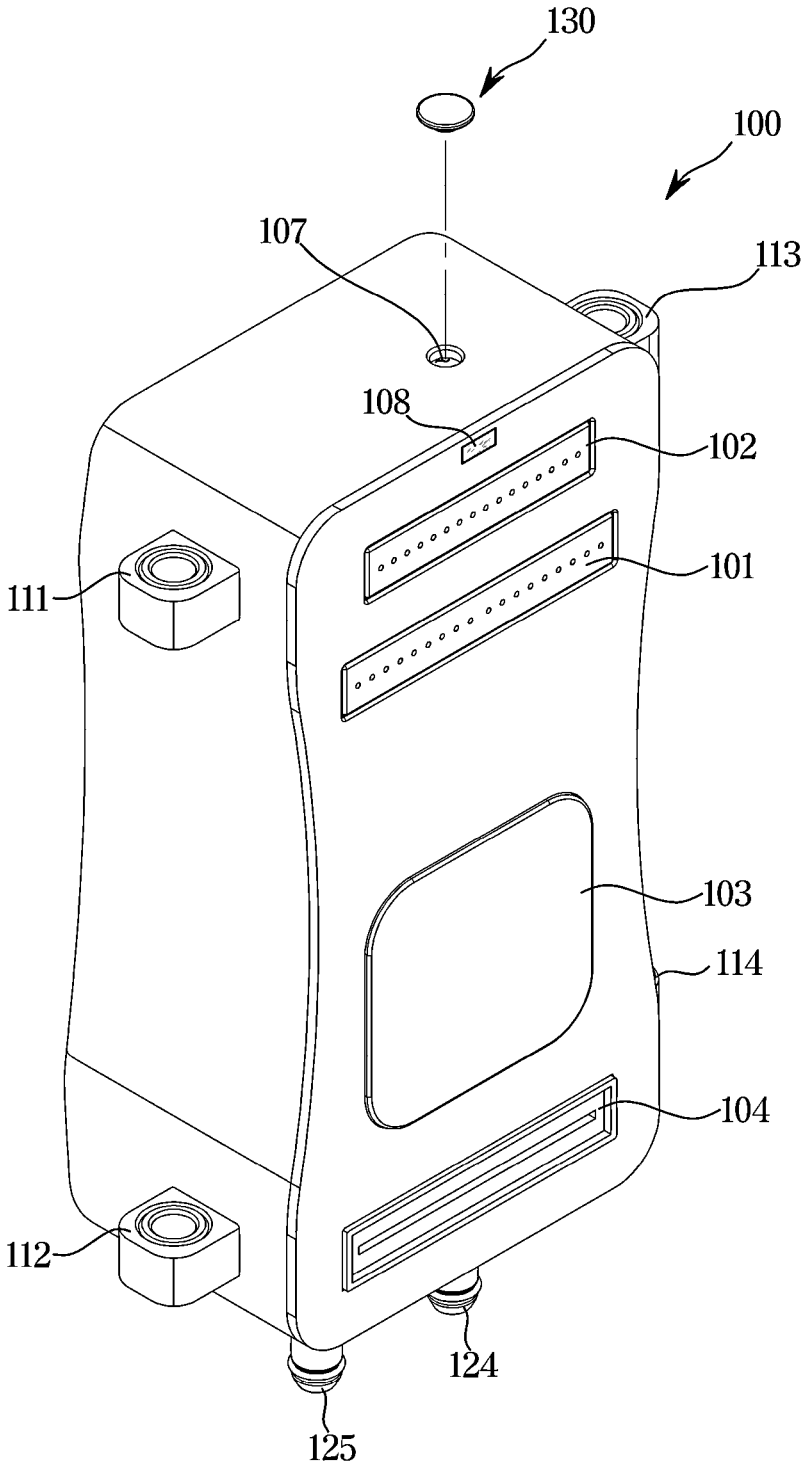
FIG. 11 illustrates a spot cleaning device, according to an embodiment.

FIG. 11 illustrates a spot cleaning device, according to an embodiment.

Referring to FIG. 11, the spot cleaning device 100 according to the embodiment may include the water sprayer 101, the washing fluid sprayer 102, the vibrator 103 and the suction part 104. In other words, the spot cleaning device 100 may be configured to include only the vibrator among the vibrator and the roller.

Figure 12:
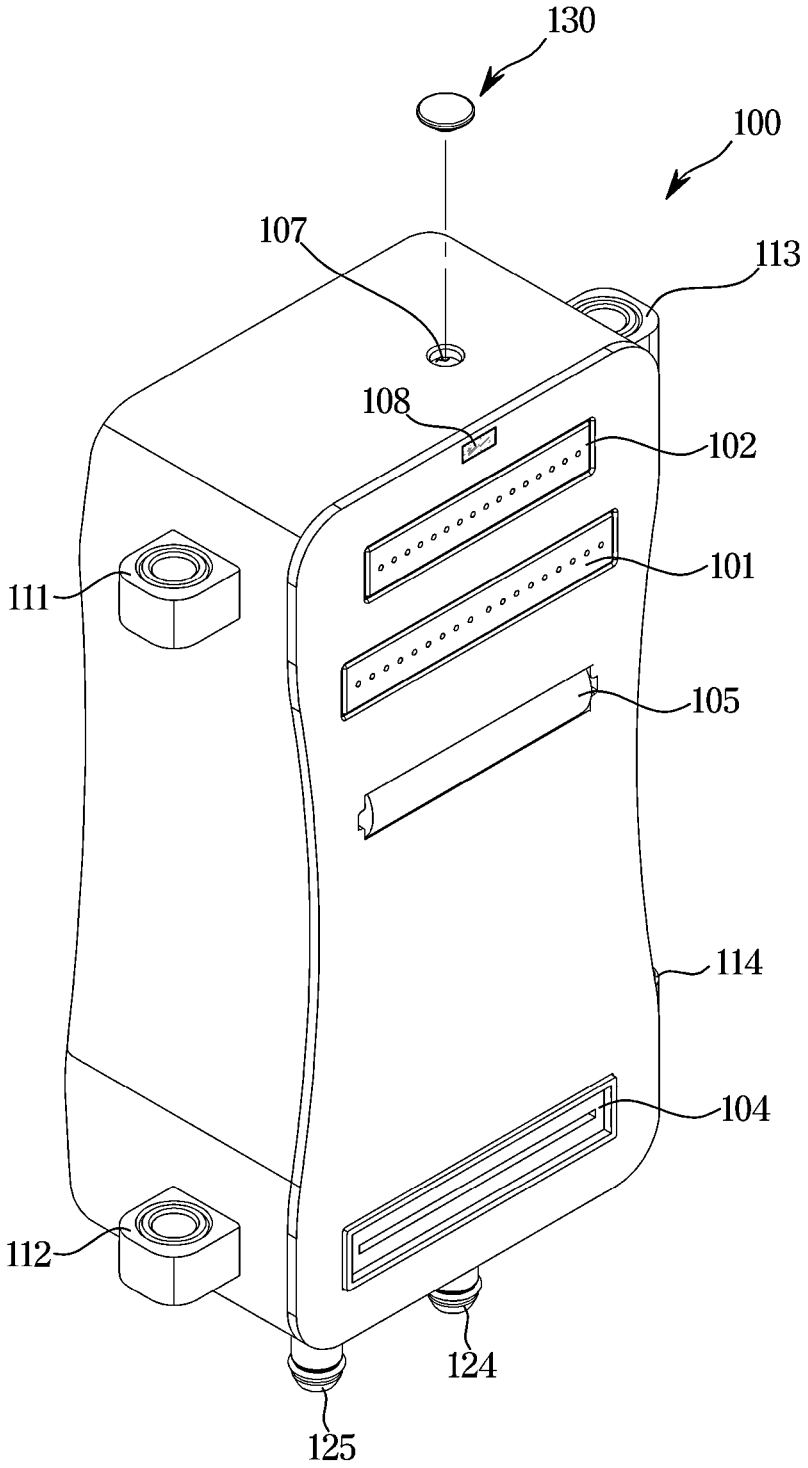
FIG. 12 illustrates a spot cleaning device, according to an embodiment.

FIG. 12 illustrates a spot cleaning device, according to an embodiment.

Referring to FIG. 12, the spot cleaning device 100 according to the embodiment may include the water sprayer 101, the washing fluid sprayer 102, the roller 105 and the suction part 104. In other words, the spot cleaning device 100 may be configured to include only the roller among the vibrator and the roller.

Unlike what are shown in FIGS. 11 and 12, the spot cleaning device 100 may further include a heating module according to various embodiments. Similar to an electric iron, the heating module may include a flat iron plate and an electric heating element (e.g., heater) for heating the iron plate. In various embodiments, the heating module may also be arranged in the vibrator 103. For example, the heating module may include an electric heating element (e.g., heater) arranged in the vibrator 103.

A garment treatment process that may be performed by the spot cleaning device 100 may include a water spraying process to spray water onto the garment through the water sprayer 101, a washing fluid spraying process to spray the washing fluid onto the garment through the washing fluid sprayer 102, a vibrating process to provide vibration for the garment through the vibrator 103, a rolling process to rotate the roller 105, a suction process to draw in contaminated water through the suction part 104 and/or a heating process to heat the garment through the heating module.

In the disclosure, controlling the water sprayer 101 to spray water and/or controlling the washing fluid sprayer 102 to spray the washing fluid may include operating the first water supply pump 140.

In the disclosure, controlling the suction part 104 to draw in the contaminated water may include controlling the first drain pump 150.

In the disclosure, controlling the vibrator 103 to provide vibration may include applying a voltage to the vibrator 103*a*.

In the disclosure, controlling the roller 105 to get rid of contaminants may include providing driving force to the roller 105 by operating the driving motor 160 and/or controlling the moving device 200 to move the roller 105 back and forth on the target portion.

In the disclosure, controlling the heating module to perform the heating process may include controlling the electric heating element to emit heat.

Figure 13:
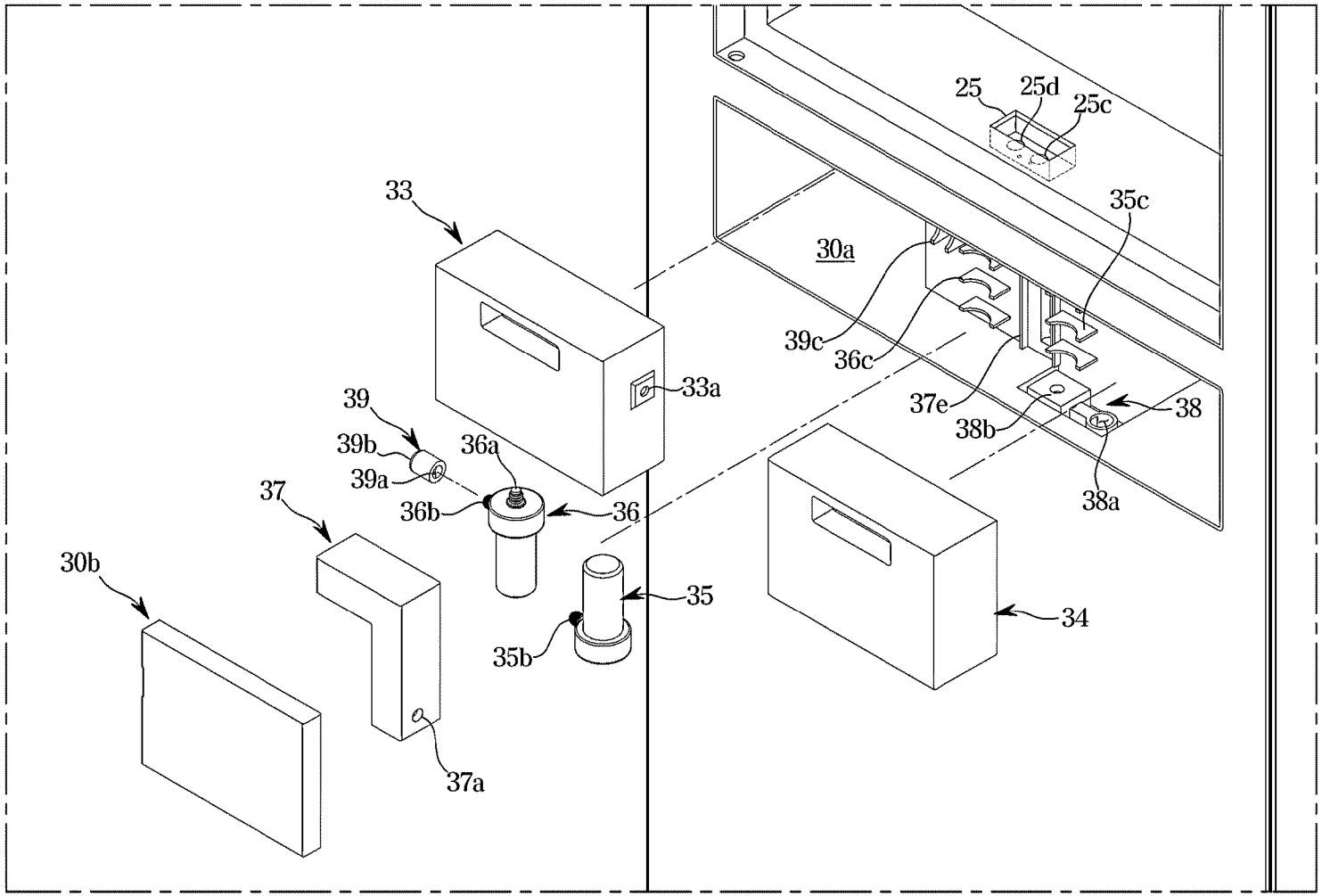
FIG. 13 illustrates a third chamber and disassembled components otherwise accommodated in the third chamber of a first door in a clothes care apparatus, according to an embodiment.
Figure 14:
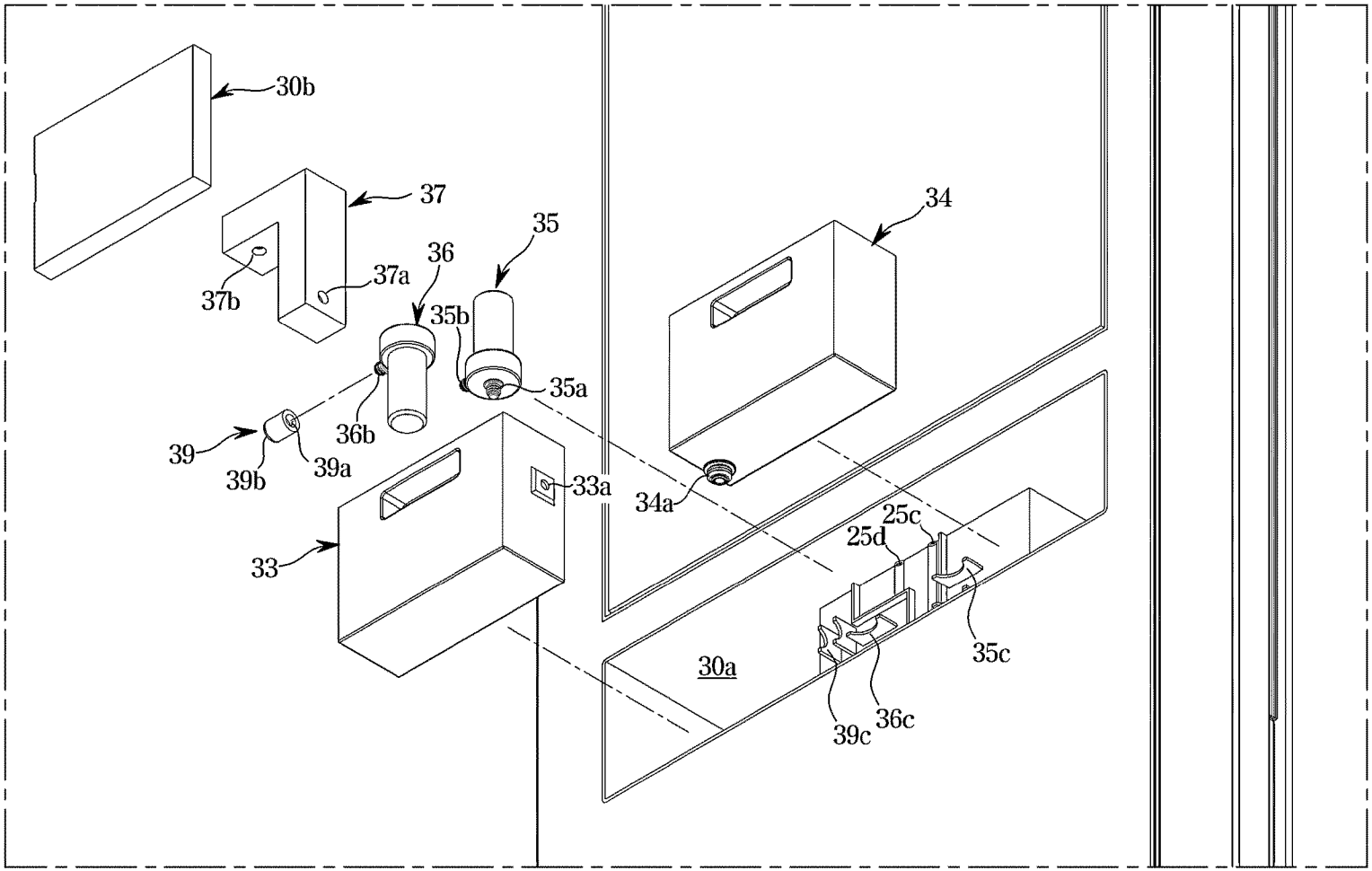
FIG. 14 illustrates what are shown in FIG. 13 at a different angle.
Figure 15:
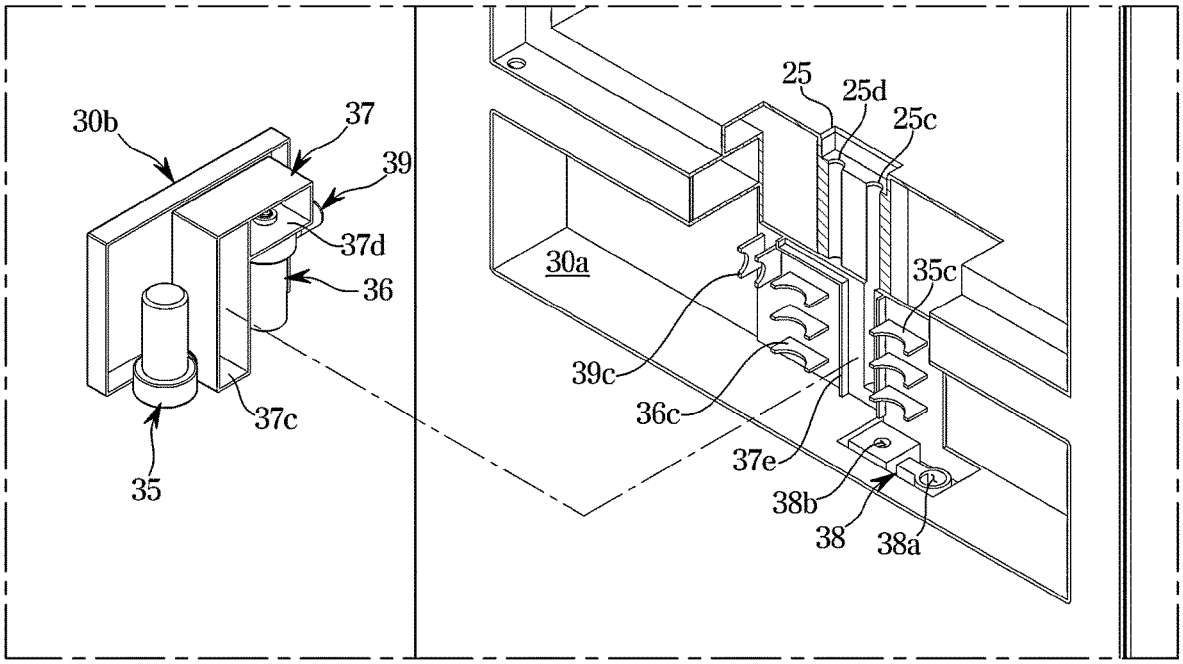
FIG. 15 illustrates a third chamber in a clothes care apparatus and components mounted in the third chamber, according to an embodiment.

FIG. 13 illustrates a third chamber of a first door and disassembled components otherwise accommodated in the third chamber in a clothes care apparatus, according to an embodiment. FIG. 14 illustrates what are shown in FIG. 13 at a different angle. FIG. 15 illustrates a third chamber and components mounted in the third chamber in a clothes care apparatus, according to an embodiment.

Referring to FIGS. 13 to 15, the first door 20 may have the third chamber 30*a* configured to receive the door drain tub 33 and the door water supply tub 34. The third chamber 30*a* may be formed under the home position part 25. The third chamber 30*a* may have both sides of a portion for receiving the door drain tub 33 and the door water supply tub 34 opened so that the door drain tub 33 and the door water supply tub 34 may be pulled out forward and backward.

The clothes care apparatus 1 may include the second water supply pump 35 and the second drain pump 36 accommodated in the third chamber 30*a*.

The second water supply pump 35 may be configured to move the water in the door water supply tub 34 into the water supply tub 121 when the spot cleaning device 100 is coupled to the home position part 25. The second water supply pump 35 may be arranged under the home position part 25. The second water supply pump 35 may move the water from the door water supply tub 34 arranged under the water supply tub 121 to the water supply tub 121.

The second water supply pump 35 may include a first pump inlet 35*a* through which water flows into the second water supply pump 35, and a first pump outlet 35*b* through which to drain the water brought into the second water supply pump 35. The first pump inlet 35*a* may be arranged on the bottom of the second water supply pump 35 and the first pump outlet 35*b* may be arranged on a side of the second water supply pump 35. With the layout of the first pump inlet 35*a* and the first pump outlet 35*b*, the second water supply pump 35 may draw in water underneath the second water supply pump 35 and release the water to the side of the second water supply pump 35.

The third chamber 30*a* may include a water supply pump mounting part 35*c* configured to install the second water supply pump 35. The water supply pump mounting part 35*c* may support the second water supply pump 35 to be fixed.

The third chamber 30*a* may include a first connecting hose 38 that connects the door water supply tub 34 to the first pump inlet 35*a* of the second water supply pump 35. The first connecting hose 38 may be integrally formed with the third chamber 30*a* in the third chamber 30*a* or configured to be separable from the third chamber 30*a*. The first connecting hose 38 may include a first connection port 38*a* configured to connect to a water supply tub opening 34*a* arranged on the bottom of the door water supply tub 34, and a second connection port 38*b* configured to connect to the first pump inlet 35*a* of the second water supply pump 35. The first connecting hose 38 may connect the first connection port 38*a* to the second connection port 38*b* so that the water brought in through the first connection port 38*a* is released through the second connection port 38*b*.

The second drain pump 36 may be configured to move the water in the drain tub 122 into the door drain tub 33 when the spot cleaning device 100 is coupled to the home position part 25. The second drain pump 36 may be arranged under the home position part 25. The second drain pump 36 may move the water in the drain tub 122 into the door drain tub 33 arranged diagonally beneath the drain tub 122.

The second drain pump 36 may include a second pump inlet 36*a* through which water flows into the second drain pump 36, and a second pump outlet 36*b* through which to drain the water brought into the second drain pump 36. The second pump inlet 36*a* may be arranged on the top of the drain pump 35 and the second pump outlet 36*b* may be arranged on a side of the second drain pump 35. With the layout of the second pump inlet 36*a* and the second pump outlet 36*b*, the drain pump 35 may draw in water above the second drain pump 36 and release the water to the side of the second drain pump 36.

The third chamber 30*a* may include a drain pump mounting part 36*c* configured to install the second drain pump 36. The drain pump mounting part 36*c* may support the second drain pump 36 to be fixed.

The clothes care apparatus 1 may include a second connecting hose 39 that connects the second pump outlet 36*b* of the water supply pump 36 to a drain tub opening 33*a* arranged on a side of the door drain tub 33. The second connecting hose 39 may be coupled to the second drain pump 36. The second connecting hose 39 may include a third connection port 39*a* connected to the second pump outlet 36*b* of the second drain pump 36, and a fourth connection port 39*b* connected to the drain tub opening 33*a* of the door drain tub 33. The third connection port 39*a* may be formed on one side of the second connecting hose 39, and the fourth connection port 39*b* may be formed on the other side of the second connecting hose 39. The second connecting hose 39 may connect the third connection port 39*a* to the fourth connection port 39*b* so that the water brought in through the third connection port 39*a* is released through the fourth connection port 39*b*. The second connecting hose 39 is a component to connect between the second drain pump 36 and the door drain tub 33 arranged to be laterally spaced apart, and may be omitted when the water supply pump 36 and the door drain tub 33 are arranged such that the second pump outlet 36*b* of the water supply pump 36 is directly connected to the drain tub opening 33*a* of the door drain tub 33.

The third chamber 30*a* may include a second connecting hose mounting part 39*c* configured to install the second connecting hose 39. The second connecting hose mounting part 39*c* may support the second connecting hose 39 to be fixed.

The clothes care device 1 may include a hose 37. The hose 37 may include a first hose 37*c* arranged to connect the first opening 25*c* formed at the home position part 25 to the first pump outlet 35*b* of the second water supply pump 35, and a second hose 37*d* configured to connect the second opening 25*d* formed at the home position part 25 to the second pump inlet 36*a* of the second drain pump 36. The first hose 37*c* and the second hose 37*d* may be separated from each other. The water in the first hose 37*c* and the water in the second hose 37*d* may not be mixed together.

The third chamber 30*a* may include a hose mounting part 37*e* configured to install the hose 37. The hose 37 may be installed at the hose mounting part 37*e* to form a flow path. The hose 37 may have a form with one open side. When the hose 37 is installed at the hose mounting part 37*e*, the hose mounting part 37*e* may cover the open side of the hose 37. With the hose mounting part 37*e* covering the open side of the hose 37, the water in the hose 37 may not flow into the third chamber 30*a*. In other words, the hose 37 may form a flow path in which the water moves. Alternatively, the hose may not include an open side. In this case, the hose may form a flow path inside.

The hose mounting part 37*e* may support the second water supply pump 35 to fix the hose 37.

The hose 37 may include a first hose opening 37*a* configured to connect to the first pump outlet 35*b* of the second water supply pump 35. The hose 37 may include a second hose opening 37*b* configured to connect to the second pump inlet 36*a* of the second drain pump 36. The hose 37 may be installed at the hose mounting part 37*e* to form a first flow path that connects the first opening 25*c* of the home position part 25 to the first pump outlet 35*b* of the second water supply pump 35 The hose 37 may be installed at the hose mounting part 37*e* to form a second flow path that connects the second opening 25*d* of the home position part 25 to the second pump inlet 36*a* of the second drain pump 36.

The clothes care device 1 may include a cover 30*b* configured to cover at least a portion of the third chamber 30*a* to prevent the second water supply pump 35, the second drain pump 36 and the hose 37 from being exposed to the outside. The cover 30*b* may be separated forward from the third chamber 30*a*. The cover 30*b* may be separated forward from the first door 20.

Figure 16:
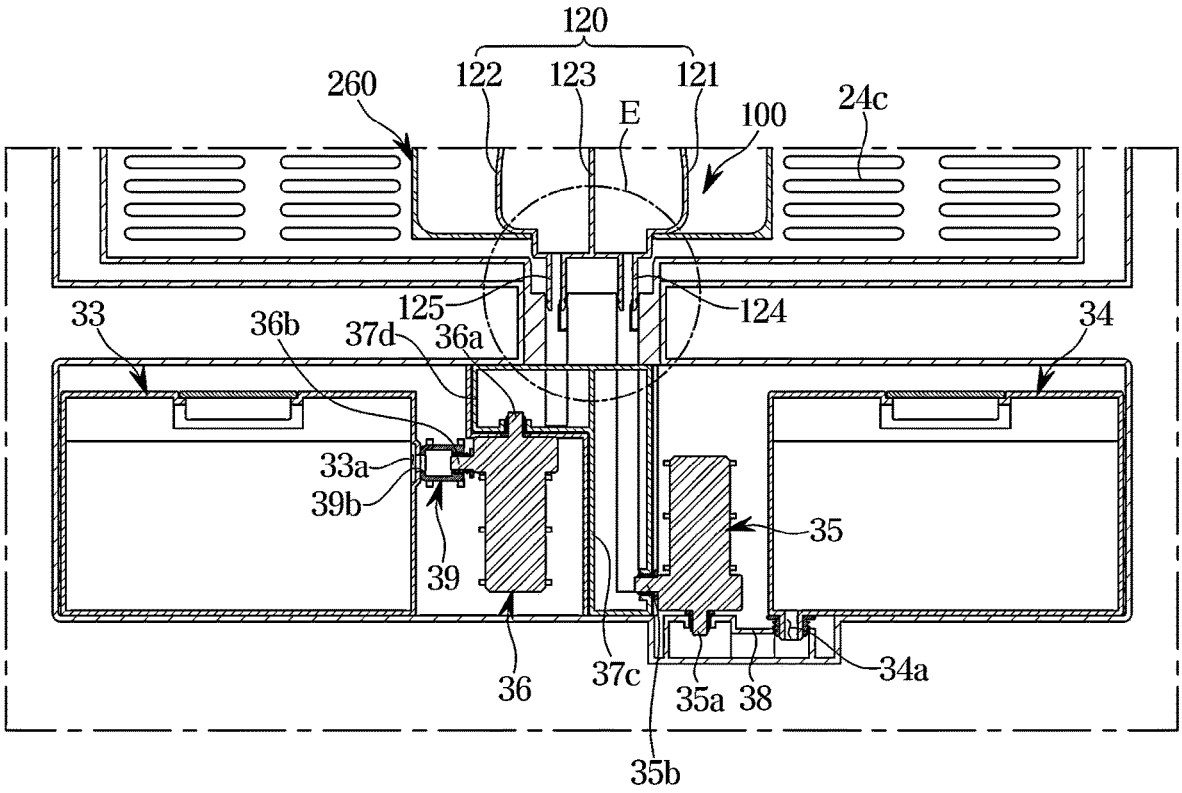
FIG. 16 is a cross-sectional view for describing water supply and drain procedures of a spot cleaning device coupled to a home position part in a clothes care apparatus, according to an embodiment.
Figure 17:
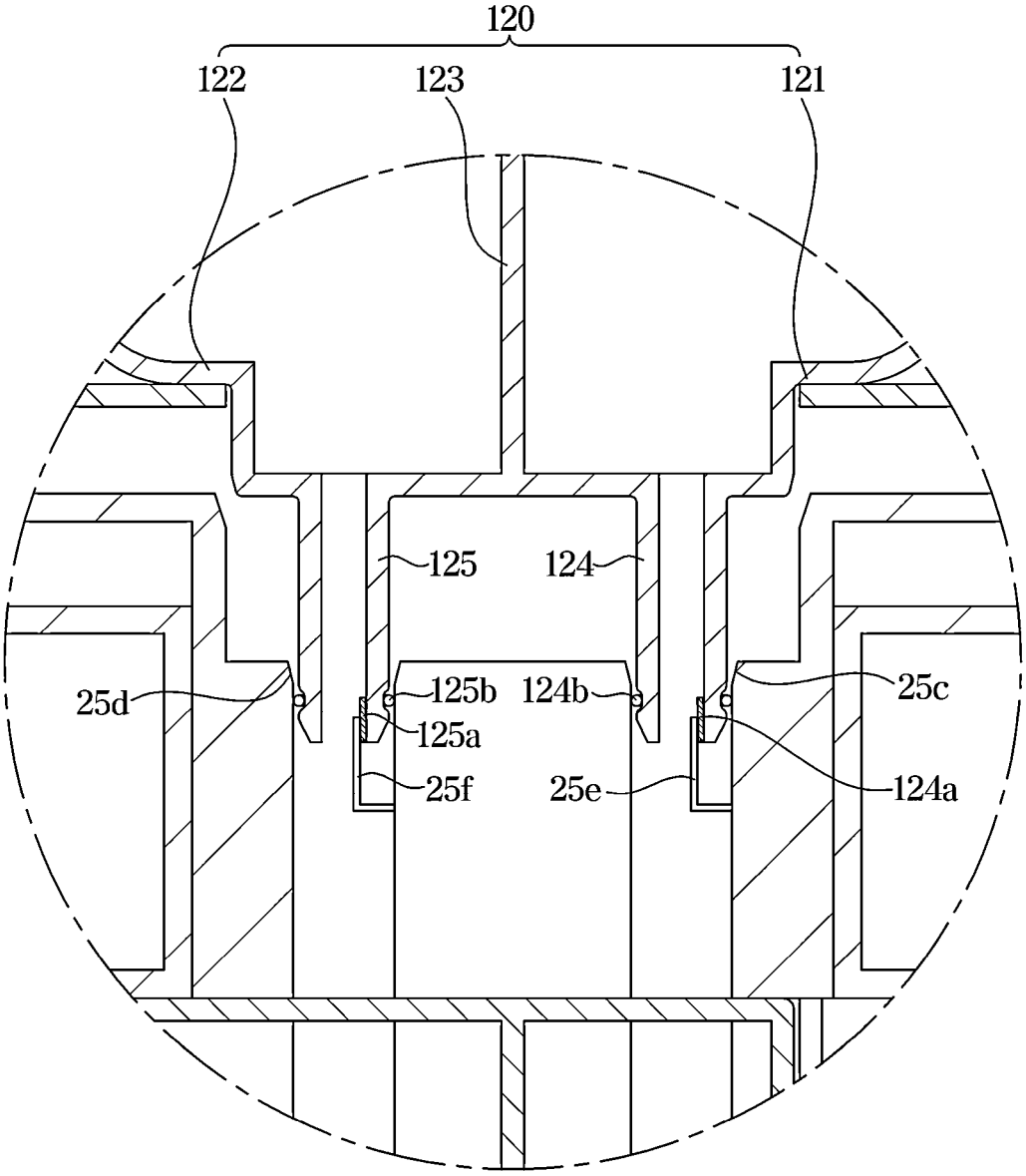
FIG. 17 is an enlarged view of E of FIG. 16.

FIG. 16 is a cross-sectional view for describing water supply and drain procedures of a spot cleaning device connected to a home position in a clothes care apparatus, according to an embodiment. FIG. 17 is an enlarged view of E of FIG. 16.

Referring to FIG. 16, when the spot cleaning device 100 is coupled to the home position part 25, the water supply part 124 of the spot cleaning device 100 may be connected to the first opening 25*c* of the home position part 25, and the drain part 125 of the spot cleaning device 100 may be connected to the second opening 25*d* of the home position part 25. At least a portion of the water supply part 124 may be inserted to the first opening 25*c*, and at least a portion of the drain part 125 may be inserted to the second opening 25*d*.

A first sealing member 124*b* may be configured to seal the gap between the water supply part 124 and the first opening 25*c* when the water supply part 124 is inserted to the first opening 25*c*. The first sealing member 124*b* may be arranged along the outer circumference of the water supply part 124. The first sealing member 124*b* may be shaped like a ring and coupled to the water supply part 124.

A second sealing member 125*b* may be configured to seal the gap between the drain part 125 and the second opening 25*d* when the drain part 125 is inserted to the second opening 25*d*. The second sealing member 125*b* may be arranged along the outer circumference of the drain part 125. The second sealing member 125*b* may be shaped like a ring and coupled to the drain part 125.

Referring to FIG. 17, as the water supply part 124 is inserted to the first opening 25*c*, the first check valve 124*a* may be opened. As the drain part 125 is inserted to the second opening 25*d*, the second check valve 125*a* may be opened. A first opener 25*e* may be provided inside the first opening 25*c* to open the first check valve 124*a*. A second opener 25*f* may be provided inside the second opening 25*d* to open the second check valve 125*a*. The first opener 25*e* may pressurize the first check valve 124*a* to open the first check valve 124*a* when the water supply part 124 is inserted to the first opening 25*c*. The second opener 25*f* may pressurize the second check valve 125*a* to open the second check valve 125*a* when the drain part 125 is inserted to the second opening 25*d*. The first check valve 124*a* may be moved by the first opener 25*e* from a position to close the water supply part 124 to a position to open the water supply part 124. The second check valve 125*a* may be moved by the second opener 25*f* from a position to close the drain part 125 to a position to open the drain part 125. The first opener 25*e* may have the form of a projection having a smaller diameter than the inner diameter of the water supply part 124. The second opener 25*f* may have the form of a projection having a smaller diameter than the inner diameter of the drain part 125.

When the water supply part 124 is connected to the first opening 25*c*, the first check valve 124*a* may be opened and the second water supply pump 35 may operate. When the drain part 125 is connected to the second opening 25*d*, the second check valve 125*a* may be opened and the second drain pump 36 may operate.

As the second water supply pump 35 operates, the water in the first connecting hose 38 may flow into the second water supply pump 35 through the first pump inlet 35*a*, and the water flowing into the second water supply pump 35 may be released into the first duct 37*c* through the first pump outlet 35*b*. When the second water supply pump 35 releases water in the first connecting hose 38 into the first duct 37*c*, the water in the door water supply tub 34 may pass through the water supply tub opening 34*a* and the first connection port 38*a* and flow into the first connecting hose 38 by gravity. In other words, water may be continuously supplied into the first connecting hose 38 from the door water supply tub 34 until the water supply tub 121 is full or the door water supply tub 34 is empty.

The water flowing into the first duct 37*c* may flow into the water supply part 124 through the first opening 25*c*. As the first check valve 124*a* is maintained in the open state by the first opener 25*e*, water may flow in through the water supply part 124. The water brought into the water supply part 124 may fill the water supply tub 121. The water in the door water supply tub 34 located under the water supply tub 121 may be supplied into the water supply tub 121 by the second water supply pump 35.

With the aforementioned procedure, water may be supplied from the door water supply tub 34 to the water supply tub 121. When the spot cleaning device 100 is decoupled from the home position part 25 after the water supply tub 121 is full with the water, the first check valve 124*a* may be moved from a position to open the water supply part 124 to a position to close the water supply part 124 by its own weight. As the first check valve 124*a* closes the water supply part 124, the water in the water supply tub 121 may not be released through the water supply part 124.

As the second drain pump 36 operates, the water in the second duct 37*d* may flow into the second drain pump 36 through the second pump inlet 36*a*, and the water flowing into the second drain pump 36 may be released into the second connecting hose 39 through the second pump outlet 36*b*. When the second drain pump 36 releases the water in the second duct 37*d* into the second connecting hose 39, water in the drain tub 122 may pass through the drain part 125 and the second opening 25*d* and flow into the second duct 37*d* by gravity. In other words, water may be continuously supplied into the second duct 37*d* from the drain tub 122 until the drain tub 122 is empty or the door water supply tub 34 is full.

The water released by the second drain pump 36 into the second connecting hose 39 may flow into the door drain tub 33 through the fourth connection port 39*b* and the drain opening 33*a*. As the second check valve 125*a* is maintained in the open state by the second opener 25*e*, water may be released through the drain part 125. The water released through the drain part 125 from the drain tub 122 may fill the door drain tub 33.

With the aforementioned procedure, water may be released from the drain tub 122 to the door drain tub 33. When the spot cleaning device 100 is decoupled from the home position part 25 after the drain tub 122 is emptied, the second check valve 125*a* may be moved from a position to open the drain part 125 to a position to close the drain part 125 by its own weight. As the second check valve 125*a* closes the drain part 125, the water in the drain tub 122 may not be released through the drain part 125.

Figure 18:
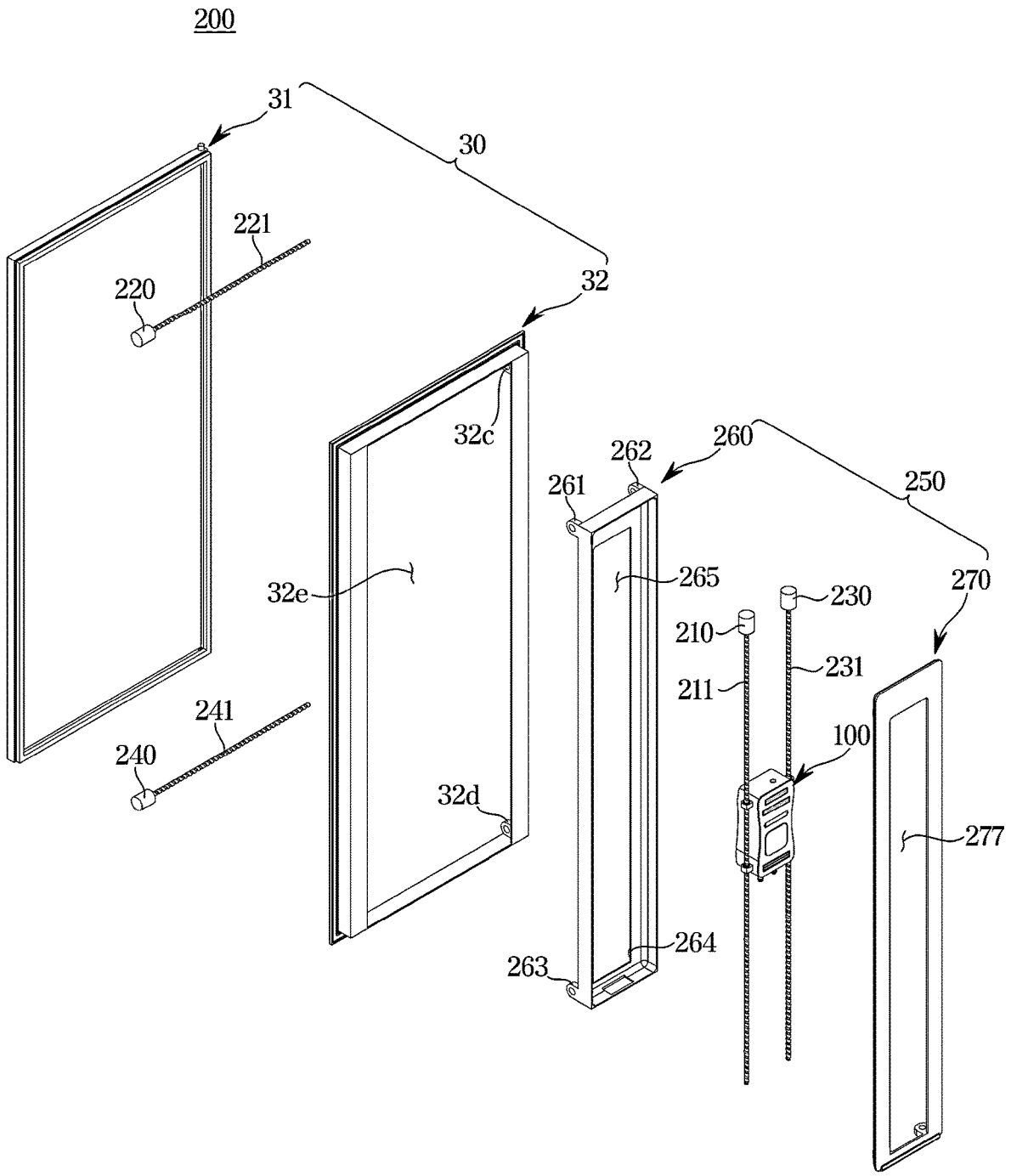
FIG. 18 is an exploded perspective view of a second door and a moving device, according to an embodiment.
Figure 19:
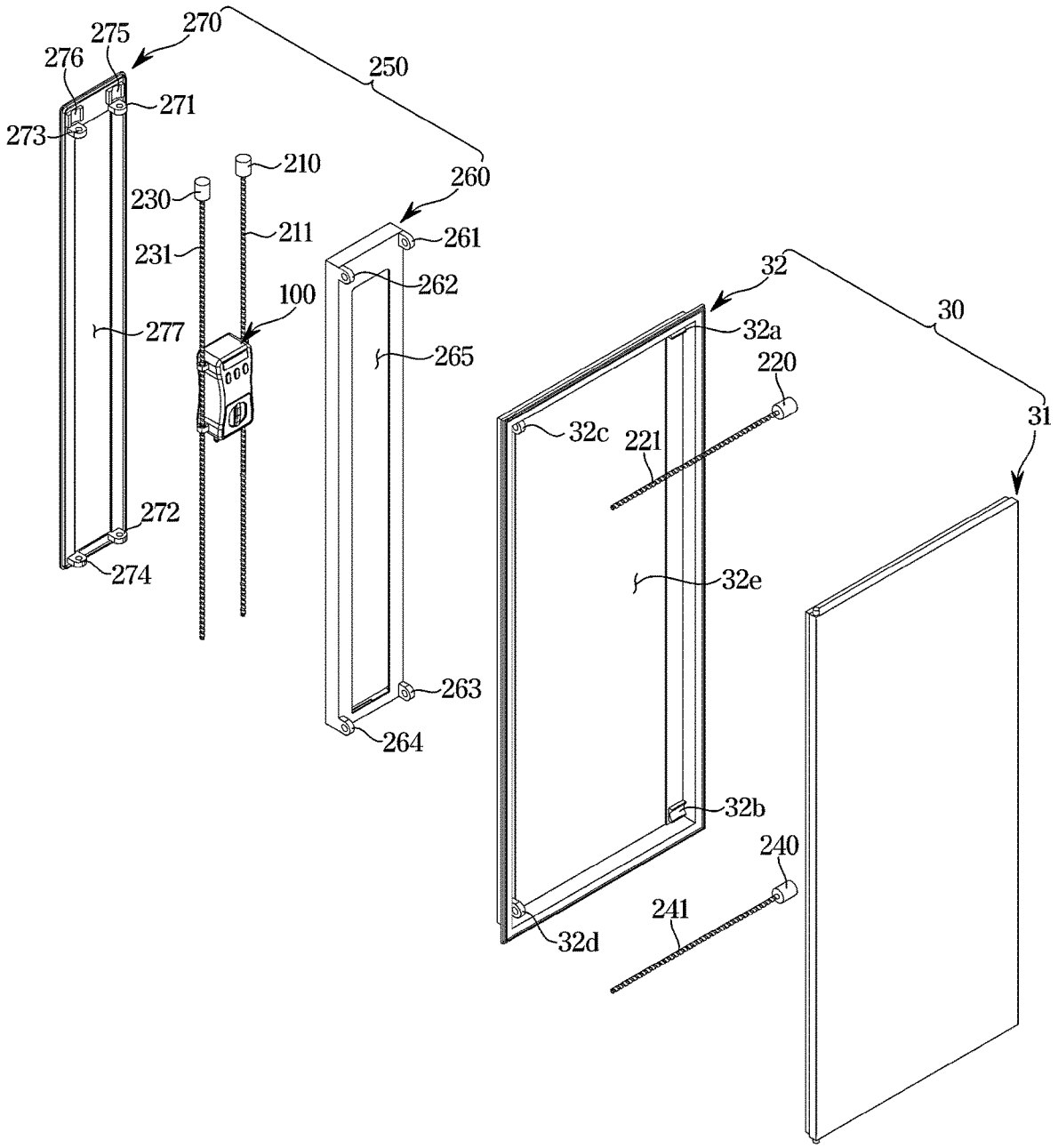
FIG. 19 illustrates what are shown in FIG. 18 at a different angle.

FIG. 18 is an exploded perspective view of a second door and a moving device, according to an embodiment. FIG. 19 illustrates what are shown in FIG. 18 at a different angle.

Referring to FIGS. 18 and 19, the clothes care apparatus 1 may include the moving device 200 configured to move the spot cleaning device 100. The moving device 200 may be configured to move the spot cleaning device 100 in the second chamber 22 along the first direction and the second direction. The moving device 200 may be arranged on the rear surface of the second door 30, and may be placed inside the second chamber 22 when the second door 30 is closed.

The moving device 200 may include a first motor 210 for providing driving force for the spot cleaning device 100 to be moved in the first direction, and a second motor 220 for providing driving force for the spot cleaning device 100 to be moved in the second direction. The moving device 200 may include a first shaft 211 extending in the first direction and connected to the first motor 210, and a second shaft 221 extending in the second direction and connected to the second motor 220. The first shaft 211 may be rotated clockwise or counterclockwise by the driving force of the first motor 210. The second shaft 221 may be rotated clockwise or counterclockwise by the driving force of the second motor 220.

In an embodiment, the moving device 200 may include a third motor 230 for providing driving force for the spot cleaning device 100 to be moved in the first direction, and a fourth motor 240 for providing driving force for the spot cleaning device 100 to be moved in the second direction. The moving device 200 may further include a third shaft 231 extending in the first direction and arranged in parallel with the first shaft 211, and a fourth shaft 241 extending in the second direction and arranged in parallel with the second shaft 221. The third shaft 231 may be rotated by receiving the driving force from the third motor 230, and the fourth shaft 241 may be rotated by receiving the driving force from the fourth motor 240. The third motor 230 may provide driving force with the first motor 210 to move the spot cleaning device 100 in the first direction. The fourth motor 240 may provide driving force with the second motor 220 to move the spot cleaning device 100 in the second direction. For example, the first to fourth motors may receive power from a power module of the clothes care apparatus through hinges of the first door and the second door. In another example, the first to fourth motors may receive power from the spot cleaning device.

Unlike what is shown in the drawings, the mobile device may only include the first and second motors. In this case, the moving device may include a first link member (not shown) connecting the first shaft to the third shaft so that the first shaft and the third shaft are rotated together, and a second link member (not shown) connecting the second shaft to the fourth shaft so that the second shaft and the fourth shaft are rotated together. When the first motor rotates the first shaft clockwise or counterclockwise, the first shaft and the third shaft may be rotated together clockwise or counterclockwise by the first link member. When the second motor rotates the second shaft clockwise or counterclockwise, the second shaft and the fourth shaft may be rotated together clockwise or counterclockwise by the second link member.

The moving device 200 may include a frame 250 to support the spot cleaning device 100. The frame 250 may support the spot cleaning device 100 to be movable in the first direction within the frame 250. The frame 250 may extend in the first direction. The frame 250 may receive the spot cleaning device 100, the first motor 210, the third motor 230, the first shaft 211 and the third shaft 231. The frame 250 may be connected to the second shaft 221 and the fourth shaft 241. The frame 250 may move along the second shaft 221 and the fourth shaft 241.

The frame 250 may receive the spot cleaning device 100 so that at least a portion of the spot cleaning device 100 is exposed to the second chamber 22. The frame 250 may support the spot cleaning device 100 so that the spot cleaning device 100 is movable within the frame 250. The frame 250 may extend in the first direction, and the spot cleaning device 100 may be moved in the first direction within the frame 250. The spot cleaning device 100 may be moved in the vertical direction within the frame 250.

The frame 250 may include a frame body 260, and a frame cover 270 coupled to the frame body 260.

The frame body 260 may include a first frame hole 265 provided for the spot cleaning device 100 to be inserted thereto. The spot cleaning device 100 may be inserted to the first frame hole 265. At least a portion of the spot cleaning device 100 may pass through the first frame hole 265 and protrude outward from the frame body 260. The first frame hole 265 may extend in the first direction and guide the movement of the spot cleaning device 100 in the first direction. The spot cleaning device 100 may be moved in the first frame hole 265 in the first direction. Unlike what is shown, the frame body 260 may receive the spot cleaning device 100 without having the first frame hole.

The frame body 260 may include a first frame moving part 261 and a second frame moving part 262 connected to the second shaft 221 and configured to move along the second shaft 221 in the second direction. The first frame moving part 261 and the second frame moving part 262 may be spaced apart in the left and right direction. The first frame moving part 261 may be arranged to be adjacent to the top on one side of the frame body 260 and the second frame moving part 262 may be arranged to be adjacent to the top on the other side of the frame body 260.

The frame body 260 may include a third frame moving part 263 and a fourth frame frame moving part 264 connected to the fourth shaft 241 and configured to move along the fourth shaft 241 in the second direction. The third frame moving part 263 and the fourth frame moving part 264 may be spaced apart in the left and right direction. The third frame moving part 263 may be arranged to be adjacent to the bottom on one side of the frame body 260 and the fourth frame moving part 264 may be arranged to be adjacent to the bottom on the other side of the frame body 260.

The frame body 260 may include the first to fourth frame moving parts 261 to 264. Each of the first to fourth frame moving parts 261 to 264 may include a hole formed for the shaft to pass through. A screw thread may be formed in the hole of each of the first to fourth frame moving parts 261, 262, 263 and 264 to correspond to a screw thread formed at the second shaft 221 or the fourth shaft 241. With this, the first frame moving part 261 and the second frame moving part 262 may move to the left or right with the rotation of the second shaft 221 in one direction, and the first frame moving part 261 and the second frame moving part 262 may move to the right or left with the rotation of the second shaft 221 in the other direction. Likewise, the third frame moving part 263 and the fourth frame moving part 264 may move to the left or right with the rotation of the fourth shaft 241 in one direction, and the third frame moving part 263 and the fourth frame moving part 264 may move to the right or left with the rotation of the fourth shaft 241 in the other direction. The one direction and the other direction in which the second shaft 221 and the fourth shaft 241 rotate may refer to clockwise (CW) and counterclockwise (CCW), respectively.

The frame cover 270 may be coupled to the frame body 260 to cover an open side of the frame body 260. The frame cover 270 coupled to the frame body 260 to form an inner space of the frame 250 that receives the spot cleaning device 100, the first motor 210, the third motor 230, the first shaft 211 and the third shaft 231.

The frame cover 270 may include first shaft supporters 271 and 272 configured to support the first shaft 211, and third shaft supporters 273 and 274 configured to support the third shaft 231. The frame cover 270 may include a first motor mounting part 275 on which the first motor 210 is mounted, and a third motor mounting part 276 on which the third motor 230 is mounted. The frame cover 270 may include a second frame hole 277 formed by penetrating the frame cover 270 to expose the spot cleaning device 100 to the second chamber 22.

The first shaft supporters 271 and 272 may be coupled to the first shaft 211. The first shaft supporters 271 and 272 may include the first upper supporter 271 arranged to be adjacent to the top on one side of the frame cover 270, and the first lower supporter 272 arranged to be adjacent to the bottom on the one side of the frame cover 270. The first upper supporter 271 and the first lower supporter 272 may each include a hole formed for the first shaft 211 to pass through. The first shaft 211 may be rotated within the first upper supporter 271 and the first lower supporter 272. The first shaft 211 may be idled within the first upper supporter 271 and the first lower supporter 272. In other words, even when the first shaft 211 is rotated within the first upper supporter 271 and the first lower supporter 272, the first upper supporter 271 and the first lower supporter 272 may not move in the first direction.

The third shaft supporters 273 and 274 may be coupled to the third shaft 231. The third shaft supporters 273 and 274 may include the second upper supporter 273 arranged to be adjacent to the top on the other side of the frame cover 270, and the second lower supporter 274 arranged to be adjacent to the bottom on the the other side of the frame cover 270. The second upper supporter 273 and the second lower supporter 274 may each include a hole formed for the third shaft 231 to pass through. The third shaft 231 may be rotated within the second upper supporter 273 and the second lower supporter 274. The third shaft 231 may be idled within the second upper supporter 273 and the second lower supporter 274. In other words, even when the third shaft 231 is rotated within the second upper supporter 273 and the second lower supporter 274, the second upper supporter 273 and the second lower supporter 274 may not move in the first direction.

The first motor 210 may be mounted on the first motor mounting part 275. Although the specific structure is not shown, the first motor mounting part 275 may support the first motor 210 in various structures. For example, the first motor mounting part 275 may include an elastic projection for the first motor 210 to fit into the first motor mounting part 275.

The third motor 230 may be mounted on the third motor mounting part 276. Although the specific structure is not shown, the third motor mounting part 276 may support the third motor 230 in various structures. For example, the third motor mounting part 276 may include an elastic projection for the third motor 230 to fit into the third motor mounting part 276.

The frame cover 270 may include a second frame hole 277 provided for the spot cleaning device 100 to be inserted thereto. The spot cleaning device 100 may be inserted to the second frame hole 277. At least a portion of the spot cleaning device 100 may pass through the second frame hole 277 and protrude outward from the frame cover 270. The spot cleaning device 100 may be exposed to the second chamber 22 through the second frame hole 277. The spot cleaning device 22 exposed to the second chamber 22 may partially clean the garment accommodated in the second chamber 22. The second frame hole 277 may extend in the first direction and guide the movement of the spot cleaning device 100 in the first direction. The spot cleaning device 100 may be moved in the second frame hole 277 in the first direction.

The moving device 200 may include a second motor 220 and a fourth motor 240 for providing driving force for the spot cleaning device 100 to be moved in the second direction. The second motor 220 may be connected to the second shaft 221, and the fourth motor 240 may be connected to the fourth shaft 241.

The second motor 220 and the fourth motor 240 may be coupled to the second door 30. The second door 30 may include a door body 31, and a support frame 32 coupled onto the rear side of the door body 31. The door body 31 may be pivotally coupled to the first door 20. The door body 31 may open or close the second chamber 22.

The second motor 220 and the fourth motor 240 may be mounted on the support frame 32 of the second door 30. The second motor 220 may be mounted in a second motor mounting part 32*a* on the support frame 32. The second motor mounting part 32*a* may be arranged to be adjacent to the top on one side of the support frame 32. Although the specific structure is not shown, the second motor mounting part 32*a* may support the second motor 220 in various structures. For example, the second motor mounting part 32*a* may include an elastic projection for the second motor 220 to fit into the second motor mounting part 32*a*. The fourth motor 240 may be mounted in a fourth motor mounting part 32*b* on the support frame 32. The fourth motor mounting part 32*b* may be arranged to be adjacent to the bottom on the one side of the support frame. Although the specific structure is not shown, the fourth motor mounting part 32*b* may support the fourth motor 240 in various structures. For example, the fourth motor mounting part 32*b* may include an elastic projection for the fourth motor 240 to fit into the fourth motor mounting part 32*b*.

The second shaft 221 may be coupled with a second shaft supporter 32*c* on the support frame 32. The second shaft supporter 32*c* may be arranged to be adjacent to the top on the other side of the support frame 32. The second shaft supporter 32*c* may include a hole formed for the second shaft 221 to pass through. The second shaft 221 may be idled within the second shaft supporter 32*c*. In other words, even when the second shaft 221 is rotated within the second shaft supporter 32*c*, the second shaft supporter 32*c* may not move along the second direction.

The fourth shaft 241 may be coupled with a fourth shaft supporter 32*d* on the support frame 32. The fourth shaft supporter 32*d* may be arranged to be adjacent to the bottom on the other side of the support frame 32. The fourth shaft supporter 32*d* may include a hole formed for the fourth shaft 241 to pass through. The fourth shaft 241 may be idled within the fourth shaft supporter 32*d*. In other words, even when the fourth shaft 241 is rotated within the fourth shaft supporter 32*d*, the fourth shaft supporter 32*d* may not move along the second direction.

The support frame 32 may include a support frame hole 32*e* formed by penetrating the support frame 32 so that the frame 250 may move in the second direction within the support frame 32. The frame 250 may move in the second direction against the support frame hole 32*e*.

As described above, the spot cleaning device 100 may be moved in the first direction within the frame 250. The frame 250 that receives the spot cleaning device 100 may be moved in the second direction within the support frame 32 on the second door 30. With this, the spot cleaning device 100 may be moved in the first and second directions. In other words, the spot cleaning device 100 may be moved upward, downward, to the left or right in the second chamber 22.

Figure 20:
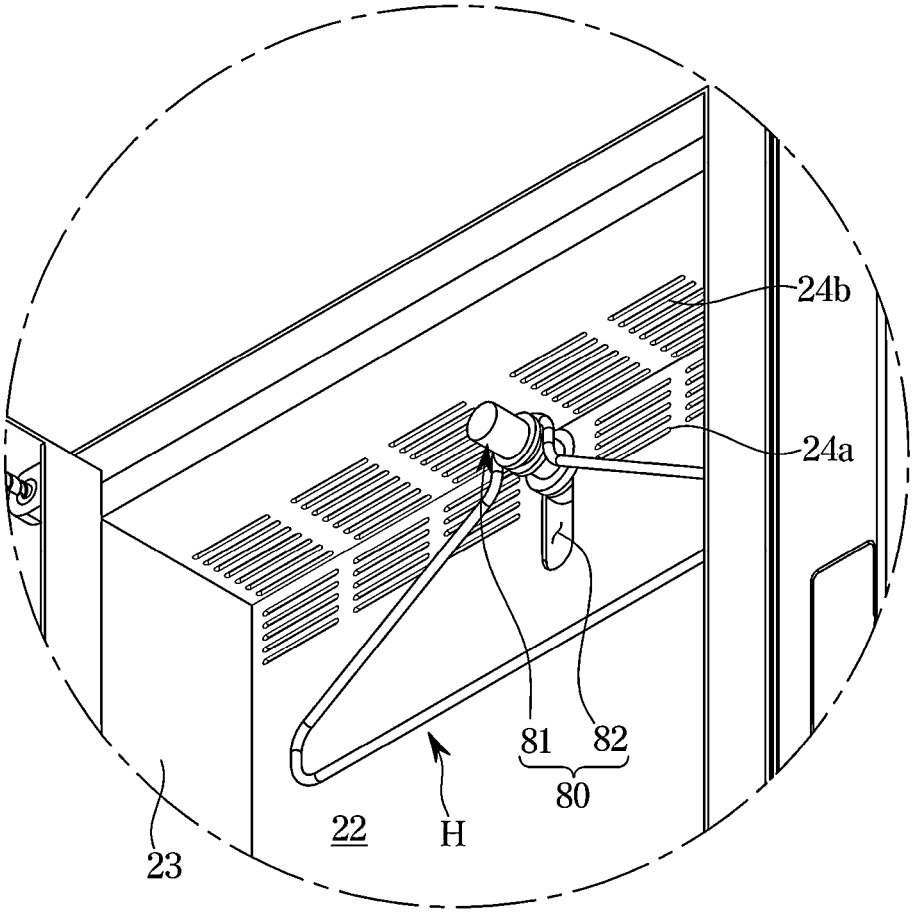
FIG. 20 illustrates a second chamber, according to an embodiment.
Figure 21:
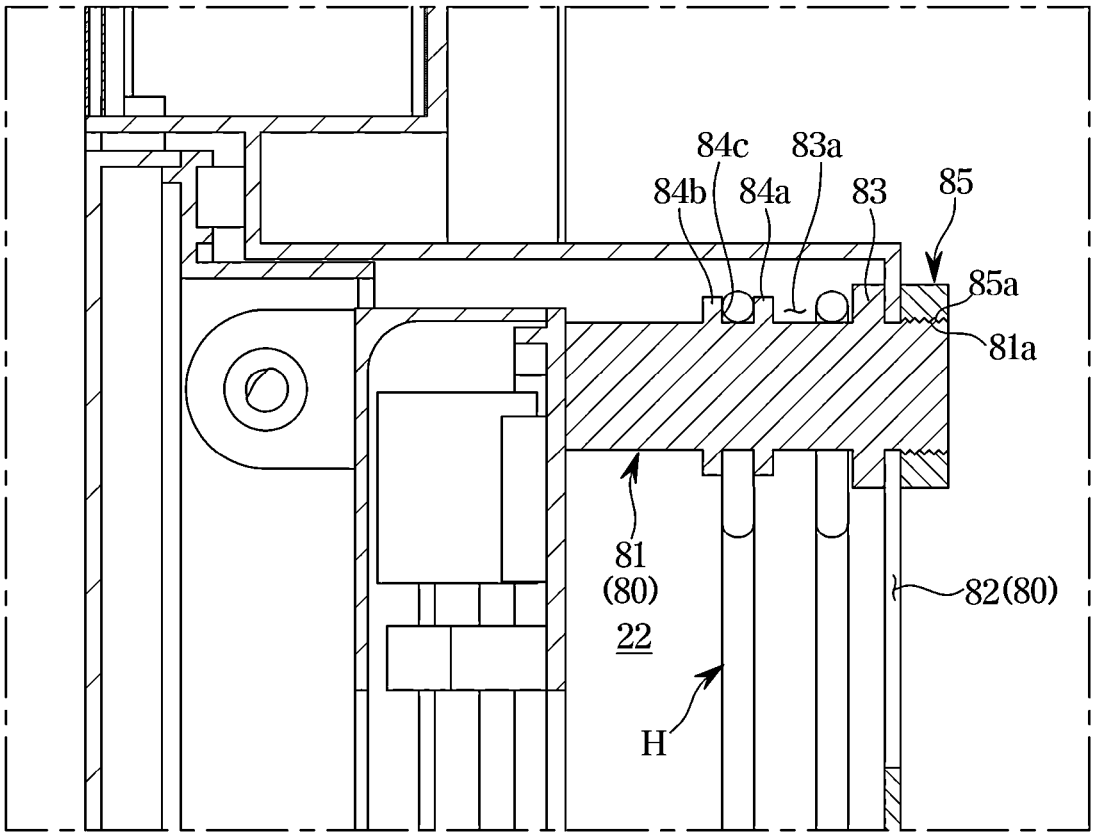
FIG. 21 is an enlarged view of B of FIG. 4.
Figure 22:
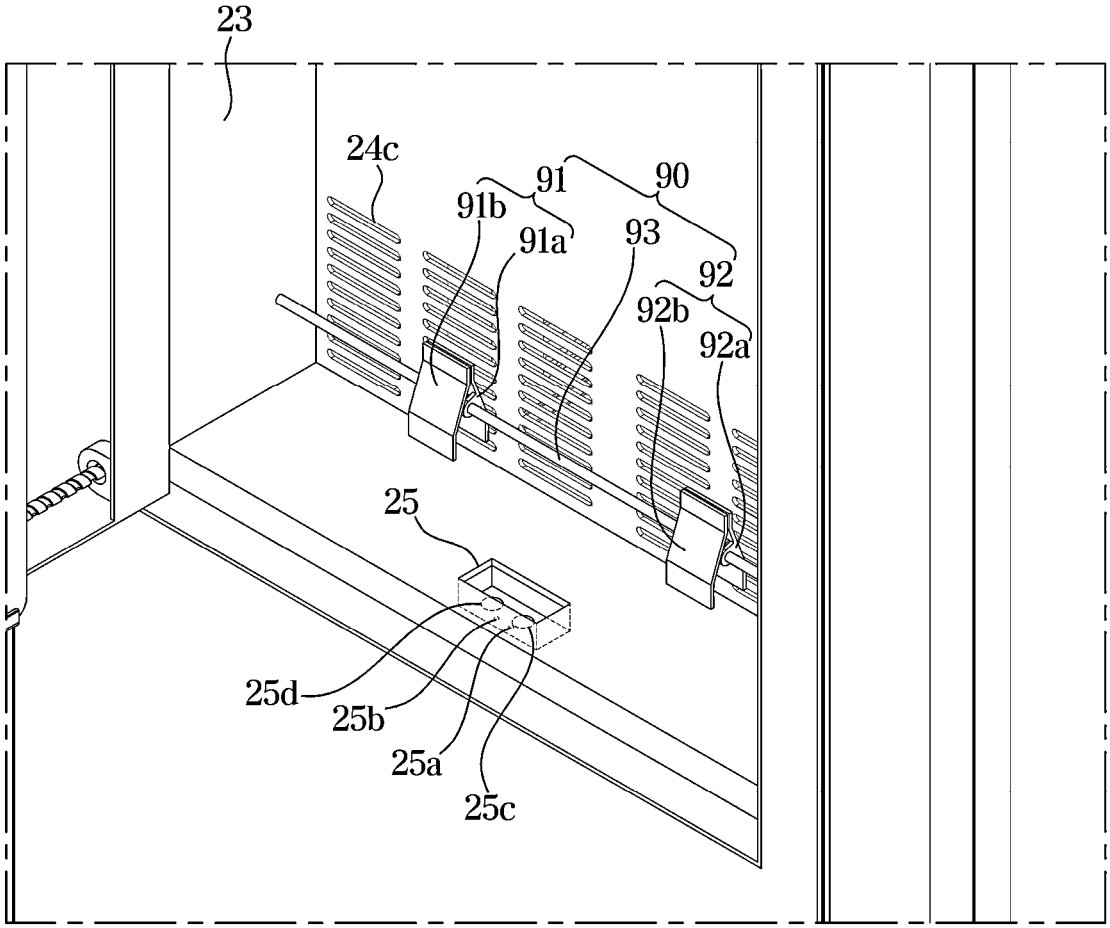
FIG. 22 is an enlarged view of A of FIG. 3.

FIG. 20 illustrates a second chamber, according to an embodiment. FIG. 21 is an enlarged view of B of FIG. 4. FIG. 22 is an enlarged view of A of FIG. 3.

Referring to FIGS. 20 to 22, the clothes care apparatus 1 may include a supporter 80 and a fixer 90 arranged in the second chamber 22.

The supporter 80 may be arranged to be adjacent to the top of the second chamber 22. The supporter 80 may be configured to support hangers (H) or support the garment, as shown in FIG. 20. The supporter 80 may be arranged to be movable in the vertical direction.

The supporter 80 may include a guide hole 82 extending vertically, and a support member 81 arranged to be vertically movable along the guide hole 82 and fixed at a position in the guide hole 82.

The guide hole 82 may be formed on the rear surface of the second chamber 22. The guide hole 82 may be formed at a location adjacent to the top of the rear surface of the second chamber 22. The guide hole 82 may extend vertically. The support member 81 may be vertically movable within the guide hole 82. Hence, the guide hole 82 may define a vertical movement range of the support member 81. To increase the vertical movement range of the support member 81, the vertical length of the guide hole 82 may be increased.

The supporter 80 may include a coupling member 85 coupled to the support member 81 to fix the support member 81 at one position within the guide hole 82. The coupling member 85 may be coupled to the support member 81 from outside of the second chamber 22. The coupling member 85 may be coupled to the support member 81 by being turned. For example, the coupling member 85 may correspond to a nut and the support member 81 may correspond to a bolt. The coupling member 85 may include a screw thread 85*a* on the inside, and the support member 81 may include a screw thread 81*a* on the outside.

The support member 81 may include a first groove 83*a* and a second groove 84*c* formed for at least a portion of the hanger H to be inserted thereto. The support member 81 may include a first projection 83 and a second projection 84*a* that radially protrude from the support member 81 to form the first groove 83*a*. The support member 81 may include a third projection 84*b* that radially protrudes from the support member 81 to form the second groove 84*c*. The first groove 83*a* may be formed between the first projection 83 and the second projection 84*a*, and the second groove 84*c* may be formed between the second projection 84*a* and the third projection 84*b*. In another example, the support member 81 may include only one of the first groove 83*a* or the second groove 84*c*.

The first groove 83*a* may have a larger width than the second groove 84*c* in the forward and backward directions. The forward and backward direction may refer to the left and right direction of FIG. 10 The user may put the hanger H in the second groove 84*c* to fix the hanger H in the forward and backward directions. The user may put the hanger in the first groove 83*a* when the hanger is too thick to fit into the second groove 84*c*. That is, the hanger H may be hung in the second chamber 22 by putting the hanger H in the first groove 83*a* or the second groove 84*c* according to a choice of the user.

Referring to FIG. 22, the clothes care apparatus 1 may include the fixer 90 configured to fix the garment accommodated in the second chamber 22.

The fixer 90 may be configured to hold and fix at least a portion of the garment (e.g., a lower portion of the garment). The fixer 90 may include a bar 93 arranged to be adjacent to the bottom of the second chamber 22 and configured to horizontally cross the second chamber 22, and fixing members 91 and 92 configured to be horizontally movable along the bar 93.

The fixing members 91 and 92 may be configured to hold and fix the garment. The fixing members 91 and 92 may include the first fixing member 91 and the second fixing member 92. Alternatively, there may be one or three or more fixing members.

The first fixing member 91 may include a first moving member 91*a* configured to be horizontally movable along the bar 93 and a first rotating member 91*b* rotationally coupled with the first moving member 91*a*. The first rotating member 91*b* may be elastically biased in a direction approaching the first moving member 91*a*. For this, the first fixing member 91 may include an elastic member (not shown).

The second fixing member 92 may include a second moving member 92*a* configured to be horizontally movable along the bar 93 and a second rotating member 92*b* rotationally coupled with the second moving member 92*a*. The second rotating member 92*b* may be elastically biased in a direction approaching the second moving member 92*a*. For this, the second fixing member 92 may include an elastic member (not shown).

In an embodiment, the bar 93 may be fixed to a position adjacent to the bottom of the second chamber 22. As the support member 81 is arranged to be vertically movable within the guide hole 82 even when the bar 93 is fixed, the support member 81 or the hanger H hung on the support member 81 may support an upper portion of the garment and the fixing members 91 and 92 may fix a lower portion of the garment. When the garment is short in vertical direction, the support member 81 is moved downward so that the support member 81 or the hanger H hung on the support member 81 may support the upper portion of the garment and the fixing members 91 and 92 may fix the lower portion of the garment. In order to fix upper and lower portions of the garment having various sizes, the bar 93 may be configured to be movable vertically.

With the use of the supporter 80 and the fixer 90 included in the clothes care apparatus 1, the garment accommodated in the second chamber 22 may be pulled tightly in the vertical direction. The supporter 80 may fix the upper portion of the garment and the fixer 90 may hold and fix the lower portion of the garment, so that the garment may remain in the tightly pulled state. This may facilitate spot cleaning of the spot cleaning device 100 and increase the cleaning efficiency of the spot cleaning device 100.

Referring to FIG. 21, the home position part 25 may be arranged at the second chamber 22. Charging terminals 25*a* and 25*b* may be arranged in the home position part 25 to charge the battery 118*b* of the spot cleaning device 100. The charging terminals 25*a* and 25*b* may include the positive electrode 25*a* and the negative electrode 25*b*. The positive electrode 25*a* and the negative electrode 25*b* of the home position part 25 may correspond to the positive electrode 115*a* and the negative electrode 115*b* of the spot cleaning device 100, respectively. The charging terminals are not limited to the example but may have many different commercialized forms.

The spot cleaning device 100 may be docked to the home position part 25 such that the charging terminals 115*a* and 115*b* of the spot cleaning device 100 come into contact with the charging terminals 25*a* and 25*b* arranged in the home position part 25 of the first door 20, respectively. The spot cleaning device 100 may be docked to the home position part 25, may charge the battery 118*b*, and then clean the target portion of the garment accommodated in the second chamber 22 in response to the user's input or a command from the controller 180 or 300.

Figure 23:
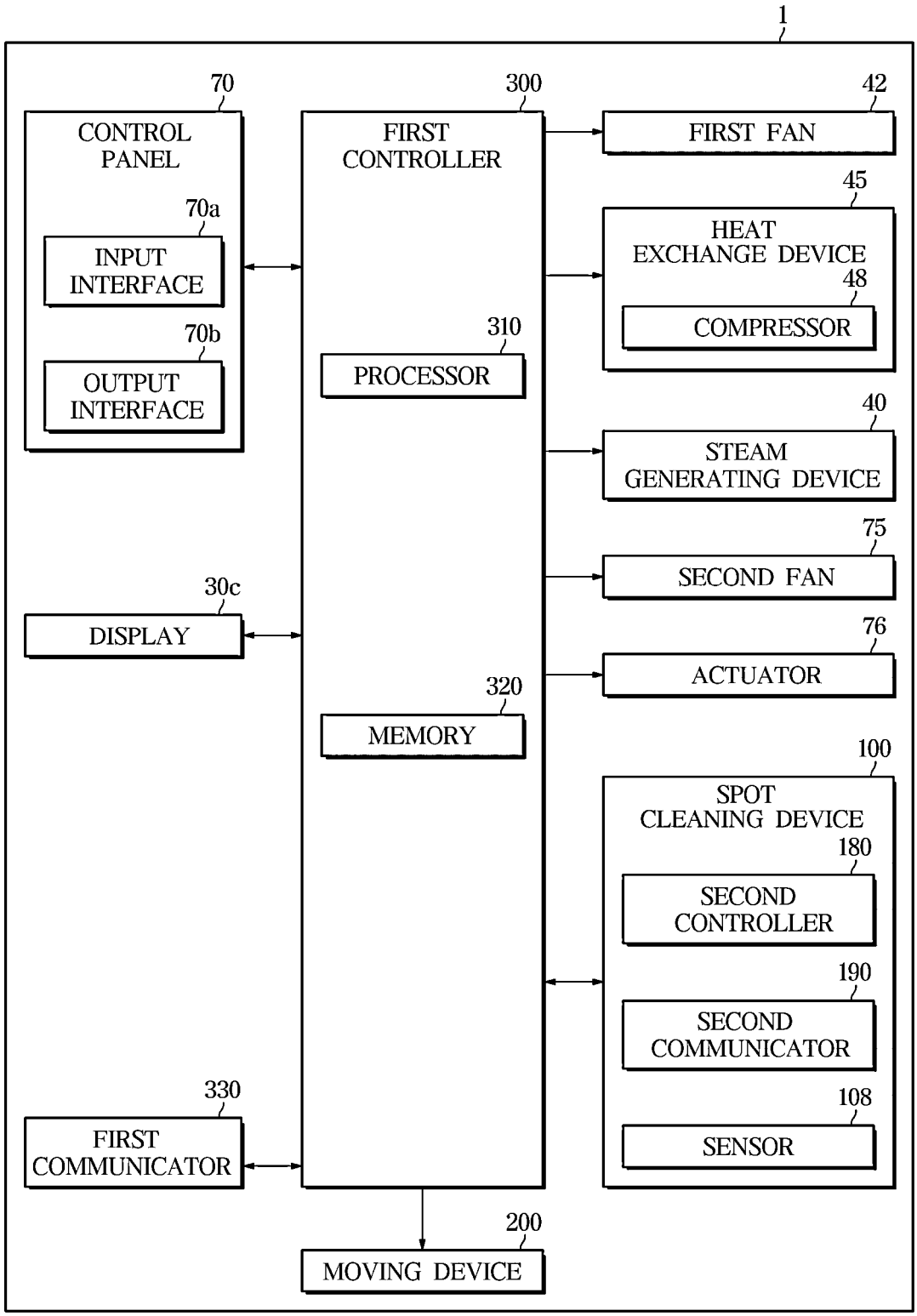
FIG. 23 is a control block diagram of a clothes care apparatus, according to an embodiment.

FIG. 23 is a control block diagram of a clothes care apparatus, according to an embodiment.

Referring to FIG. 23, the clothes care apparatus 1 according to an embodiment may include the display 30*c*, the control panel 70, the heat exchange device 45, the first fan 42, the steam generating device 40, the second fan 75, an actuator 76, the spot cleaning device 100, the moving device 200, a communicator 330 and/or a first controller 300.

The control panel 70 may include at least one input interface 70*a* and at least one output interface 70*b*.

Figure 24:
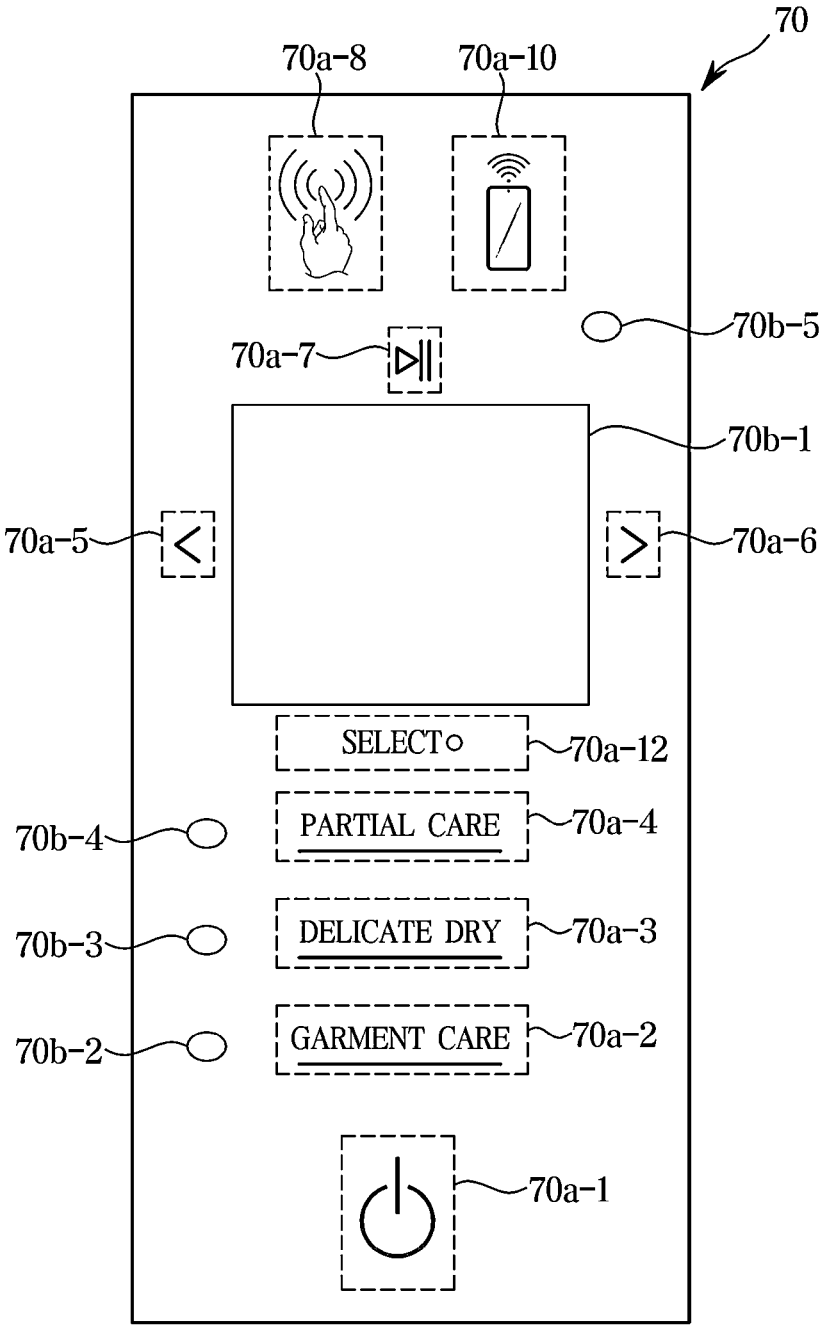
FIG. 24 illustrates an example of a control panel, according to an embodiment.

FIG. 24 illustrates an example of a control panel, according to an embodiment.

Referring to FIG. 24, the at least one input interface 70*a* may include a power button 70*a*-1, course selection buttons 70*a*-2, 70*a*-3 and 70*a*-4, direction selection buttons 70*a*-5 and 70*a*-6, a start/pause button 70*a*-7, a second door 30 open button 70*a*-8, a communication button 70*a*-10 and/or a selection button 70*a*-12.

Each button may include a visual indicator (e.g., text, an icon, etc.) that may indicate the function.

The at least one input interface 70*a* may include, for example, a tact switch, a push switch, a slide switch, a toggle switch, a micro switch, a touch switch, a touch pad, a touch screen, a jog dial and/or a microphone.

In the disclosure, the term button may be replaced by a user interface (UI) element, a tact switch, a push switch, a slide switch, a toggle switch, a micro switch, a touch switch, a touch pad, a touch screen, a jog dial and/or a microphone.

The at least one output interface 70*b* may send various information relating to the operation of the clothes care apparatus 1 to the user by generating sensory information.

For example, the at least one output interface 70*b* may send information relating to a garment care course, operation time of the clothes care apparatus 1, target portion settings for partial care, etc., to the user. The information relating to the operation of the clothes care apparatus 1 may be output through the display 70*b*-1 or 30*c*, an indicator 70*b*-2, 70*b*-3, 70*b*-4 or 70*b*-5, voice, etc. The at least one output interface 70*b* may include, for example, a liquid crystal display (LCD) panel, an indicator, a light emitting diode (LED) panel, a speaker, etc.

The display 70*b*-1 or 30*c* may output information relating to a garment care course, operation time of the clothes care apparatus 1, target portion settings for partial care, etc. The display 70*b*-1 or 30*c* may include a touch panel for receiving the user's touch input.

The indicator 70*b*-2, 70*b*-3, 70*b*-4 or 70*b*-5 may visually indicate operation status of the clothes care apparatus 1 to the user.

The garment care indicator 70*b*-2 may be turned on during operation of a garment care course.

The delicate dry indicator 70*b*-3 may be turned on during operation of a delicate dry course.

The partial care indicator 70*b*-4 may be turned on during operation of a partial care course.

The power button 70*a*-1 is a button to power on or off the clothes care apparatus 1.

The course selection buttons 70*a*-2, 70*a*-3 and 70*a*-4 are buttons to select a course of the clothes care apparatus 1.

The course selection buttons 70*a*-2, 70*a*-3 and 70*a*-4 may include the buttons 70*a*-2 and 70*a*-3 to select a course for caring garment accommodated in the first chamber 11 and the button 70*a*-4 to select a course for caring the garment accommodated in the second chamber 22.

The buttons to select a course for caring the garment accommodated in the first chamber 11 may include the garment care button 70*a*-2.

Once the garment care button 70*a*-2 is selected, at least one course corresponding to garment care may be displayed on the output interface 70*b* (e.g., the display 70*b*-1 or 30*c*) and the user may select a desired course by using the direction selection button 70*a*-5 or 70*a*-6. The at least one course may include various courses such as a standard course, a large-volume care course, a sterilization course, a fine dust course, a quick course, a school uniform course, a denim course, a coat course, a wool/knit course, a suit course, etc.

The buttons to select a course for caring the garment accommodated in the first chamber 11 may include the delicate dry button 70*a*-2.

Once the delicate dry button 70*a*-2 is selected, at least one course corresponding to delicate dry may be displayed on the output interface 70*b* (e.g., the display 70*b*-1 or 30*c*) and the user may select a desired course by using the direction selection button 70*a*-5 or 70*a*-6. The at least one course may include various courses such as a customized dry course, a shirts course, a swimsuit course, an outdoor wear course, fitness wear course, a blouse course, a denim course, a coat course, a wool/knit course, a suit course, a space dehumidification course, etc.

Once the start button 70*a*-7 is selected after a course for caring the garment is selected, the first controller 300 may control a component (e.g., the heat exchange device 45, the steam generating device 40, the first fan 42 and/or the second fan 75) of the clothes care apparatus 1 according to an algorithm for the selected course to perform the selected course.

In the disclosure, as the second chamber 22 includes the air current inlets 24*a* and 24*b* and the air current outlet 24*c*, the garment accommodated in the second chamber 22 may also be cared when a course for caring the garment accommodated in the first chamber 11 is performed.

Accordingly, it is also possible for the user to select a course for caring the garment accommodated in the first chamber 11 in order to care the garment accommodated in the second chamber 22.

The button 70*a*-4 to select a course for caring the garment accommodated in the second chamber 22 may include the partial care button 70*a*-4.

The partial care button 70*a*-4 is a button to select a course for partially caring the garment accommodated in the second chamber 22 by using the spot cleaning device 100.

Once the partial care button 70*a*-4 is selected, an interface for controlling the spot cleaning device 100 may be provided for the output interface 70*b* (e.g., the display 70*b*-1 or 30*c*).

For example, once the partial care button 70*a*-4 is selected, an interface for setting a target portion may be provided for the output interface 70*b* (e.g., the display 70*b*-1 or 30*c*).

The direction selection buttons 70*a*-5 and 70*a*-6 may include the left button 70*a*-5 and the right button 70*a*-6. In various embodiments, it is also possible that the direction selection buttons 70*a*-5 and 70*a*-6 include the top button and the bottom button or that one of the buttons is omitted.

The direction selection buttons 70*a*-5 and 70*a*-6 are buttons to manipulate an interface provided through the display 70*b*-1 or 30*c*. For example, the direction selection buttons 70*a*-5 and 70*a*-6 may be used to change the selection of a UI element provided by the display 70*b*-1 or 30*c*.

In an embodiment, the direction selection button 70*a*-5 and 70*a*-6 may be used to set a target portion for the partial care course.

The start/pause button 70*a*-7 is a button to start the selected course or pause the course in operation.

The second door 30 open button 70*a*-8 is a button to automatically open the second door 30.

The communication button 70*a*-10 is a button to set up communication of the clothes care apparatus 1. The clothes care apparatus 1 may access a nearby access point (AP) through the communication button 70*a*-10. The clothes care apparatus 1 may communicate with an external device such as a server, a user equipment, another home appliance, etc., through the nearby AP.

The selection button 70*a*-12 is a button to manipulate an interface provided by the display 70*b*-1 or 30*c*. For example, the selection button 70*a*-12 may be used to select a UI element provided by the display 70*b*-1 or 30*c*.

In an embodiment of the disclosure, various buttons included on the control panel 70 are not limited to the above example, and it is obvious that some of the buttons may be omitted or certain buttons may be added thereto.

For example, the control panel 70 may further include an interface button to display a user interface related to the spot cleaning device 100, as will be described later, on the display 70*b*-1 or 30*c*, or remove the user interface from the display 70*b*-1 or 30*c*.

The heat exchange device 45 may include the compressor 48 for compressing the refrigerant to heat the air supplied into the first chamber 11. The compressor 48 may operate based on a control signal from the controller 300.

The first fan 42 may force the air in the first chamber 11 to pass through the machine room 13, the evaporator 46 and the condenser 47 and to be released back into the first chamber 11. The first fan 42 may be operated based on a control signal from the controller 300.

The steam generator 40 may spray steam into the first chamber 11. The steam generator 40 may operate based on a control signal from the first controller 300.

The second fan 75 may force the air in the first chamber 11 to circulate through the second air current outlet 12*b* or the garment support member 50 back into the first chamber 11. The second fan 75 may be operated based on a control signal from the controller 300.

The actuator 76 may open the second door 30. The actuator 76 may operate based on a control signal from the first controller 300. For example, the actuator 76 may include a member such as an electromagnet or a link member or may include any component that is able to push the second door 30.

The clothes care apparatus 1 may include the first communicator 330 for communicating with an external device (e.g., a server, a user equipment, the spot cleaning device 100 and/or a home appliance) wiredly and/or wirelessly.

The first communicator 330 may include at least one of a short-range communication module or a long-range communication module.

The first communicator 330 may transmit data to the external device or receive data from the external device. For example, the first communicator 330 may establish communication with the server, the user equipment and/or the other home appliance to transmit or receive various data.

For this, the first communicator 330 may support establishment of a direct (e.g., wired) communication channel or a wireless communication channel with the external device, and communication through the established communication channel. In an embodiment, the first communicator 330 may include a wireless communication module (e.g., a cellular communication module, a short-range wireless communication module or a global navigation satellite system (GNSS) communication module) or a wired communication module (e.g., a local area network (LAN) communication module or a power-line communication module). A corresponding one of the communication modules may communicate with an external device over a first network (e.g., a short-range communication network such as bluetooth, wireless-fidelity (Wi-Fi) direct or infrared data association (IrDA)) or a second network (e.g., a remote communication network such as a legacy cellular network, a fifth generation (5G) network, a next generation communication network, the Internet, or a computer network (e.g., a LAN or wide area network (WAN)). These various types of communication modules may be integrated into a single component (e.g., a single chip) or implemented as a plurality of separate components (e.g., a plurality of chips).

The short-range communication module may include a bluetooth communication module, a bluetooth low energy (BLE) communication module, a near field communication (NFC) module, a WLAN, e.g., Wi-Fi, communication module, a Zigbee communication module, an infrared data association (IrDA) communication module, a Wi-Fi direct (WFD) communication module, an ultrawideband (UWB) communication module, an Ant+ communication module, a microwave (uWave) communication module, etc., without being limited thereto.

The long-range communication module may include a communication module for performing various types of long-range communication and include a first mobile communicator 330. The first mobile communicator 330 transmits or receives wireless signals to and from at least one of a base station, an external terminal, or a server in a mobile communication network.

In an embodiment, the first communicator 330 may communicate with an external device such as a server, a user equipment, another home appliance, etc., through a nearby AP. The AP may connect a LAN connected to the clothes care apparatus 1, another home appliance and/or user equipment to a WAN connected to the server. The clothes care apparatus 1, the other home appliance and/or the user equipment may be connected to the server through the WAN.

The spot cleaning device 100 may be arranged in the second chamber 22 to do the partial wash (spot cleaning) on the garment accommodated in the second chamber 22.

The spot cleaning device 100 may include the second controller 180 for controlling the components of the spot cleaning device 100 (e.g., the water sprayer 101, the washing fluid sprayer 102, the vibrator 103, the suction part 103 and/or the at least one sensor 108) and the second communicator 190 for communicating with an external device (e.g., a server, a user equipment, the first communicator 330 and/or a home appliance).

The second communicator 190 included in the spot cleaning device 100 may communicate with the first communicator 330 of the clothes care apparatus 1 wiredly or wirelessly.

In an embodiment, when the second communicator 190 included in the spot cleaning device 100 performs wireless communication with the first communicator 330 of the clothes care apparatus 1, it may dispense with a wire for connecting the cabinet 10 of the clothes care apparatus 1 to the spot cleaning device 100, thereby preventing the wire from spoiling the appearance inside the second chamber 22.

The first controller 300 controlling the spot cleaning device 100 may include the first controller 300 transmitting a control command to the second controller 180.

The second communicator 190 may communicate with the first communicator 330 of the clothes care apparatus 1 to forward the control command sent from the first controller 300 to the second controller 180.

The second controller 180 may control the components of the spot cleaning device 100 based on the control command forwarded from the first controller 300.

The moving device 200 may move the spot cleaning device 100.

In various embodiments, the moving device 200 may include a third controller (not shown) for controlling the first to fourth motors and a wired or wireless third communicator (not shown). The third controller of the moving device 200 may receive a control command from the second controller 180 through the third communicator. That is, the second controller 180 may control the moving device 200. In another example, the motor of the moving device 200 may be connected to the controller 180 of the spot cleaning device 100 by a cable and controlled directly.

For example, when the first controller 300 sends a movement control signal to the spot cleaning device 100, the second controller 180 of the spot cleaning device 100 may control the moving device 200 to move the spot cleaning device 100.

In various embodiments, the moving device 200 may receive a control command from the first controller 300. That is, the first controller 300 may control the moving device 200. For example, the first controller 300 may control the spot cleaning device 100 to move the spot cleaning device 100.

In the disclosure, the controlling of the spot cleaning device 100 may include not only controlling the components of the spot cleaning device 100 (e.g., the first water supply pump 140, the first drain pump 150, the driving motor 160, the vibrator 103 and/or the at least one sensor 108) but also controlling the moving device 200 to control the motion of the spot cleaning device 100.

In the disclosure, what controls the spot cleaning device 100 may be the first controller 300 and/or the second controller 180.

The controller 180 or 300 may control the moving device 200 to move the spot cleaning device 100 to the home position part 25 based on a certain condition being satisfied.

For example, the controller 180 or 300 may control the moving device 200 to move the spot cleaning device 100 to the home position part 25 based on a garment treatment process for a target portion of the garment accommodated in the second chamber 22 being completed by the spot cleaning device 100.

The controller 180 or 300 may operate the second water supply pump 35 and/or the second drain pump 36 based on the spot cleaning device 100 being coupled to the home position part 25 after completing the movement into the home position part 25.

In the disclosure, as the spot cleaning device 100 is automatically moved into the home position part 25 after completing the garment treatment process, water replenishment for the spot cleaning device 100 may be performed by moving the water in the door water supply tub 34 into the water supply tub 121 and contaminated water stored in the spot cleaning device 100 may be discharged by moving the water in the drain tub 122 into the door drain tub 33.

Furthermore, in the disclosure, as the spot cleaning device 100 is automatically moved into the home position part 25 after completing the garment treatment process, the battery **118*b*** may be recharged.

In an embodiment, the spot cleaning device 100 may include at least one sensor 108. Sensor data collected from the at least one sensor 108 may be sent to the first controller 300. For example, the sensor 108 of the spot cleaning device 100 may include a camera, and image data collected by the camera may be sent to the controller 300 or 180.

In another example, the spot cleaning device 100 may include a photo sensor, which may collect light intensity data by irradiating light to the garment (hereinafter, target garment) accommodated in the second chamber 22 and receiving the reflected light and send the light intensity data collected from the photo sensor to the controller 300 or 180.

The controller 300 or 180 may determine a target portion of the target garment based on the data collected from the sensor 108 being processed. For example, the controller 300 or 180 may identify a contaminated portion of the target garment based on receiving and processing image data for the target garment. The controller 300 or 180 may determine the contaminated portion of the target garment as the target portion, and control the spot cleaning device 100 to do the wash on the target portion.

In another example, the controller 300 or 180 may identify the contaminated portion of the target garment based on receiving and processing light intensity data. The controller 300 or 180 may determine the contaminated portion of the target garment as the target portion, and control the spot cleaning device 100 to do the wash on the target portion.

The controller 300 or 180 may identify a material of the target garment based on processing of data collected from the sensor 108.

The controller 300 or 180 may identify the material of the garment by using data (e.g., image data and/or light intensity data) collected by the at least one sensor 108 as input data to an artificial intelligence (AI) model trained to determine the material of the garment.

The AI model trained to determine the material of the clothes may be stored in the clothes care apparatus 1, the spot cleaning device 100 and/or an external device.

In a case that the AI model trained to determine the material of the garment is stored in the external device, the controller 300 or 180 may control the communicator 190 or 330 to transmit the data (e.g., image data and/or light intensity data) collected by the at least one sensor 108 to the external device. The external device may identify the material of the garment by inputting the data collected by the at least one sensor 108 and accommodated from the spot cleaning device 100 to the AI model trained to determine the material, and then send data about the material of the garment to the clothes care apparatus 1 and/or the spot cleaning device 100.

In an embodiment, the sensor for detecting the material of the target garment may include a short-range communication reader (e.g., a radio frequency identification (RFID) reader). The short-range communication reader may obtain material information of the garment from a short-range communication tag attached to the target garment.

In an embodiment, the sensor for detecting the material of the target garment may be the input interface 70*a*.

The user may select the material of the target garment through the input interface 70*a*.

The first controller 300 may control various components (e.g., the display 70*b*-1 or 30*c*, the control panel 70, the heat exchange device 45, the first fan 42, the steam generating device 40, the second fan 75, the actuator 76, the spot cleaning device 100, the moving device 200, and the first communicator 330) of the clothes care apparatus 1. The first controller 300 may control various components of the clothes care apparatus 1 to perform a garment are course or a partial care course according to a user input. For example, the first controller 300 may control the heat exchange device 45 and the first fan 42 to supply hot air into the first chamber 11, control the steam generating device 40 to supply steam into the first chamber 11, control the second fan 75 to circulate the air in the first chamber 11, or do the partial wash on the garment accommodated in the second chamber 22.

In another example, the first controller 300 may control the actuator 76 to open the second door 30.

The first controller 300 may process the data collected from various components (e.g., the control panel 70, the display 70*b*-1 or 30*c*, the first communicator 330 and the spot cleaning device 100) of the clothes care apparatus 1. The first controller 300 may process a user input entered through the control panel 70 and/or the display 70*b*-1 or 30*c* and perform an operation corresponding to the user input.

In another example, the first controller 300 may control the actuator 76 to open the second door 30 based on the second door 30 open button 70*a*-8 being selected.

The first controller 300 may process image data collected from the at least one sensor 108 of the spot cleaning device 100.

The first controller 300 may include hardware such as a control processing unit (CPU), a micom or a memory, and software such as a control program. For example, the first controller 300 may include at least one memory 320 that stores data in the form of an algorithm or a program for controlling operations of the components in the clothes care apparatus 1, and at least one processor 310 for performing the aforementioned and following operations with the use of the data stored in the at least one memory 320. The memory 320 and the processor 310 may be implemented in separate chips. The processor 310 may include one, two or more processor chips or one, two or more processing cores. The memory 320 may include one, two or more memory chips or one, two or more memory blocks. Alternatively, the memory 320 and the processor 310 may be implemented in a single chip.

The at least one memory 320 may store algorithms for the garment care course, the partial care course and target portion settings.

The first controller 300 may be mounted on e.g., a printed circuit board provided on the rear side of the control panel 70, but the position of the first controller 300 is not limited thereto.

The first controller 300 may be electrically connected to the display 70*b*-1 or 30*c*, the control panel 70, the heat exchange device 45, the first fan 42, the steam generating device 40, the second fan 75, the actuator 76, the spot cleaning device 100, the moving device 200, and/or the first communicator 330.

The components shown in FIG. 23 are merely an example of the components of the clothes care apparatus 1 according to an embodiment, and the clothes care apparatus 1 may further include some other components than the components shown in FIG. 23 or may not include some of the components shown in FIG. 23.

For example, the clothes care apparatus 1 may include an actuator for automatically opening the first door 20, a first door open/close sensor for detecting opening or closing of the first door 20, a second door open/close sensor for detecting opening or closing of the second door 30, a proximity sensor for detecting approaching of an object to a certain location around the clothes care apparatus 1, etc.

Hereinafter, the first controller 300 and/or the second controller 180 is referred to as the controller 300, and the first communicator 330 and/or the second communicator 190 is referred to as the communicator 330 for convenience of explanation.

Figure 25:
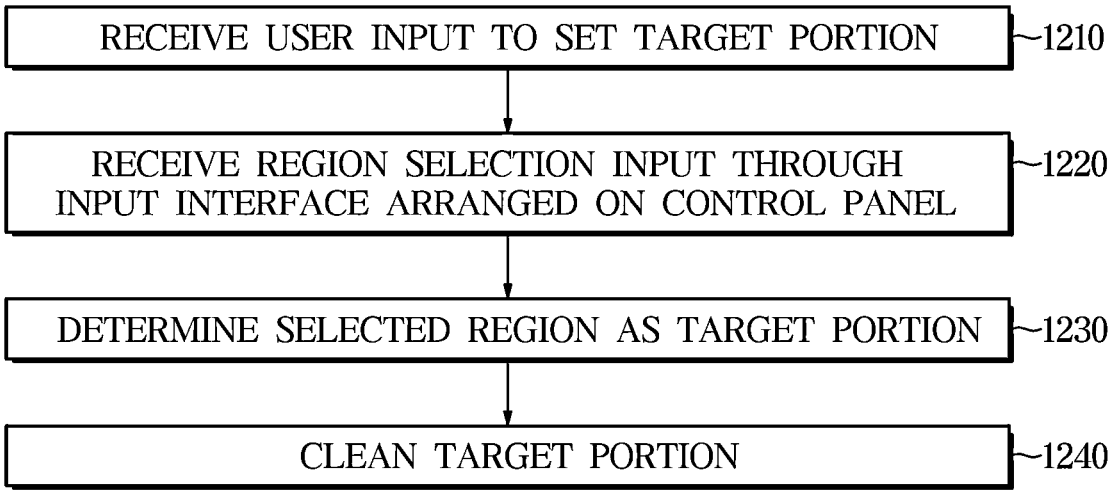
FIG. 25 is a flowchart illustrating an example of a method in which a clothes care apparatus determines a target portion, according to an embodiment.

FIG. 25 is a flowchart illustrating an example of a method in which a clothes care apparatus determines a target portion, according to an embodiment.

Referring to FIG. 25, the clothes care apparatus 1 may receive a user input to set a target portion, in 1210. The clothes care apparatus 1 may receive the user input to set a target portion through various methods.

In an embodiment, the clothes care apparatus 1 may determine a target portion based on the user input received through the input interface 70*a* of the control panel 70.

In an embodiment, the controller 300 may receive an input to select at least one of a plurality of regions through the control panel 70, in 1220.

The controller 300 may determine the at least one region selected through the control panel 70 from among the plurality of regions as the target portion, in 1230. The controller 300 may start an operation to clean the target portion, in 1240.

Figure 26:
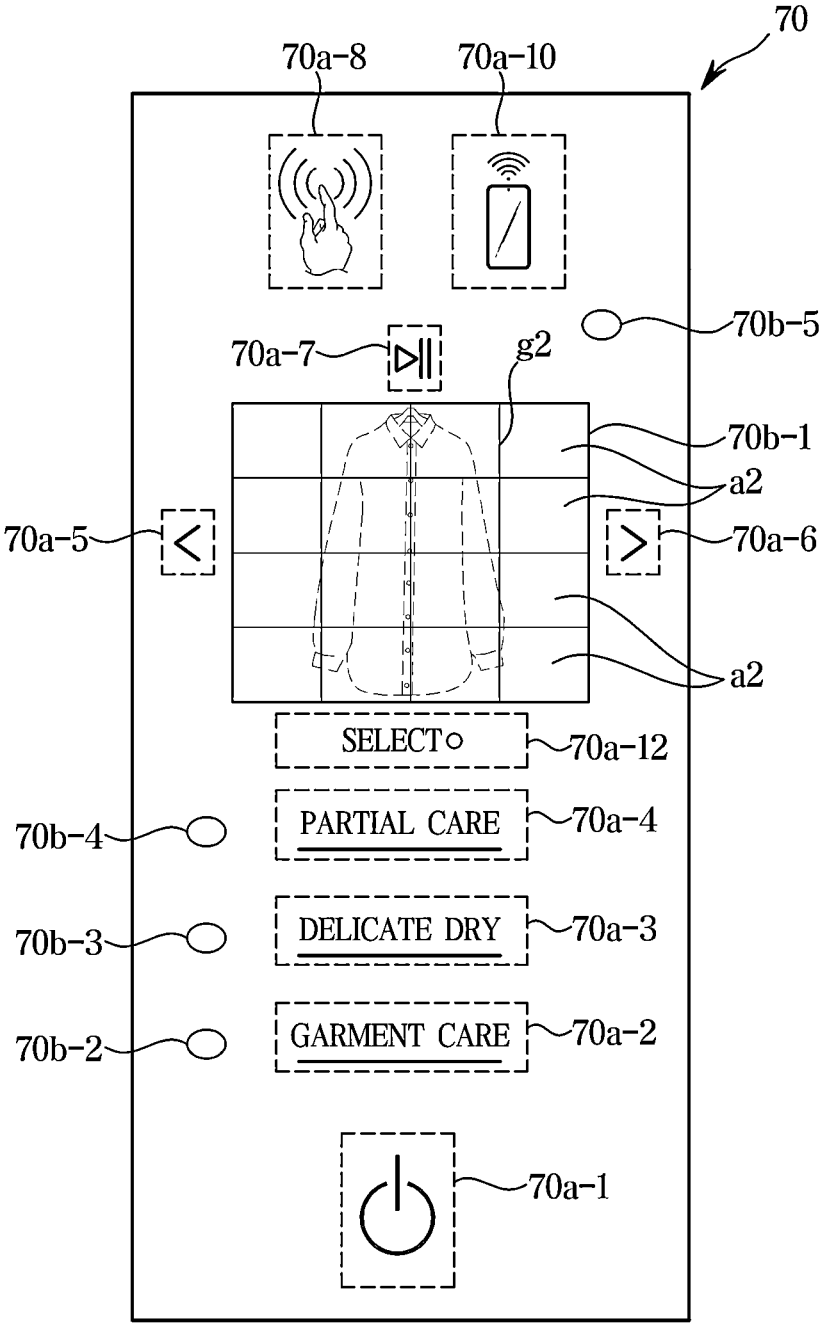
FIG. 26 illustrates an example of an interface for setting a target portion, which is provided by a control panel, according to an embodiment.

FIG. 26 illustrates an example of an interface for setting a target portion, which is provided by the control panel 70, according to an embodiment.

Referring to FIG. 26, the controller 300 may control the output interface 70*b* to provide an interface for receiving a selection of at least one of the plurality of regions separated from one another based on reception of the user input for setting the target portion.

For example, the controller 300 may control the display 70*b*-1 or 30*c* to provide the interface for receiving the selection of at least one of a plurality of regions a2 separated from one another based on selection of the partial care button 70*a*-4.

In an embodiment, the interface for receiving the selection of at least one of the plurality of regions a2 separated from one another may include a pre-stored garment image and a visual indicator g2 that partitions the pre-stored garment image into the plurality of regions a2.

In an embodiment, the controller 300 may control the display 70*b*-1 or 30*c* to provide an interface for determining the type of the garment (e.g., short sleeves, long sleeves, pants, etc.) based on selection of the partial care button 70*a*-4, and control the display 70*b*-1 or 30*c* to output a pre-stored garment image corresponding to the type of the garment and the visual indicator g2 that partitions the pre-stored garment image into the plurality of regions a2 based on selection of the type of the garment.

The visual indicator g2 may include grids, but the form of the visual indicator g2 that partitions the pre-stored garment image displayed on the display 70*b*-1 or 30*c* into the plurality of regions a2 is not limited thereto.

The user may select at least one of the plurality of regions a2 through the control panel 70. For example, the user may select at least one of the plurality of regions a2 through the direction selection button 70*a*-5 or 70*a*-6 and the selection button 70*a*-12, or select at least one of the plurality of regions a2 through a touch input on the display 70*b*-1 or 30*c*.

The controller 300 may control the display 70*b*-1 or 30*c* to output a visual indication to distinguish the at least one region selected through the control panel 70 from among the plurality of regions a2 from the non-selected regions.

The controller 300 may determine the at least one region selected through the control panel 70 from among the plurality of regions a2 as a target portion.

In an embodiment of the disclosure, even when the user is unable to see the garment accommodated in the second chamber 22, the user may identify a contaminated portion of the clothes in advance and easily set a target portion by selecting at least one region corresponding to the contaminated portion.

Figure 27:
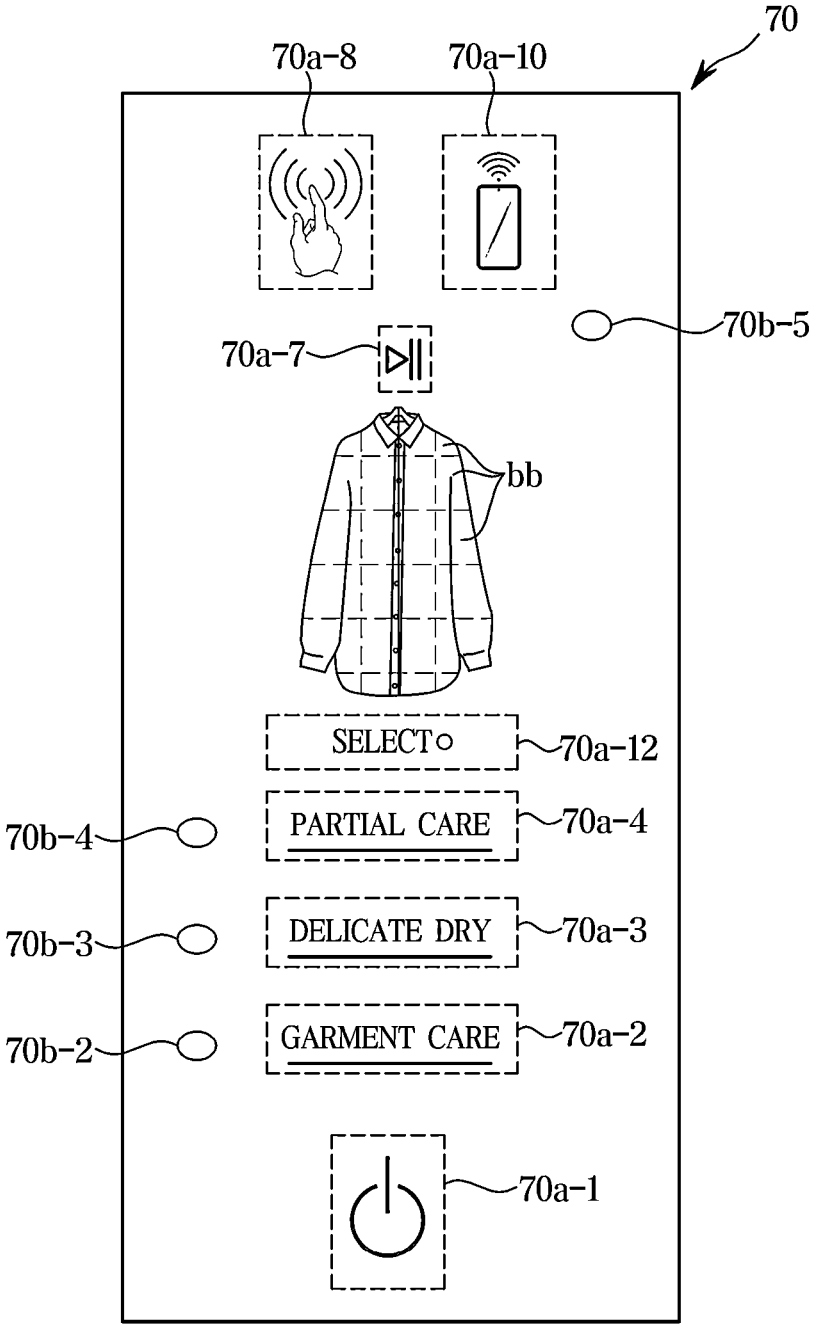
FIG. 27 illustrates an example of buttons for setting a target portion, which are arranged on a control panel, according to an embodiment.

FIG. 27 illustrates an example of buttons for setting a target portion, which are arranged on the control panel 70, according to an embodiment.

In an embodiment, the control panel 70 may include a plurality of buttons bb for receiving a selection of at least one of the plurality of regions a2 separated from one another.

In an embodiment, the plurality of buttons bb may form a garment shape. For example, the plurality of buttons bb may form a half-sleeve shape, a long-sleeve shape, a pants shape and/or a Y-shirt shape.

The plurality of buttons bb may correspond to the plurality of regions a2. In other words, the plurality of buttons bb may correspond to the plurality of regions a2, respectively.

The user may select at least one of the plurality of regions a2 separated from one another by selecting a button bb corresponding to a desired portion to be cleaned from among the plurality of buttons bb.

Each of the plurality of buttons bb may refer to a physical button. Each of the plurality of buttons bb may be turned on in response to being selected, and turned off in response to a release from the selection. In another example, the plurality of buttons bb may be provided on the touch panel, and the button regions may be turned on or off.

The controller 300 may determine the at least one region selected through the control panel 70 from among the plurality of regions a2 as a target portion. In other words, the controller 300 may determine a region corresponding to the button selected from among the plurality of buttons bb as a target portion.

In an embodiment of the disclosure, even when the user is unable to see the garment accommodated in the second chamber 22, the user may figure out a contaminated portion of the garment in advance and easily set a target portion by selecting at least one button bb corresponding to the contaminated portion.

In the disclosure, the user may set a target portion through the control panel 70 of the clothes care apparatus 1.

Figure 28:
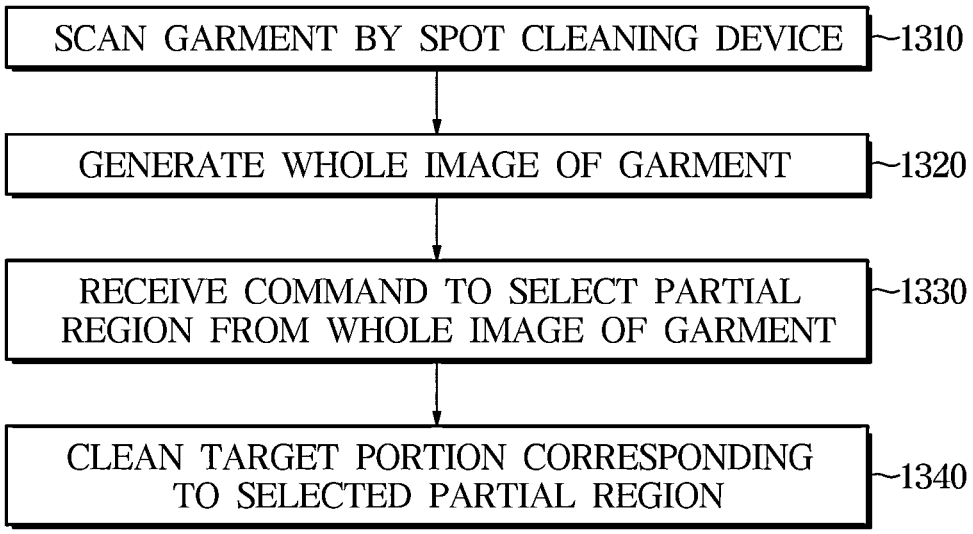
FIG. 28 is a flowchart illustrating another example of a method in which a clothes care apparatus determines a target portion, according to an embodiment.

FIG. 28 is a flowchart illustrating another example of a method in which the clothes care apparatus 1 determines a target portion, according to an embodiment.

Referring to FIG. 28, the controller 300 may transmit a garment scan command to the spot cleaning device 100 based on a certain condition being satisfied, in 1310. The spot cleaning device 100 may move down the second chamber 22 to obtain the whole image of the garment accommodated in the second chamber 22 based on reception of the garment scan command from the controller 300.

In other words, based on the certain condition being satisfied, the controller 300 may control the spot cleaning device 100 to move down the second chamber 22 to obtain the whole image of the garment accommodated in the second chamber 22.

The certain condition may include at least one of opening or closing being detected, a new garment being detected based on an image obtained by the camera of the spot cleaning device 100, garment replacement being detected based on the image obtained by the camera of the spot cleaning device 100 or the garment scan command being received.

For example, the controller 300 may control the spot cleaning device 100 to obtain the whole image of the garment accommodated in the second chamber 22 based on reception of the garment scan command through a user interface provided by the control panel 70 and/or the display 70*b*-1 or 30*c*.

In another example, the controller 300 may control the spot cleaning device 100 to obtain the whole image of the garment accommodated in the second chamber 22 based on reception of the garment scan command through the communicator 330.

In another example, the controller 300 may control the spot cleaning device 100 to obtain the whole image of the garment accommodated in the second chamber 22 based on reception of a user input to set a target portion.

In another example, the controller 300 may control the spot cleaning device 100 to obtain the whole image of the garment accommodated in the second chamber 22 based on detection of opening or closing of the second door 30.

In another example, the controller 300 may control the spot cleaning device 100 to obtain the whole image of the garment accommodated in the second chamber 22 based on detection of a new garment or detection of garment replacement based on an image obtained by the camera of the spot cleaning device 100.

Figure 29:
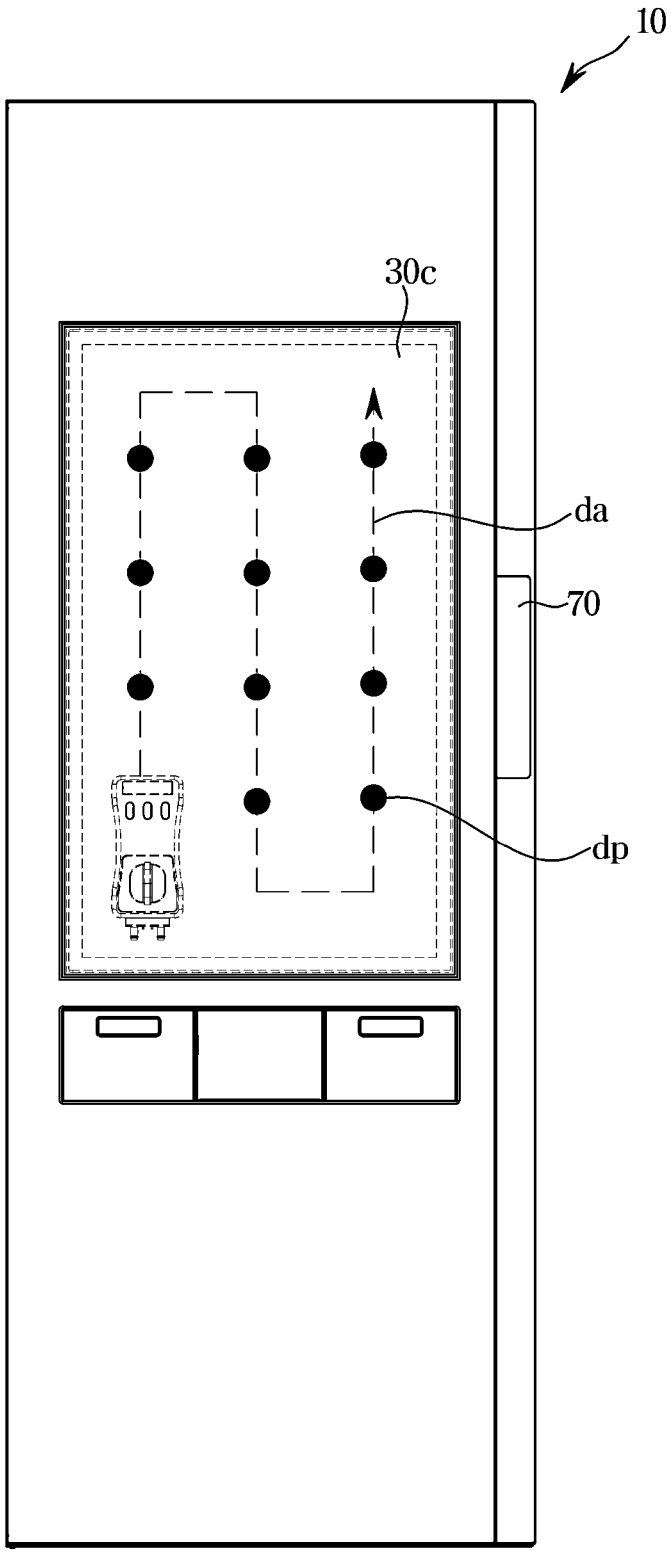
FIG. 29 illustrates a spot cleaning device scanning a garment accommodated in a second chamber, according to an embodiment.
Figure 30:
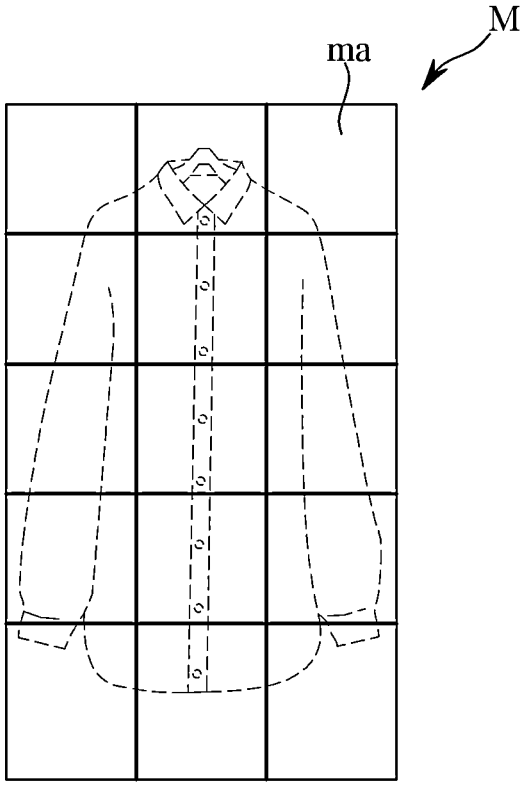
FIG. 30 illustrates an example of a whole image of a garment obtained by a spot cleaning device, according to an embodiment.

FIG. 29 illustrates the spot cleaning device 100 scanning a garment accommodated in the second chamber 22, according to an embodiment. FIG. 30 illustrates an example of a whole image of a garment obtained by the spot cleaning device 100, according to an embodiment.

Referring to FIGS. 29 and 30, the spot cleaning device 100 may obtain a partial image ma of a garment accommodated in the second chamber 22 at each of a plurality of positions while moving down the second chamber based on reception of a garment scan command from the controller 300.

For example, the spot cleaning device 100 may obtain the partial image ma of the garment accommodated in the second chamber 22 at each of a plurality of predetermined positions dp while moving down the second chamber along a predetermined path da based on reception of the garment scan command from the controller 300. For example, the partial image ma may be obtained by a camera (image sensor), which is the sensor 108, arranged in the spot cleaning device 100.

The spot cleaning device 100 may send the plurality of partial images ma obtained at the plurality of predetermined positions dp to the controller 300.

The clothes care apparatus 1 may generate a whole image M of the garment by combining the plurality of partial images ma obtained from the plurality of positions dp, in 1320.

In an embodiment, the controller 300 may generate the whole image M of the garment by combining the plurality of partial images ma.

In an embodiment, the controller 300 may identify a contaminated portion from the whole image M of the garment. For this, the memory 320 may store an algorithm for identifying a contaminated portion from the whole garment image. For example, the controller 300 may identify a contaminated portion by inputting the whole image M of the garment to a machine learning model.

In various embodiments, the second controller 180 of the spot cleaning device 100 may combine the plurality of partial images ma to generate the whole image M of the garment.

The clothes care apparatus 1 may receive a command to select a partial region from the whole image M of the garment, in 1330.

The command to select a partial region from the whole image M of the garment may be received from the control panel 70, a user interface provided by the display **70*b*-1 or 30*c* and/or an external device through the communicator 330**.

The clothes care apparatus 1 needs to show the user the whole image M of the garment to receive the command to select a partial region from the whole image M of the garment.

Based on reception of the command to select a partial region from the whole image M of the garment, the clothes care apparatus 1 may determine the selected partial region as a target portion and the spot cleaning device 100 may clean the target portion, in 1340.

Figure 31:
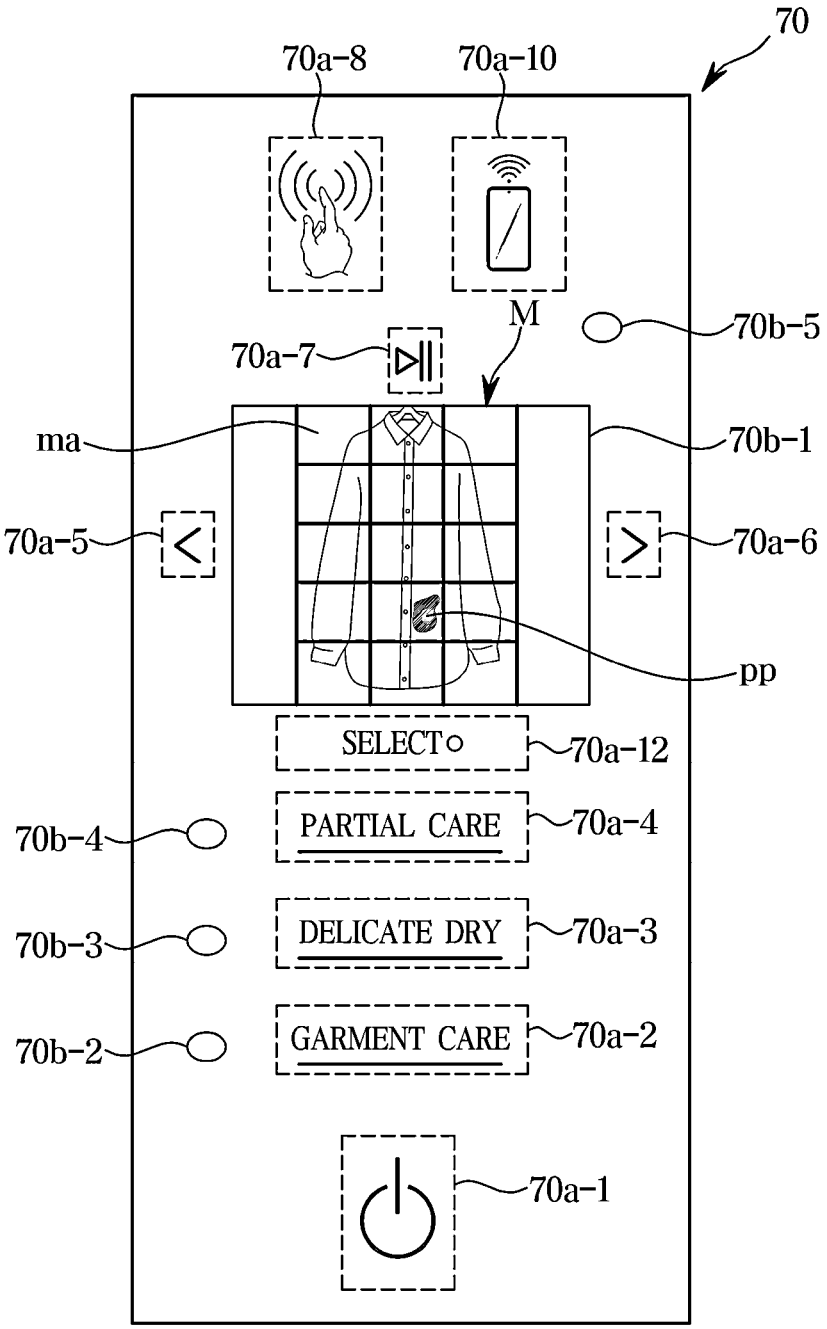
FIG. 31 illustrates an example in which a whole image of a garment is displayed on a control panel, according to an embodiment.

FIG. 31 illustrates an example in which a whole image of a garment is displayed on the control panel 70, according to an embodiment.

Referring to FIG. 31, in an embodiment, the controller 300 may control the display **70*b*-1 or 30*c* on the control panel 70** to display the whole image of the garment based on reception of the user input to set a target portion.

The whole image of the garment may be displayed on the display **70*b*-1 or 30*c* on the control panel 70**.

The controller 300 may control the display **70*b*-1 or 30*c*** to display a visual indicator pp to highlight the contaminated portion identified from the whole image M of the garment while displaying the whole image M of the garment.

In the disclosure, the user may easily set the target portion by referring to the contaminated portion identified by the clothes care apparatus 1 from the whole image M of the garment.

The whole image M of the garment displayed on the display **70*b*-1 or 30*c*** may be scaled up or down based on a user input to scale up or down the whole image M of the garment.

The user input to scale up or down the whole image M of the garment may include, for example, a pinch zoom touch input on the display **70*b*-1 or 30*c***.

The controller 300 may control the display **70*b*-1 or 30*c*** to scale up or down the whole image M of the garment based on reception of the user input to scale up or down the whole image M of the garment.

In the disclosure, the user may easily locate a contaminated portion of the garment while scaling up or down the garment.

The controller 300 may determine a target portion based on the selection of a partial region from among the whole image M of the garment displayed on the display **70*b*-1 or 30*c***.

The controller 300 may control the spot cleaning device 100 to clean the target portion based on the determination of the target portion.

The receiving of the selection of the partial region from among the whole image M of the garment displayed on the display **70*b*-1 or 30*c* may include receiving a touch input on the display 70*b*-1 or 30*c* and/or using the direction selection button 70*a*-5 or 70*a*-6 and the selection button 70*a*-12 on the control panel 70**.

In various embodiments, as in the embodiment of FIG. 31, the whole image M of the garment displayed on the display **70*b*-1 or 30*c*** may be partitioned into a plurality of regions by the visual indicator.

Figure 32:
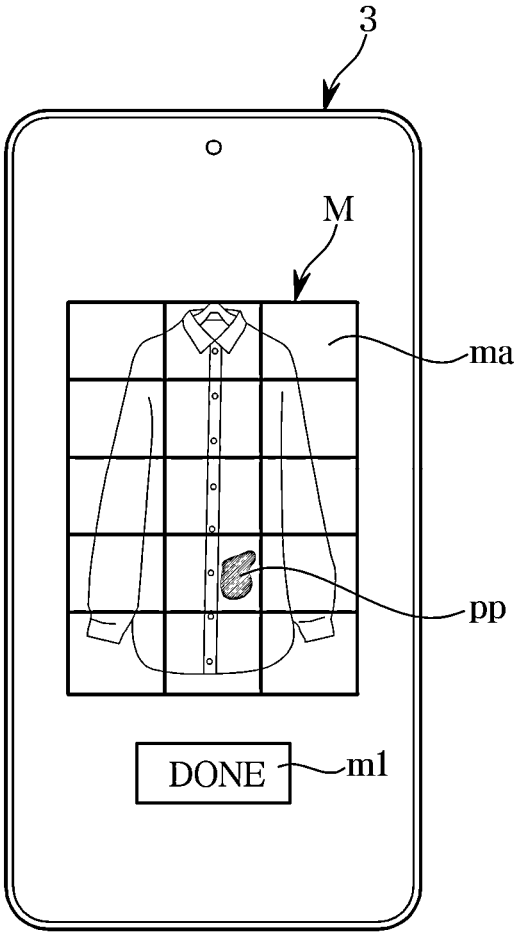
FIG. 32 illustrates a whole image of a garment obtained by a clothes care apparatus and transmitted to a user equipment, according to an embodiment.

FIG. 32 illustrates a whole image of a garment obtained by the clothes care apparatus 1 and transmitted to a user equipment, according to an embodiment.

Referring to FIG. 32, the controller 300 may transmit the whole image M of the garment to an external device (e.g., the user equipment 3) through the communicator 330.

For example, the controller 300 may transmit the whole image M of the garment to the external device in response to reception of a command for target settings from the external device through the communicator 330.

In another example, the controller 300 may transmit the whole image M of the garment to the external device (e.g., user equipment) based on creation of the whole image M of the garment.

The user equipment may store an application for managing a home appliance.

The user may run the application for managing the home appliance through the user equipment 3, make access to an account of the user and transmit various control commands to the home appliance associated with the account or receive various information from the home appliance associated with the account.

When the clothes care apparatus 1 is associated with the account of the user, the user may transmit a command to control the clothes care apparatus 1 through the user equipment 3.

When the clothes care apparatus 1 is associated with the account of the user, the clothes care apparatus 1 may transmit the whole image M of the garment to the user equipment 3.

The user equipment 3 may display the whole image M of the garment received from the clothes care apparatus 1 according to the user's manipulation.

The user equipment 3 may display the visual indicator pp to highlight the contaminated portion identified from the whole image M of the garment while displaying the whole image M of the garment.

The whole image M of the garment displayed by the user equipment 3 may be partitioned into a plurality of regions by the visual indicator.

A method of receiving the selection of a partial region from among the whole image M of the garment displayed on the user equipment 3 may include receiving a touch input on the user equipment 3.

The user may select a confirm button m1 after finishing selection of a partial region from among the whole image M of the garment by manipulating the user equipment 3.

The user equipment 3 may transmit a spot cleaning command to the clothes care apparatus 1 based on reception of the selection of the partial region from among the whole image M of the garment and selection of the confirm button m1.

The spot cleaning command may include a command to select a partial region from the whole image M of the garment.

The controller 300 may determine a region corresponding to the partial region selected by the user equipment 3 from the whole image M of the garment as a target portion.

The controller 300 may control the spot cleaning device 100 to clean the target portion based on the determination of the target portion.

In the disclosure, the user may set the target portion even remotely.

In the disclosure, the target portion may be set through various methods and means.

Figure 33:
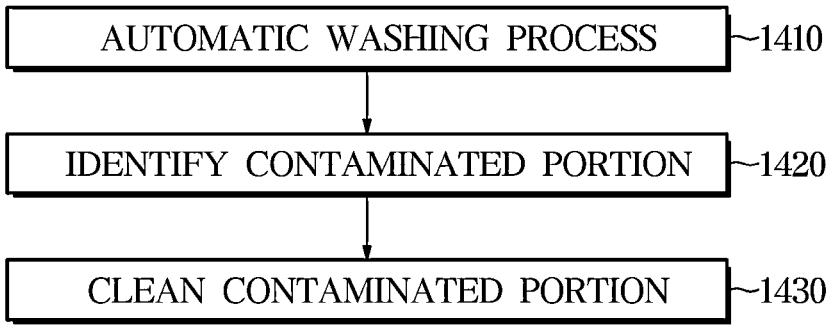
FIG. 33 is a flowchart for describing a method in which a clothes care apparatus automatically sets a target portion, according to an embodiment.

FIG. 33 is a flowchart for describing a method in which the clothes care apparatus 1 automatically sets a target portion, according to an embodiment.

Referring to FIG. 33, the clothes care apparatus 1 may automatically set a target portion.

The controller 300 may receive a user input to start an automatic washing process, in 1410. The user input to start the automatic washing process may be sent to the controller 300 in various methods.

For example, when the partial care button 70*a*-4 is selected, an interface for selecting an automatic washing mode may be provided on the display 70*b*-1 or 30*c*, and the controller 300 may perform the automatic washing process based on selection of the start button 70*a*-7 during the automatic washing mode selected.

In another example, based on selection of the automatic washing button on the user interface provided on the display 70*b*-1 or 30*c*, the controller 300 may perform the automatic washing process.

The automatic washing process may refer to a process of automatically identifying the contaminated portion on the garment accommodated in the second chamber 22 based on sensor data collected from the at least one sensor 108 of the spot cleaning device 100 and cleaning the contaminated portion by the spot cleaning device 100.

In various embodiments, the controller 300 may control the spot cleaning device 100 to move down the second chamber 22 along a certain path based on the start of the automatic washing process.

In an embodiment, the controller 300 may identify the contaminated portion of the garment accommodated in the second chamber 22 based on the sensor data collected from the sensor 108 while the spot cleaning device 100 is moving, in 1420.

The controller 300 may identify the contaminated portion of the garment based on the sensor data collected from the sensor 108. For this, the memory 320 may store an algorithm for identifying a contaminated portion based on the sensor data. For example, the controller 300 may identify a contaminated portion by inputting the sensor data to a machine learning model.

When the sensor 108 is a camera, the controller 300 may identify a contaminated portion of the garment based on image data. When the sensor 108 is a photo sensor, the controller 300 may identify a contaminated portion of the garment based on light intensity data.

In various embodiments, when the second controller 180 of the spot cleaning device 100 is able to identify the contaminated portion of the garment based on the sensor data collected from the sensor 108, the aforementioned operation and the following operation may be performed by the second controller 180.

In an embodiment, the controller 300 may control the spot cleaning device 100 to clean the contaminated portion, in 1430.

In various embodiments, the controller 300 may control the spot cleaning device 100 to clean the contaminated portion in response to the contaminated portion being identified while the spot cleaning device 100 is moving down the second chamber 22 along the certain path.

In an embodiment, the spot cleaning device 100 may clean the contaminated portion in real time while moving down the second chamber 22.

In various embodiments, the controller 300 may control the spot cleaning device 100 to store coordinate data of the contaminated portion while moving down the chamber 22 along the certain path and clean the contaminated portion in response to the spot cleaning device 100 being done with garment scanning.

In an embodiment, as the contaminated portion of the garment accommodated in the second chamber 22 is correctly identified and then cleaned, the time required to finish the automatic washing process may be relatively precisely calculated.

In various embodiments, the clothes care apparatus 1 may include a plurality of spot cleaning devices 100. In other words, the spot cleaning device 100 may be provided in the plural.

Figure 34:
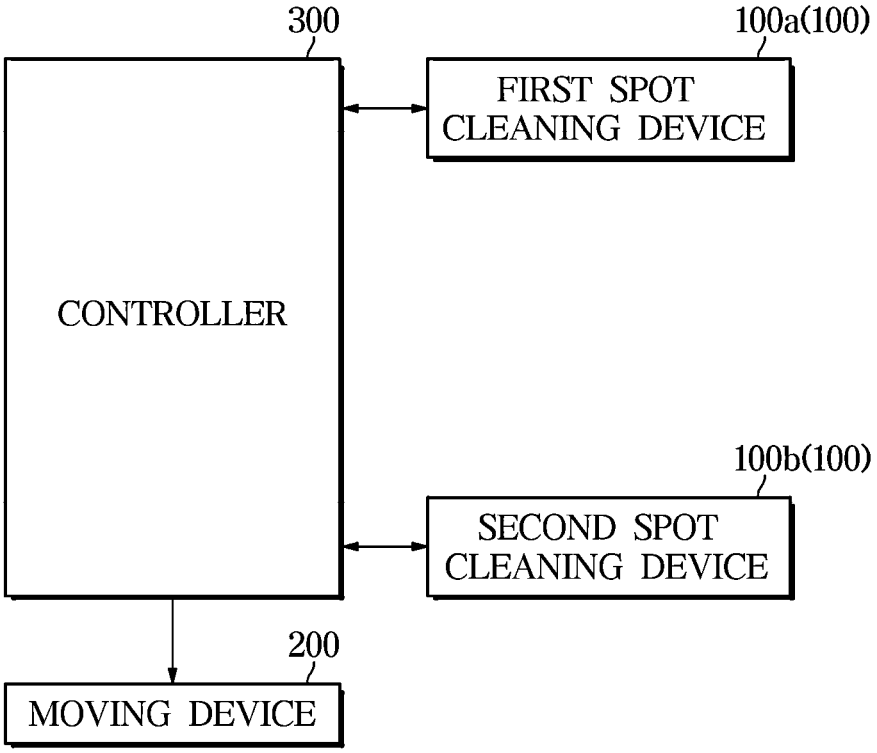
FIG. 34 illustrates an example of a control block diagram of a clothes care apparatus including a first spot cleaning device and a second spot cleaning device, according to an embodiment.

FIG. 34 illustrates an example of a control block diagram of a clothes care apparatus including a first spot cleaning device and a second spot cleaning device, according to an embodiment.

Referring to FIG. 34, the clothes care apparatus 1 may include a first spot cleaning device 100*a*, a second spot cleaning device 100*b*, the moving device 200 and/or the controller 300.

The clothes care apparatus 1 may further include the components as shown in FIG. 23 in addition to the components shown in FIG. 34.

In an embodiment, the first spot cleaning device 100*a* and the second spot cleaning device 100*b* may each include the second controller 180, the second communicator 190 and/or the at least one sensor 108, which are described above.

In an embodiment, the first spot cleaning device 100*a* and the second spot cleaning device 100*b* may each include at least one of the components such as the first water supply pump 140, the first drain pump 150 and/or the driving motor 160, which are described above. In various embodiments, the first spot cleaning device 100*a* and the second spot cleaning device 100*b* may further include other components in addition to the aforementioned components.

For example, one of the first spot cleaning device 100*a* and the second spot cleaning device 100*b* may further include a heating module. Similar to an electric iron, the heating module may include a flat iron plate and an electric heating element (e.g., heater) for heating the iron plate.

The moving device 200 may move the first spot cleaning device 100*a* and the second spot cleaning device 100*b*.

In an embodiment, as shown in FIG. 19, the moving device 200 may include the second motor 220 and the fourth motor 240 that provide driving force for the first spot cleaning device 100*a* and the second spot cleaning device 100*b* to move in the second direction.

The first spot cleaning device 100*a* and the second spot cleaning device 100*b* may move together in the second direction along with the movement of the frame 250 due to the driving force provided by the second motor 220 and the fourth motor 240. In an embodiment, the first spot cleaning device 100*a* and the second spot cleaning device 100*b* may move dependently on each other in the second direction.

In the meantime, unlike what is shown in FIG. 19, the moving device 200 may include at least one first motor for providing driving force to move the first spot cleaning device 100*a* in the first direction, at least one first shaft coupled to the first spot cleaning device 100*a* and receiving the driving force from the at least one first motor, at least one second motor for providing driving force to move the second spot cleaning device 100*b* in the first direction, and at least one second shaft coupled to the second spot cleaning device 100*b* and receiving the driving force from the at least one second motor.

The first spot cleaning device 100*a* may move in the first direction with the operation of the at least one first motor, and the second spot cleaning device 100*b* may move in the first direction with the operation of the at least one second motor. In an embodiment, the first spot cleaning device 100*a* and the second spot cleaning device 100*b* may move independently from each other in the first direction.

In various embodiments, it is obvious to employ a structure where the first spot cleaning device 100*a* and the second spot cleaning device 100*b* are able to independently move in the first direction and the second direction.

The controller 300 may control operation of the first spot cleaning device 100*a* and the second spot cleaning device 100*b*.

The controlling of operation of the first spot cleaning device 100*a* and the second spot cleaning device 100*b* may include controlling the moving device 200 to control movement of the first spot cleaning device 100*a* and the second spot cleaning device 100*b*.

The controlling of operation of the first spot cleaning device 100*a* and the second spot cleaning device 100*b* may include controlling the components (e.g., the first water supply pump 140, the first drain pump 150, the driving motor 160, the vibrator 103, the roller 105 and/or the heating module) of each of the first spot cleaning device 100*a* and the second spot cleaning device 100*b*.

Figure 35:
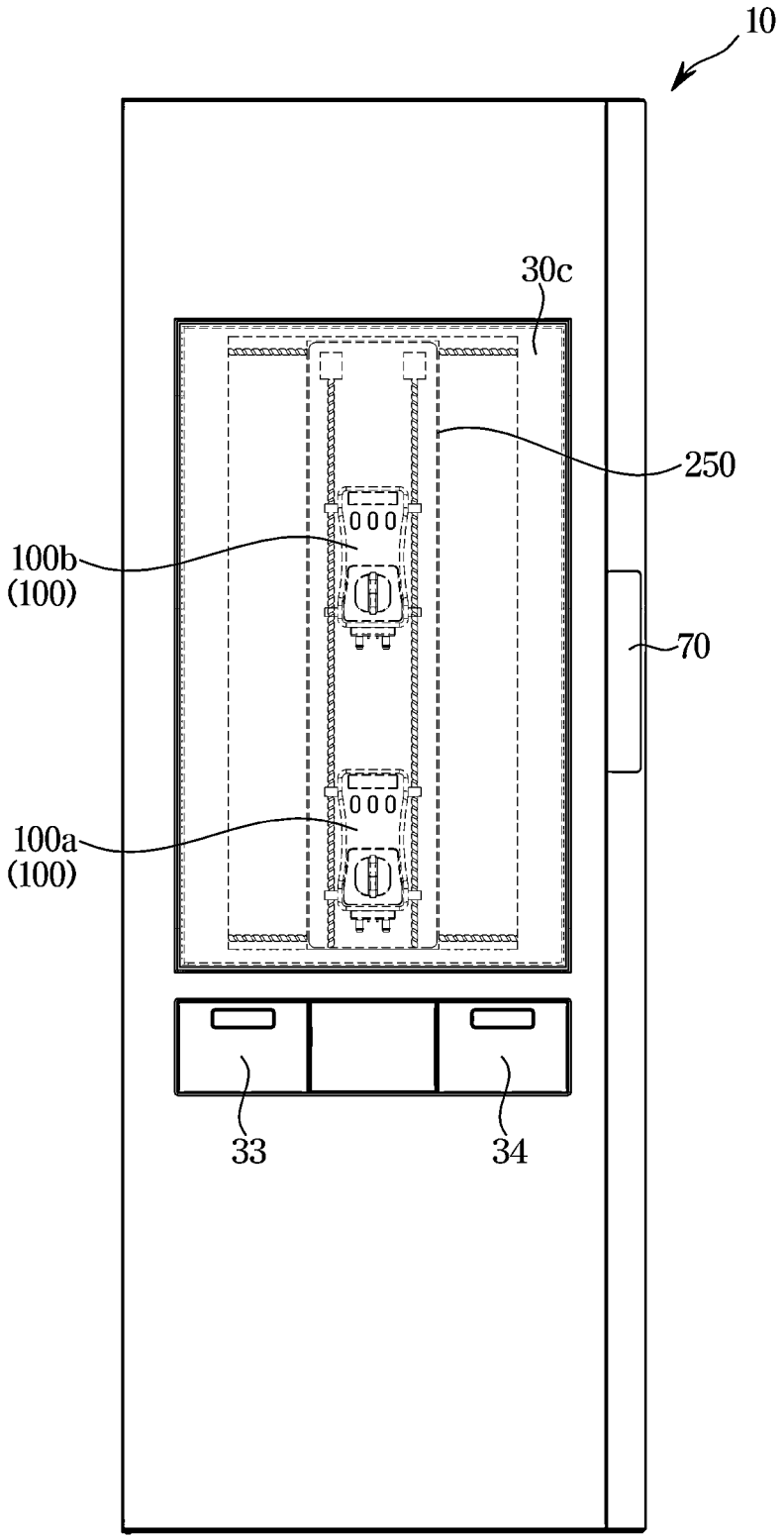
FIG. 35 is a front view of a clothes care apparatus including a first spot cleaning device and a second spot cleaning device, according to an embodiment.

FIG. 35 is a front view of a clothes care apparatus including a first spot cleaning device and a second spot cleaning device, according to an embodiment.

Referring to FIG. 35, the first spot cleaning device 100*a* and the second spot cleaning device 100*b* may be supported by the frame 250 extending in the first direction.

The first spot cleaning device 100*a* and the second spot cleaning device 100*b* are able to move dependently on each other in the second direction and move independently from each other in the first direction, along with the movement of the frame 250 in the second direction.

With the movement of the frame 250 in the second direction (e.g., horizontal direction), the first spot cleaning device 100*a* and the second spot cleaning device 100*b* may also move in the second direction.

The first spot cleaning device 100*a* may move in the first direction by the at least one first motor that provides driving force to move the first spot cleaning device 100*a* in the first direction (e.g., vertical direction).

The second spot cleaning device 100*b* may move in the first direction by the at least one second motor that provides driving force to move the second spot cleaning device 100*b* in the first direction (e.g., vertical direction).

As described above, in various embodiments, it is obvious to employ a structure where the first spot cleaning device 100*a* and the second spot cleaning device 100*b* are able to independently move in the first direction and the second direction.

The first spot cleaning device 100*a* and the second spot cleaning device 100*b* may simultaneously proceed a garment treatment process for the garment accommodated in the second chamber 22 or sequentially proceed a garment treatment process for the target portion of the garment accommodated in the second chamber 22.

Although the second spot cleaning device 100*b* is shown as being arranged above the first spot cleaning device 100*a* in FIG. 35, it is possible that the first spot cleaning device 100*a* is arranged above the second spot cleaning device 100*b*.

As the home position part 25 connectable to the water supply tub 34 and the drain tub 33 of the clothes care apparatus 1 is arranged on a lower side of the second chamber 22, in an embodiment, the second spot cleaning device 100*b* may be configured to perform a garment treatment process (e.g., a heating process) that does not require water supply and drain and the first spot cleaning device 100*a* may be configured to perform a garment treatment process (e.g., washing fluid spraying process, suction process) that requires water supply and drain.

In an embodiment, it is also possible that the home position part 25 connectable to the water supply tub 34 and the drain tub 33 is arranged not only on the lower side but also on the upper side of the second chamber 22. In this case, the water supply tub 34 and the drain tub 33 may also be arranged not only on the lower side but also on the upper side.

In an embodiment, both the first spot cleaning device 100*a* and the second spot cleaning device 100*b* may be configured to perform a garment treatment process (e.g., the washing fluid spraying process or the suction process) that requires water supply and drain.

Figure 36:
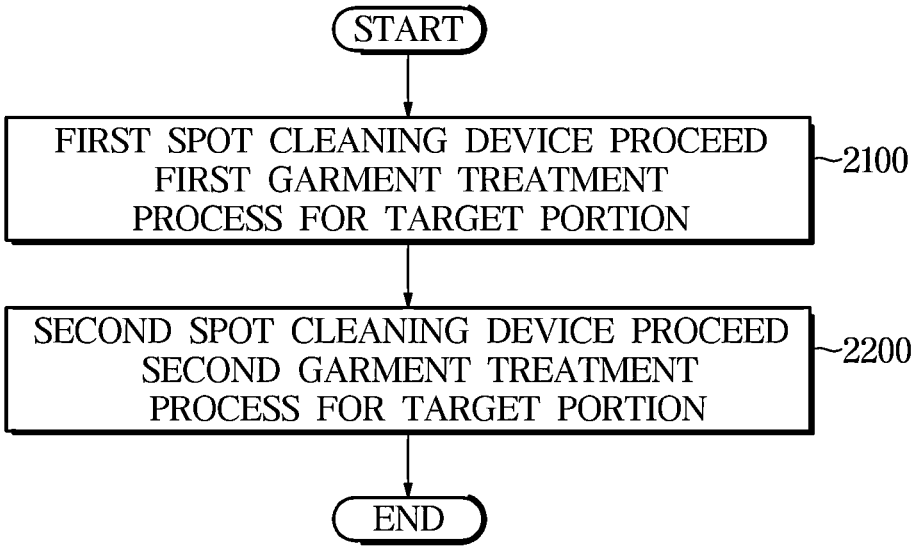
FIG. 36 illustrates an example of a method of controlling a clothes care apparatus including a first spot cleaning device and a second spot cleaning device, according to an embodiment.

FIG. 36 illustrates an example of a method of controlling a clothes care apparatus including a first spot cleaning device and a second spot cleaning device, according to an embodiment.

Referring to FIG. 36, the clothes care apparatus 1 may control the first spot cleaning device 100*a* to proceed a first garment treatment process for the target portion, in 2100.

In an embodiment, the clothes care apparatus 1 may control the first spot cleaning device 100*a* to proceed the first garment treatment process for the target portion, and then control the second spot cleaning device 100*b* to proceed the second garment treatment process for the target portion, in 2200.

Specifically, the controller 300 may control the moving device 200 to move the first spot cleaning device 100*a* to the target portion, control the first spot cleaning device 100*a* to proceed the first garment treatment process, control the moving device 200 to get away from the target portion based on completion of the first garment treatment process, control the moving device 200 to move the second spot cleaning device 100*b* to the target portion, and control the second spot cleaning device 100*b* to proceed the second garment treatment process.

The first garment treatment process may be the same process as the second garment treatment process or different from the second garment treatment process. For example, the first garment treatment process may include a washing process and the second garment treatment process may include an ironing process. In another example, the first garment treatment process may include a washing process including detergent spraying, and the second garment treatment process may include a washing process including fabric softener spraying. In another example, both the first garment treatment process and the second garment treatment process may include a washing process including detergent spraying.

In an embodiment, the first spot cleaning device 100*a* may be configured to clean the target portion of the garment accommodated in the second chamber 22, and the second spot cleaning device 100*b* may be configured to iron the target portion of the garment accommodated in the second chamber. Specifically, the first spot cleaning device 100*a* may include water sprayer 101, the washing fluid sprayer 102, the suction part 104 and the vibrator 103 (and/or the roller 105) for washing the target portion of the garment accommodated in the second chamber 22, and the second spot cleaning device 100*b* may include a heating module. In various embodiments, it is possible that the second spot cleaning device 100*b* includes the water sprayer 101 along with the heating module to independently perform the ironing process.

In an embodiment, the controller 300 may control the first spot cleaning device 100*a* to move to the target portion and proceed the washing process and control the second spot cleaning device 100*b* to move to the target portion and proceed the ironing process.

The washing process may include a washing fluid spraying process, a water spraying process, a vibrating process (and/or a rolling process) and a suction process.

The ironing process may include a heating process. In various embodiments, the ironing process may include a water spraying process and a heating process.

The target portion for which the washing process is done may be dried and unwrinkled by the ironing process.

In various embodiments, the controller 300 may control the first spot cleaning device 100*a* and the second spot cleaning device 100*b*, separately. For example, as described above, the controller 300 may identify a contaminated portion of a target garment and even a wrinkled portion in addition to the contaminated portion based on sensor data collected through the at least one sensor 108.

The controller 300 may control the first spot cleaning device 100*a* to perform the washing process on the contaminated portion of the target garment, and control the second spot cleaning device 100*b* to perform the ironing process for the wrinkled portion of the target garment.

When the second spot cleaning device 100*b* performs the ironing process independently from the first spot cleaning device 100*a*, the second spot cleaning device 100*b* may include the water sprayer 101. In this case, the ironing process may include the water spraying process and the heating process.

In various embodiments, the controller 300 may determine whether the ironing process is required for the target portion for which the washing process is done by the first spot cleaning device 100*a*. For example, the controller 300 may control the second spot cleaning device 100*b* to perform the ironing process for the target portion based on identification of wrinkles on the target portion for which the washing process has been performed by the first spot cleaning device 100*a*.

In an embodiment, the first spot cleaning device 100*a* may be configured to spray the detergent on the target portion of the garment accommodated in the second chamber 22, and the second spot cleaning device 100*b* may be configured to spray the fabric softener on the target portion of the garment accommodated in the second chamber. In other words, the first spot cleaning device 100*a* and the second spot cleaning device 100*b* may include the water sprayer 101 and the washing fluid sprayer 102 for spraying the detergent or the fabric softener onto the target portion of the garment accommodated in the second chamber 22. In an embodiment, the first spot cleaning device 100*a* configured to spray the detergent may further include the vibrator 103 and/or the roller 105, and the second spot cleaning device 100*b* configured to spray the fabric softener may further include the suction part 104.

It is obvious that the first spot cleaning device 100*a* may further include the suction part 104 and the second spot cleaning device 100*b* may further include the vibrator 103 and/or the roller 105.

The detergent may be contained in the detergent container 131 (see FIG. 8) of the first spot cleaning device 100*a* for spraying the detergent, and the fabric softener may be contained in the detergent container 131 (see FIG. 8) of the second spot cleaning device 100*b* for spraying the fabric softener.

The clothes care apparatus 1 may guide the user through the output interface 70*b* to replenish the detergent in the first spot cleaning device 100*a* and replenish the fabric softener in the second spot cleaning device 100*b*.

In an embodiment, the controller 300 may control the first spot cleaning device 100*a* to move to the target portion and spray the detergent and control the second spot cleaning device 100*b* to move to the target portion and spray the fabric softener.

Specifically, the controller 300 may control the first spot cleaning device 100*a* to move to the target portion and perform the washing process including detergent spraying and control the second spot cleaning device 100*b* to move to the target portion and perform the washing process including fabric softener spraying.

The target portion for which the washing process including the detergent spraying is done may not only lose the contaminants but also wear a scent by the washing process including the fabric softener spraying.

In the disclosure, provided is the clothes care apparatus 1 that increases the user's satisfaction with cleaning by not only cleaning the target portion but also providing a scent.

In an embodiment, both the first spot cleaning device 100*a* and the second spot cleaning device 100*b* may be configured to clean the target portion of the garment accommodated in the second chamber.

Specifically, the first spot cleaning device 100*a* and the second spot cleaning device 100*b* may include the water sprayer 101, the washing fluid sprayer 102, the suction part 104 and the vibrator 103 (and/or the roller 105).

In an embodiment, the controller 300 may control the first spot cleaning device 100*a* to move to the target portion and proceed a first washing process and control the second spot cleaning device 100*b* to move to the target portion and proceed a second washing process.

For example, the controller 300 may control the first spot cleaning device 100*a* to move to the target portion and perform the first washing process, and based on identification that the contaminants in the target portion are not removed, control the second spot cleaning device 100*b* to move to the target portion and perform the second washing process.

More specifically, the controller 300 may control the first spot cleaning device 100*a* to move to the target portion and perform the first washing process, identify whether the contaminants in the target portion are removed based on sensor data collected from the sensor 108 of the first spot cleaning device 100*a*, and based on identification that the contaminants in the target portion are not removed, control the second spot cleaning device 100*b* to move to the target portion and perform the second washing process.

In the disclosure, in the case that the contaminants are not completely removed from the target portion, the washing process may be proceeded one more to remove the contaminants in the target portion to the maximum.

In various embodiments, the controller 300 may control the first spot cleaning device 100*a* to move to a first target portion and perform the first washing process and control the second spot cleaning device 100*b* to move to a second target portion and perform the second washing process.

In this case, the first target portion and the second target portion may be different from each other, and the first spot cleaning device 100*a* and the second spot cleaning device 100*b* may proceed the washing processes, simultaneously.

Specifically, while the first spot cleaning device 100*a* is performing the first washing process for the first target portion, the second spot cleaning device 100*b* may perform the second washing process for the second target portion.

In the disclosure, as multiple washing processes are simultaneously proceeded for various portions on the target garment, cleaning speed may get faster.

In the disclosure, at least two spot cleaning devices may be used to perform various garment treatment processes for one target portion or simultaneously perform the garment treatment processes for a plurality of target portions.

Figure 37:
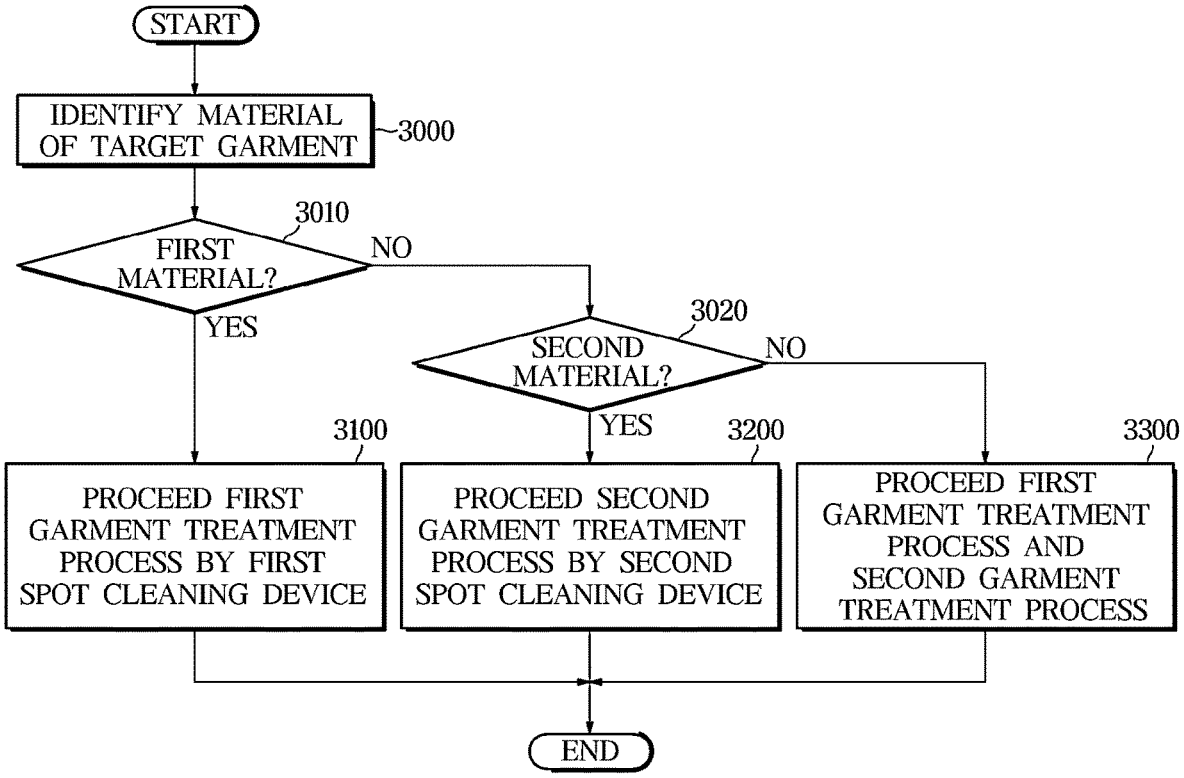
FIG. 37 illustrates another example of a method of controlling a clothes care apparatus including a first spot cleaning device and a second spot cleaning device, according to an embodiment.

FIG. 37 illustrates another example of a method of controlling a clothes care apparatus including a first spot cleaning device and a second spot cleaning device, according to an embodiment.

Referring to FIG. 37, the clothes care apparatus 1 may identify a material of a target garment, in 3000.

As described above, the controller 300 may identify the material of the garment by using data (e.g., image data and/or light intensity data) collected by the at least one sensor 108 as input data to an AI model trained to determine the material of the garment.

In another example, the clothes care apparatus 1 may include a short-range communication reader (e.g., an RFID reader), and the short-range reader may obtain material information of the garment from a short-range communication tag attached to the target garment.

In another example, the material of the target garment may be selected through the input interface 70*a*.

The clothes care apparatus 1 may identify a garment treatment process to be performed for the target garment based on the material of the target garment.

For example, the memory 320 may store a look-up table in which garment materials are mapped to types of garment treatment processes to be performed.

Ultrasonic vibration may cause damages on the garment depending on the garment material. For example, in a case that the garment material is fiber or nylon, the garment may be likely to be damaged when the ultrasonic vibration is applied to the garment.

A rolling process may cause damages on the garment depending on the garment material. For example, in a case that the garment material is a knit, the garment may be likely to be damaged when the roller 105 is rotated.

Hereinafter, assume that only the vibrating process is possible for a first material among the vibrating process and the rolling process; only the rolling process is possible for a second material among the vibrating process and the rolling process; both the vibrating process and the rolling process are possible for a material other than the first material and second material.

In an embodiment, the first spot cleaning device 100*a* may include a vibrator, and the second spot cleaning device 100*b* may include a roller.

The controller 300 may control the first spot cleaning device 100*a* to perform the vibrating process on the target portion, the second spot cleaning device 100*b* to perform the rolling process on the target portion, or the first spot cleaning device 100*a* and the second spot cleaning device 100*b* to perform the vibrating process and the rolling process on the target portion based on the material of the target garment.

In an embodiment, the controller 300 may control the first spot cleaning device 100*a* to perform the vibrating process on the target portion and the second spot cleaning device 100*b* not to perform any process on the target portion in 3100, based on the material of the target garment being identified as the first material in 3010.

In an embodiment, the controller 300 may control the second spot cleaning device 100*b* to perform the rolling process on the target portion and the first spot cleaning device 100*a* not to perform any process on the target portion in 3200, based on the material of the target garment being identified as the second material in 3020.

In an embodiment, the controller 300 may control the first spot cleaning device 100*a* to perform the vibrating process on the target portion and the second spot cleaning device 100*b* to perform the rolling process on the target portion in 3300, based on the material of the target garment being not identified as the first material and the second material in 3020.

In an embodiment, the controller 300 may control the second spot cleaning device 100*b* to perform the rolling process on the target portion and the first spot cleaning device 100*a* to perform the vibrating process on the target portion in 3300, based on the material of the target garment being not identified as the first material and the second material in 3020.

In various embodiments, the sequence of the vibrating process and the rolling process may be changed according to the type of the contaminant material in the target portion.

In an embodiment, the spot cleaning device 100 may include a sensor for detecting the type of the contaminant material in the target portion.

In an embodiment, the sensor for detecting the type of the contaminant material in the target portion may include the at least one sensor 108 (e.g., a camera and/or a photo sensor) as described above.

The controller 180 may identify the type of the contaminant material by using data (e.g., image data and/or light intensity data) collected by the at least one sensor 108 as input data to an AI model trained to determine the type of the contaminant material.

The AI model trained to determine the type of the contaminant material may be stored in the spot cleaning device 100 or in an external device.

In the case that the AI model trained to determine the type of the contaminant material is stored in the external device, the controller 300 may control the communicator 330 to transmit the data (e.g., image data and/or light intensity data) collected by the at least one sensor 108 to the external device. The external device may identify the material by inputting the data collected by the at least one sensor 108 and received from the spot cleaning device 100 to the AI trained to determine the type of the contaminant material.

In an embodiment, the user may select the type of the contaminant material through the input interface 70*a*.

The type of the contaminant material may be classified into two. For example, the type of the contaminant material may be classified into a first type (e.g., dust) that may be dusted from the garment or a second type (e.g., a stain) that may not be dusted from the garment.

In response to the type of the contaminant material being identified as the first type (e.g., dust) that may be dusted from the garment, the controller 300 may control the first spot cleaning device 100*a* and the second spot cleaning device 100*b* to perform the rolling process and then perform the vibrating process.

In response to the type of the contaminant material being identified as the first type (e.g., dust) that may be dusted from the garment, the controller 300 may control the second spot cleaning device 100*b* to skip the vibrating process and perform only the rolling process.

In response to the type of the contaminant material being identified as the second type (e.g., a stain) that may not be dusted from the garment, the controller 300 may control the first spot cleaning device 100*a* and the second spot cleaning device 100*b* to perform the vibrating process and then perform the rolling process.

In response to the type of the contaminant material being identified as the second type (e.g., a stain) that may not be dusted from the garment, the controller 300 may control the first spot cleaning device 100*a* to skip the rolling process and perform only the vibrating process.

The controlling of the first spot cleaning device 100*a* to perform the vibrating process on the target portion and the controlling of the second spot cleaning device 100*b* to perform the rolling process on the target portion may include controlling the first spot cleaning device 100*a* to perform the vibrating process on the target portion and then controlling the second spot cleaning device 100*b* to perform the rolling process on the target portion, and/or controlling the second spot cleaning device 100*b* to perform the rolling process on the target portion and then controlling the first spot cleaning device 100*a* to perform the vibrating process on the target portion.

According to the disclosure, as the contaminant material is removed in a suitable method depending on the material of the target garment, cleaning power may be maximized.

In various embodiments, examples of the first garment treatment process and the second garment treatment process are not limited to the vibrating process and the rolling process.

For example, the ironing process is sometimes not possible depending on the garment material.

The controller 300 may control the first spot cleaning device 100*a* or the second spot cleaning device 100*b* not to perform the ironing process on the target garment based on the garment material being identified as a material for which ironing is impossible.

In an embodiment, the clothes care apparatus 1 includes the cabinet 10, the first chamber 11 formed inside the cabinet and configured to accommodate a garment, the first door 20 configured to open or close the first chamber 11, having the second chamber 22 separated from the first chamber 11 and configured to accommodate a garment, and including the door water supply tub 34 and the door drain tub 33, the second door 30 pivotally coupled to the first door 20 to open or close the second chamber 22, and the spot cleaning device 100 arranged inside the second chamber 22 to partially clean the garment accommodated in the second chamber 22 and including the water supply tub 121 and the drain tub 122. The water supply tub of the spot cleaning device 100 may receive water from the door water supply tub and the drain tub of the spot cleaning device may drain water into the door drain tub.

The spot cleaning device may be movable in the second chamber.

The first door may further include the home position part 25 placed inside the second chamber and able to be coupled to the spot cleaning device.

When the spot cleaning device is coupled to the home position part, the water supply tub may be coupled to the door water supply tub to receive water from the door water supply tub, and the drain tub may be coupled to the door drain tub to release water into the door drain tub.

The home position part may include the first opening 25*c* formed for the water of the door water supply tub to pass through.

The clothes care apparatus 1 may further include the water supply pump 35 placed below the first opening and configured to move the water in the door water supply tub into the water supply tub located above the first opening when the spot cleaning device is coupled to the home position part.

The home position part may further include the second opening 25*d* formed for the water of the drain tub to pass through.

The clothes care apparatus 1 may further include the drain pump 36 placed below the second opening and configured to move the water in the drain tub located above the second opening into the door drain tub when the spot cleaning device is coupled to the home position part.

The clothes care apparatus 1 may further include the first hose 37*c* configured to connect the first opening to the outlet of the water supply pump.

The clothes care apparatus 1 may further include the second hose 37*d* configured to connect the second opening to the inlet of the drain pump.

The first door may further include the third chamber 30*a* configured to accommodate the door water supply tub, the door drain tub, the water supply pump, the drain pump, the first hose and the second hose.

The clothes care apparatus 1 may further include the cover 30*b* covering at least a portion of the third chamber to prevent the water supply pump, the drain pump, the first hose and the second hose from being exposed to the outside.

The cover may be separated in the forward direction of the first door.

The door water supply tub may be detachable in the forward or backward direction of the first door.

The door drain tub may be detachable in the forward or backward direction of the first door.

The spot cleaning device may include the water supply part 124 coupled to the water supply tub to supply water into the water supply tub and able to be coupled to the home position part, and the drain part 125 coupled to the drain tub to discharge water from the drain tub and able to be coupled to the home position part.

The water supply part may include the first check valve 124*a* configured to prevent the water in the water supply tub from being discharged by gravity through the water supply part.

The drain part may include the second check valve 125*a* configured to prevent the water in the drain tub from being discharged by gravity through the drain part.

The home position part may include the first opener 25*e* configured to open the first check valve when the water supply part is coupled to the home position part, and the second opener 25*f* configured to open the second check valve when the drain part is coupled to the home position part.

The spot cleaning device may include the water sprayer 101 configured to spray water, the washing fluid sprayer 102 configured to spray a washing fluid, which is a mixture of water and a detergent, and the suction part 104 configured to draw in the water, the washing fluid and foreign materials.

The spot cleaning device may include at least one of the vibrator 103 configured to provide microvibration for the garment or the roller 105 configured to contact the garment and get rid of contaminants on the garment.

The spot cleaning device may further include the water supply pump 140 configured to move the water in the water supply tub into the washing fluid sprayer, the drain pump 150 configured to move the water from the suction part to the drain tub, and the battery 118*b* configured to supply power to the water supply pump and the drain pump.

The spot cleaning device may include the first charging terminals 115*a* and 115*b* electrically connected to the battery.

The home position part 25 may include the second charging terminals 25*a* and 25*b* connected to the first charging terminals and configured to charge the battery.

The spot cleaning device 100 may include the first spot cleaning device 100*a* and the second spot cleaning device 100*b*, and the clothes care apparatus 1 may further include the controller 300 for controlling the first spot cleaning device 100*a* and the second spot cleaning device 100*b*.

The first spot cleaning device 100*a* may be configured to clean the target portion of the garment accommodated in the second chamber, and the second spot cleaning device 100*b* may be configured to iron the target portion of the garment accommodated in the second chamber, and the controller 300 may control the first spot cleaning device 100*a* to move to the target portion and proceed a washing process and control the second spot cleaning device 100*b* to move to the target portion and proceed an ironing process.

The first spot cleaning device 100*a* may be configured to spray a detergent on the target portion of the garment accommodated in the second chamber, and the second spot cleaning device 100*b* may be configured to spray fabric softener on the target portion of the garment accommodated in the second chamber, and the controller 300 may control the first spot cleaning device 100*a* to move to the target portion and spray the detergent and control the second spot cleaning device 100*b* to move to the target portion and spray the fabric softener.

The first spot cleaning device 100*a* and the second spot cleaning device 100*b* may all be configured to clean the target portion of the garment accommodated in the second chamber, and the controller 300 may control the first spot cleaning device 100*a* to move to the target portion and perform a first washing process, and based on identification that contaminants in the target portion are not removed, control the second spot cleaning device 100*b* to move to the target portion and perform a second washing process.

The first spot cleaning device 100*a* may include a vibrator for performing a vibrating process which provides vibration to the target portion of the garment accommodated in the second chamber, the second spot cleaning device 100*b* may include a roller for performing a rolling process which removes contaminants in the target portion of the garment accommodated in the second chamber, and the controller 300 may control the first spot cleaning device 100*a* to perform the vibrating process on the target portion, the second spot cleaning device 100*b* to perform the rolling process on the target portion, or the first spot cleaning device 100*a* and the second spot cleaning device 100*b* to perform the vibrating process and the rolling process on the target portion based on a material of the garment accommodated in the second chamber.

According to the disclosure, a clothes care apparatus including a spot cleaning device to do the partial wash on the garment may be provided.

According to the disclosure, a clothes care apparatus may be configured to increase space availability by arranging the spot cleaning device in a separate space formed inside the door.

According to the disclosure, a clothes care apparatus capable of supplying and draining water without separating a water supply tub and a drain tub of a spot cleaning device from the spot cleaning device may be provided.

According to the disclosure, a clothes care apparatus capable of automatically supplying water into a water supply tub and draining water from a drain tub of a spot cleaning device may be provided.

According to the disclosure, a clothes care apparatus capable of supplying water from a door water supply tub having relatively large volume to a water supply tub of a spot cleaning device having relatively small volume may be provided.

According to the disclosure, a clothes care apparatus capable of draining water from a drain tub of a spot cleaning device having relatively small volume to a door drain tub having relatively large volume may be provided.

In the disclosure, at least two spot cleaning devices may be used to perform various garment treatment processes for one target portion or simultaneously perform the garment treatment processes for a plurality of target portions.

Meanwhile, the embodiments of the disclosure may be implemented in the form of a recording medium for storing instructions to be carried out by a computer. The instructions may be stored in the form of program codes, and when executed by a processor, may generate program modules to perform operations in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment of the disclosure, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

Several embodiments of the disclosure have been described above, but a person of ordinary skill in the art will understand and appreciate that various modifications can be made without departing from the scope of the disclosure. Thus, it will be apparent to those of ordinary skill in the art that the true scope of technical protection is only defined by the following claims.

What is claimed is:

1. A clothes care apparatus comprising:

a cabinet;

a first chamber formed inside the cabinet, and configured to accommodate a garment to clean;

a first door:

configured to open or close the first chamber;

having a second chamber separated from the first chamber and configured to accommodate a garment to clean; and comprising a door water supply tub and a door drain tub;

a second door pivotally coupled to the first door to open or close the second chamber; and a spot cleaning device arranged inside the second chamber to spot clean the garment accommodated in the second chamber, the spot cleaning device including:

a water supply tub connectable to the door water supply tub to receive water, to be used to spot clean the garment accommodated in the second chamber, from the door water supply tub; and a drain tub connectable to the door drain tub to release the water from the spot cleaning device to the door drain tub.

2. The clothes care apparatus of claim 1, wherein the spot cleaning device is movable in the second chamber.

3. The clothes care apparatus of claim 2, wherein:

the first door further comprises a home position part placed inside the second chamber, and to be coupled to the spot cleaning device, and in response to the spot cleaning device being coupled to the home position part, the water supply tub is connected to the door water supply tub; and the drain tub is connected to the door drain tub.

4. The clothes care apparatus of claim 3, wherein home position part comprises a first opening formed for the water of the door water supply tub to pass through, and the clothes care apparatus further comprises a water supply pump placed below the first opening and configured to move the water in the door water supply tub into the water supply tub located above the first opening in response to the spot cleaning device being coupled to the home position part.

5. The clothes care apparatus of claim 4, wherein the home position part further comprises a second opening formed for the water of the drain tub to pass through, and the clothes care apparatus further comprises a drain pump placed below the second opening and configured to move the water in the drain tub located above the second opening into the door drain tub in response to the spot cleaning device being coupled to the home position part.

6. The clothes care apparatus of claim 5, further comprising:

a first hose configured to connect the first opening to an outlet of the water supply pump; and a second hose configured to connect the second opening to an inlet of the drain pump.

7. The clothes care apparatus of claim 6, wherein the first door further comprises a third chamber configured to accommodate the door water supply tub, the door drain tub, the water supply pump, the drain pump, the first hose, and the second hose.

8. The clothes care apparatus of claim 7, further comprising:

a cover to cover at least a portion of the third chamber to prevent the water supply pump, the drain pump, the first hose, and the second hose from being exposed to outside, wherein the cover is detachable in a forward direction of the first door.

9. The clothes care apparatus of claim 7, wherein:

the door water supply tub is detachable in a forward or backward direction of the first door; and the door drain tub is detachable in the forward or backward direction of the first door.

10. The clothes care apparatus of claim 3, wherein the spot cleaning device comprises:

a water supply part coupled to the water supply tub to supply the water from the door water supply tub into the water supply tub, and to be coupled to the home position part; and a water drain part coupled to the water drain tub to drain the water from the water drain tub to the door drain tub, and to be coupled to the home position part, and wherein the water supply part comprises a first check valve configured to prevent the water in the water supply tub from being discharged by gravity through the water supply part, and wherein the drain part comprises a second check valve configured to prevent the water in the drain tub from being discharged by gravity through the drain part.

11. The clothes care apparatus of claim 10, wherein the home position part comprises:

a first opener configured to open the first check valve in response to the water supply part being coupled to the home position part; and a second opener configured to open the second check valve in response to the drain part being coupled to the home position part.

12. The clothes care apparatus of claim 1, wherein the spot cleaning device comprises:

a water sprayer configured to spray the water supplied from the water supply tub;

a washing fluid sprayer configured to spray a washing fluid which is a mixture of the water supplied from the water supply tub and a detergent; and a suction part configured to draw in the water, the washing fluid and foreign materials.

13. The clothes care apparatus of claim 1, wherein the spot cleaning device comprises:

at least one of a vibrator configured to vibrate a garment; and a roller configured to contact a garment to remove contaminants on the garment by rolling on the garment.

14. The clothes care apparatus of claim 12, wherein the spot cleaning device comprises:

a water supply pump configured to move the water in the water supply tub into the washing fluid sprayer, a drain pump configured to move the water from the suction part into the drain tub; and a battery configured to supply power to operate the water supply pump and the drain pump.

15. The clothes care apparatus of claim 14, wherein:

the first door further comprises a home position part placed inside the second chamber, and to be coupled to the spot cleaning device, the spot cleaning device comprises a first charging terminal electrically connected to the battery, and the home position part comprises a second charging terminal connected to the first charging terminal and configured to charge the battery.

* * * * *